US006727050B2

(12) United States Patent
Hosokawa

(10) Patent No.: US 6,727,050 B2
(45) Date of Patent: Apr. 27, 2004

(54) SILVER HALIDE PHOTOGRAPHIC LIGHTSENSITIVE MATERIAL AND IMAGE FORMING METHOD USING THE SAME

(75) Inventor: Junichiro Hosokawa, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/108,956

(22) Filed: Mar. 29, 2002

(65) Prior Publication Data

US 2003/0054297 A1 Mar. 20, 2003

(30) Foreign Application Priority Data

Mar. 29, 2001 (JP) ..... 2001-097245

(51) Int. Cl.[7] ..... G03C 5/16; G03C 1/498

(52) U.S. Cl. ..... 430/351; 380/523; 380/566; 380/620

(58) Field of Search ..... 430/523, 567, 430/566, 350, 620, 380, 351

(56) References Cited

U.S. PATENT DOCUMENTS 6,066,440 A * 5/2000 Araki et al. ..... 430/354

FOREIGN PATENT DOCUMENTS

| | | | |
|---|---|---|---|
| EP | 0902322 | * | 3/1999 |
| JP | 11-133541 A | | 5/1999 |
| JP | 2000-267228 A | | 9/2000 |

* cited by examiner

*Primary Examiner*—Thorl Chea
(74) *Attorney, Agent, or Firm*—Birch, Stewart, Kolasch & Birch, LLP

(57) ABSTRACT

A silver halide photographic lightsensitive material comprises, on a support, at least one lightsensitive silver halide emulsion layer and at least one non-lightsensitive layer. The roughness of the surfaces of the lightsensitive material satisfies the relationship of formula (1):

$$Rq1/Rq2 \leqq 0.5 \quad (1)$$

wherein Rq1 is the roughness of one of the surfaces of the lightsensitive material with which a heat source is to be brought into contact, and Rq2 is the roughness of the other opposing surface of the lightsensitive material.

21 Claims, No Drawings

SILVER HALIDE PHOTOGRAPHIC LIGHTSENSITIVE MATERIAL AND IMAGE FORMING METHOD USING THE SAME

CROSS-REFERENCE TO RELATED APPLICATION

This application is based upon and claims the benefit of priority from the prior Japanese Patent Application No. 2001-97245, filed Mar. 29, 2001, the entire contents of which are incorporated herein by reference.

BACKGROUND OF THE INVENTION

1. Field of the Invention

The present invention relates to a novel silver halide photographic lightsensitive material (hereinafter referred to simply as "lightsensitive material") and an image-forming method using the same. More particularly, the present invention relates to a silver halide photographic lightsensitive material having a high sensitivity, and being excellent in rapid processing suitability, improving ability of development-induced unevenness and an adhesion resistance during the storage thereof, and to an image-forming method using the same.

2. Description of the Related Art

Today, it has become possible to easily obtain a high-quality recorded image by virtue of photographic lightsensitive materials using silver halide. For example, in a system usually called a color photograph, photographing is performed using a color negative film, and image information recorded on the color negative film after development is optically printed on a color print paper to obtain a color print. Recently, this process has advanced to a higher level so that a color lab, which is a large-scale centralized base for producing a large quantity of color prints in high efficiency, or a so-called mini lab, which is a compact and simple printer processor installed at a shop, is popularized, and as a result, anybody can easily enjoy color photographs.

The above-described system is widely popularized at present. However, demands for further simplification thereof are more and more increasing. For example, first, the composition and the temperature of processing baths for performing development, bleaching and fixing need to be precisely controlled, and therefore, professional knowledge and advanced operation are required. Second, the processing solutions contain materials whose the discharge is necessary to be restricted in view of environmental conservation, such as a developing agent and a bleaching agent such as a chelate compound, and therefore, installation of equipments, such as developing equipments, requires facilities for exclusive use thereof. Third, although the recent technological development has shortened the time spent for the above-described development processing, such processing still needs time and accordingly is at a level insufficient to meet the demand for rapid reproduction of recorded images. Thus, there still is room for further improvement as a system.

Moreover, demands for lightsensitive materials have become stronger. There also is a higher-level demand for photographic characteristics such as high speed, image qualities such as graininess and sharpness, and in addition, so-called toughness such as storage stability and resistance to pressure.

Rapidly processable lightsensitive materials containing tabular silver halide emulsions are disclosed in Jpn. Pat Appln. KOKAI Publication No. (hereinafter referred to as JP-A-) 10-15888, JP-A's-10-62936, 9-61960, 62-78555 and the like. These techniques can provide high speed and rapidly processable lightsensitive materials, but are still insufficient in terms of toughness such as their storage stability, resistance to pressure.

Unlike the conventional developing method in which a lightsensitive material is immersed in a developing solution, the attempt to perform development by a method in which a heat source at high temperature, such as 60° C. to 180° C., is brought into contact, directly or through a certain processing member, with the surface of a lightsensitive material has cause new problems. It has been found that in this developing method, developing unevenness easily occurs due to the unevenness and roughness in the surface of a lightsensitive material and also that the surface of a lightsensitive material is required to be kept smoother than in the conventional method. However, it has been found that if the surface of a lightsensitive material is made too smooth, adhesion between the front face and the back face of the lightsensitive material occurs during its raw stock storage and its wound storage, causing serious deterioration in photographic performance.

JP-A-2000-267228 discloses a technique for preventing an image from roughing when printing is conducted using a specular light source by defining the grain diameter of matting agent grains and the surface roughness of the outermost layer. This publication discloses how to effect more efficiently the dissolution of the matting agent with alkali during development processing. However, there is no description on a problem caused by a method, according to the present invention, of developing a lightsensitive material by contacting, directly or through a certain processing member, with a high-temperature heat source, and on the solution of this problem.

BRIEF SUMMARY OF THE INVENTION

An object of the present invention is to provide a silver halide photographic lightsensitive material that generates less processing-induced unevenness even in a simple and rapid processing and also is excellent in adhesion resistance. Another object of the present invention is to provide an image-forming method that is able to withstand practical use using the silver halide photographic lightsensitive material.

The above-mentioned objects of the present invention has successfully been attained by the following means:

(1) A silver halide photographic lightsensitive material comprising, on a support, at least one lightsensitive silver halide emulsion layer and at least one non-lightsensitive layer, wherein the roughness of the surfaces of the lightsensitive material satisfies the relationship of formula (1):

$$Rq1/Rq2 \leqq 0.5 \quad (1)$$

wherein Rq1 is the roughness of one of the surfaces of the lightsensitive material with which a heat source is to be brought into contact, and Rq2 is the roughness of the other opposing surface of the lightsensitive material (2) The silver halide photographic lightsensitive material according to item (1) above, wherein Rq1 is 50 or less and Rq2 is 100 or more.

(3) The silver halide photographic lightsensitive material according to item (1) or (2) above, wherein the outermost layer of one of the sides of the lightsensitive material with which a heat source is to be brought into contact comprises no matting agent grain, and the outermost layer of the other opposing side of the lightsensitive material comprises a matting agent grain.

(4) The silver halide photographic lightsensitive material according to any one of items (1) to (3) above, wherein the lightsensitive silver halide emulsion layer comprises a lightsensitive silver halide emulsion containing tabular silver halide grains having an average grain thickness of 0.01 μm or more and 0.12 μm or less.

(5) The silver halide photographic lightsensitive material according to any one of items (1) to (4) above, wherein the lightsensitive silver halide emulsion layer comprising a lightsensitive silver halide emulsion containing tabular silver halide grains having adsorbed a sensitizing dye or sensitizing dyes so that the grains have a maximum spectral absorption wavelength of less than 500 nm and a light absorption intensity of 60 or more or have a maximum spectral absorption wavelength of 500 nm or more and a light absorption intensity of 100 or more.

(6) The silver halide photographic lightsensitive material according to any one of items (1) to (5) above, wherein the lightsensitive silver halide emulsion layer and/or the non-lightsensitive layer contain a developing agent and/or a precursor thereof.

(7) The silver halide photographic lightsensitive material according to item (6) above, wherein the developing agent is at least one compound selected from the group consisting of compounds represented by the following general formulas (1) to (5):

(1)

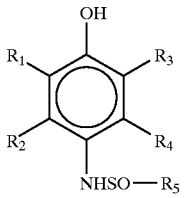

(2)

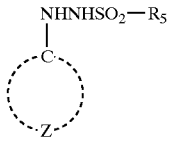

(3)

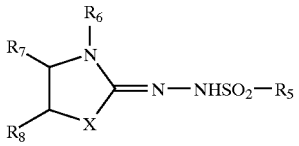

(4)

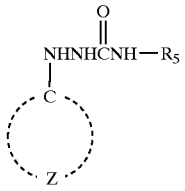

-continued (5)

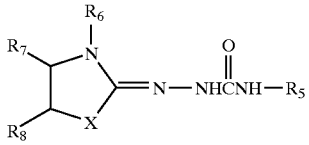

wherein each of $R_1$ to $R_4$ independently represents a hydrogen atom, halogen atom, alkyl group, aryl group, alkylcarbonamido group, arylcarbonamido group, alkylsulfonamido group, arylsulfonamido group, alkoxy group, aryloxy group, alkylthio group, arylthio group, alkylcarbamoyl group, arylcarbamoyl group, carbamoyl group, alkylsulfamoyl group, arylsulfamoyl group, sulfamoyl group, cyano group, alkylsulfonyl group, arylsulfonyl group, alkoxycarbonyl group, aryloxycarbonyl group, alkylcarbonyl group, arylcarbonyl group or acyloxy group; $R_5$ represents a substituted or unsubstituted alkyl group, aryl group or heterocyclic group; Z represents an atom group capable of forming an aromatic ring (including a heteroaromatic ring) together with the carbon atom, and the aromatic ring may have a substituent, provided that when Z forms a benzene ring, the total of Hammett's constants (σ) of the substituents is 1 or more; $R_6$ represents a substituted or unsubstituted alkyl group; X represents an oxygen atom, sulfur atom, selenium atom or tertiary nitrogen atom substituted with at least one of alkyl and aryl groups; and $R_7$ and $R_8$ each represent a hydrogen atom or substituent, provided that $R_7$ and $R_8$ may be bonded to each other to thereby form a double bond or ring (8) The silver halide photographic lightsensitive material according to item (6) above, wherein the developing agent is at least one derivative selected from p-phenylenediamine derivatives and p-aminophenol derivatives.

(9) The silver halide photographic lightsensitive material according to item (6) above, wherein the precursor of a developing agent being a compound represented by the following general formula (6):

(6)

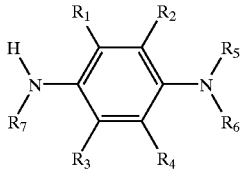

wherein each of $R_1$, $R_2$, $R_3$ and $R_4$ independently represents a hydrogen atom or substituent; each of $R_5$ and $R_6$ independently represents an alkyl group, aryl group, heterocyclic group, acyl group or sulfonyl group; $R_1$ and $R_2$, $R_3$ and $R_4$, $R_5$ and $R_6$, $R_2$ and $R_5$ and/or $R_4$ and $R_6$ may be bonded to each other to thereby form a 5-membered, 6-membered or 7-membered ring; and $R_7$ represents $R_{11}$—O—CO—, $R_{12}$—CO—CO—, $R_{13}$—NH—CO—, $R_{14}$—$SO_2$—, $R_{15}$—W—C($R_{16}$)($R_{17}$)— or $(M)_{1/n}OSO_2$—, wherein each of $R_{11}$, $R_{12}$, $R_{13}$ and $R_{14}$ independently represents an alkyl group, aryl group or heterocyclic group, $R_{15}$ represents a hydrogen atom or blocking group, W represents an oxygen atom, sulfur atom or >N—$R_{18}$, each of $R_{16}$, $R_{17}$ and $R_{18}$ independently represents a hydrogen atom or alkyl group, M represents a n-valence cation, and n is an integer of 1 to 5.

(10) The silver halide photographic lightsensitive material according to any one of items (1) to (9) above, wherein the lightsensitive silver halide emulsion layer and/or the non-lightsensitive layer contain an organometallic salt.

(11) An image-forming method comprising heat-developing the silver halide photographic lightsensitive material recited in any one of items (1) to (10) above by bringing the lightsensitive material into contact with a heat source.

(12) The image-forming method recited in item (11) above, wherein the development temperature is 60° C. or more and 180° C. or less.

(13) The image-forming method recited in item (11) or (12) above, wherein the developing time is 5 seconds or more and 60 seconds or less.

(14) The image-forming method recited in any one of items (11) to (13) above, wherein a lightsensitive silver halide emulsion layer of the lightsensitive material is brought into contact with the heat source to heat-develop the lightsensitive material.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The present invention will be described in detail below.

There will be described a lightsensitive material of the invention and an image-forming method wherein an original image is obtained on the lightsensitive material and thereafter an image is obtained on another recording material based on information of the original image.

In the present invention, color reproduction by subtractive color process can fundamentally be used for constituting a lightsensitive material to be used for recording an original scene and reproducing it as a color image. For example, color information of an original scene can be recorded by providing at least three lightsensitive layers having sensitivity in the blue, green and red regions and incorporating into each lightsensitive layer a color coupler capable of forming yellow, magenta and cyan dyes, respectively each having a complementary relation to the sensitive wavelength region of the layer itself. Through the thus-obtained dye image, a color lightsensitive material having the same relationship between the sensitive wavelength and the colored hue is exposed and thereby, an image for viewing can be reproduced. Further, information of an image obtained by photographing an original scene may be optically read with a scanner or the like to output an image for viewing based on the information. It is preferable for rapid processing that image information is read after a color development processing and immediately before a desalting step. Furthermore, it is also preferable, from the viewpoint of the speedup and simplification of processing, to use a lightsensitive material as an original in which unreacted silver halide is allowed to substantially remain without desalting the unreacted silver halide during development. Besides silver halide-utilized lightsensitive materials, sublimation type heat-sensitive recording materials, full-color direct heat-sensitive recording materials, ink jet recording materials, electrophotographic materials and the like can be employed as a material to which an image is output.

Further, it is possible to allow the lightsensitive wavelength region and the developed color hue to have therebetween a relationship other than the above-described complementary color relation. In this case, the original color information can be reproduced by applying image processing such as hue conversion after taking the image information as described above.

As the lightsensitive material of the present invention, a lightsensitive layer having light-sensitivity in at least three kinds of wavelength region may be provided. For example, it is also possible to form a lightsensitive layer having a light-sensitivity in the region of infrared rays as well as visible regions of blue, green and red.

The lightsensitive material of the present invention can be applied to B/W lightsensitive materials and also to various color lightsensitive materials such as color negative films for general purposes or cinemas, color reversal films for slides and TV, color paper, color positive films, color reversal paper and color diffusion transfer films.

In the present invention, the image-forming method that is able to withstand practical use means to develop the above-mentioned lightsensitive material constituted so as to form an image with photographic characteristics (sensitivity, gradation, color reproduction, graininess, sharpness and toughness) that can withstand to practical use as a commercial product so as to obtain a recorded image that can withstand to practical use by exposing the lightsensitive material in an exposure amount corresponding to an effective photographing range. When used as a lightsensitive material for photographing, the exposure is usually conducted for 1/10000 to 10 seconds. Further, the temperature in development may be selected from arbitral temperature, but it is preferably is 60° C. or more and 180° C. or less, more preferably is 80° C. or more and 160° C. or less. The developing time is preferably chosen from between 5 and 60 seconds, and more preferably is from 5 to 45 seconds.

Next, a matting agent that can be used for the present invention will be described.

A lightsensitive material generally has an outermost layer (surface layer) containing a hydrophilic organic colloid typified by gelatin as a binder. Therefore, the surface of a lightsensitive material becomes to have enhanced adhesiveness or tackiness under atmosphere of high temperature and high humidity, and when it comes into contact with another object, it easily adhere to the object. This adhesion phenomenon occurs between lightsensitive materials or between a lightsensitive material and an object bringing into contact therewith during the production or storage of lightsensitive materials, at the time of preparing, storing, photographing, processing or screening, or during storage after processing. That phenomenon often causes serious defects. In order to improve such poor adhesion property under high temperature and high humidity, it is known to provide unevenness to the surface of a lightsensitive material. A method in which adhesiveness is reduced by incorporating fine grains of organic or inorganic substance to increase the roughness of the surface of a lightsensitive material, thereby performing so-called matting is well known in the art. However, since a reduction of sharpness and an increase in haze are caused in a lightsensitive material as a surface is roughened more, the average grain diameter and content of the fine grains are limited. The matting agent to be used in the present invention has an average grain size of from $10^{-3}$ to $10^{2}$ μm, preferably from $10^{-1}$ to 10 μm, and more preferably from 0.5 to 5 μm. The average grain size is calculated by using the diameter of a matting agent when it is in spherical shape or by using the diameter of a sphere with the same volume as the matting agent when the mating agent has indefinite shape as the diameter thereof. Further, regardless of the shape of the matting agent, i.e., whether the matting agent, for example, has a spherical or indefinite shape, the content thereof is 0.1 to $10^{3}$ mg/m$^{2}$, preferably 5 to 300 mg/m$^{2}$, and more preferably 20 to 250 mg/m$^{2}$. The matting agent-containing layer is not particularly limited to what layer(s) of the emulsion side and/or the back side, and may be contained in a plurality of layers. Preferably, it is the outermost layer(s) of the emulsion side and/or the back side. It is more preferably to use a matting agent layer as the outermost layer of the back layer. Further, the thickness of the outermost layer is not particularly limited, but is preferably 0.05 to 10 μm, and more preferably 0.15 to 6 μm. The matting agent to be used is not specifically limited in its composition but preferably is an inorganic compound or a high molecular compound having a glass transition temperature Tg of 50° C. or more. Further, the matting agent is a high molecular agent preferably having Tg of 60° C. or more, more preferably 65° C. or more. Two or more of these matting agents may be used in admixture.

Examples of an inorganic compound which can be used as a matting agent include fine grains of inorganic compounds such as barium sulfate, manganese colloid, titanium dioxide, strontium barium sulfate and silicon dioxide, in addition, silicon dioxide such as synthetic silica obtained by wet process or gelation of silicic acid, and titanium dioxide (rutile type or anatase type) produced from titanium slug with sulfuric acid. Such a matting agent can also be obtained by grinding inorganic compound grains having a grain diameter as relatively large as 20 μm or more, and then classifying the grains (vibrating filtration, air classification, etc.). Examples of the high molecular compounds include polytetrafluoroethylene, cellulose acetate, polystyrene, polymethyl methacrylate, polyporpyl methacrylate, polymethyl acrylate, polyethylene carbonate, and starch. A matting agent obtained by grinding and classifying these high molecular compounds can be also used. Alternatively, high molecular compounds synthesized by suspension polymerization, high molecular compounds or inorganic compounds formed into sphere by spray drying and dispersion may be used. The matting agent may also comprise grains obtained by forming, by various means, high molecular compounds that are polymer from one kind or two or more kinds of monomers such as those described later. Specific examples of the monomer compounds for the high molecular compounds include acrylic ester, methacrylic ester, itaconic diester, crotonic ester, maleic diester and phthalic diesters. Examples of the residual groups of esters include methyl, ethyl, propyl, isopropyl, butyl, hexyl, 2-ethylhexyl, 2-chlorohexyl, cyanoethyl, 2-acetoxyethyl, dimethylaminoethyl, benzyl, cyclohexyl, furfuryl, phenyl, 2-hydroxyethyl, 2-ethxyethyl, glycidyl and ω-methoxypolyethyleneglycol (addition mol number 9).

Examples of vinyl esters include vinyl acetate, vinyl propionate, vinyl butylate, vinyl isobutylate, vinyl caproate, vinyl chloroacetate, vinyl methoxyacetate, vinyl phenylacetate, vinyl benzoate and vinyl salicylate. Further, examples of olefins include dicyclopentadiene, ethylene, propylene, 1-butene, 1-pentene, vinyl chloride, vinylidene chloride, isoprene, chloroprene, butadiene and 2,3-dimethyl butadiene. Examples of styrenes include styrene, methylstyrene, dimethylstyrene, trimethylstyrene, ethylstyrene, isopropylstyrene, chloromethylstyrene, methoxystyrene, acetoxy styrene, chlorostyrene, dichlorostyrene, bromostyrene, trifluoromethylstyrene and vinylbenzoate methyl ester. Examples of acrylamides include acrylamide, methyl acrylamide, ethyl acrylamide, propyl acrylamide, butyl acrylamide, tert-butyl acrylamide, phenyl acrylamide and dimethyl acrylamide; methacrylamides may, for example, be methacrylamide, methyl methacrylamide, ethyl methacrylamide, propyl methacrylamide and tert-butyl methacrylamide; allyl compounds may, for example, be ally acetate, allyl caproate, allyl laurate and allyl benzoate; vinyl ethers may, for example, be methyl vinyl ether, butyl vinyl ether, hexyl vinyl ether, methoxyethyl vinyl ether and dimethylaminoethyl vinyl ether; vinyl ketones may, for example, be methyl vinyl ketone, phenyl vinyl ketone and methoxyethyl vinyl ketone; vinylheterocyclic compounds may, for example, be vinylpyridine, N-vinylimidazole, N-vinyloxazoline, N-vinyltriazole and N-vinylpyrrolidone; unsaturated nitriles may, for example, be acrylonitrile and methacrylonitrile; and polyfunctional monomers may, for example, be divinylbenzene, methylenebisacrylamide and ethylene glycol dimethacrylate.

Furthermore, there can be mentioned acrylic acid, methacrylic acid, itaconic acid, maleic acid and monoalkyl itaconates (for example, monoethyl itaconate); monoalkyl maleates (for example, monomethyl maleate); styrene sulfonic acid, vinylbenzyl sulfonic acid, vinyl sulfonic acid and acryloyloxyalkyl sulfonic acid (for example, aryloyloxymethyl sulfonic acid); methacryloyloxyalkyl sulfonic acid (for example, methacryloyloxyethyl sulfonic acid); acrylamide alkyl sulfonic acid (for example, 2-acrylamide-2-methylethane sulfonic acid); methacrylamide alkyl sulfonic acid (for example, 2-methacrylamide-2-methyl ethanesulfonic acid etc.); and acryloyloxyalkyl phosphates (for example, acryloyloxyethyl phosphate). These acids may be salts of alkali metals (for example, Na and K) or salts of ammonium ions. Further, as other monomer compounds, crosslinkable monomers disclosed in published specifications of U.S. Pat. Nos. 3,459,790, 3,438,708, 3,554,987, 4,215,195 and 4,247,673 and JP-A-57-205735 can preferably be employed. Specific examples of such crosslinkable monomers include N-(2-acetoacetoxyethyl)acrylamide and N-(2-(2-acetoacetoxyethoxy)ethyl)acrylamide.

These monomer compounds may be used as grains of a polymer obtained by polymerizing the monomer compounds individually or may be used as grains of a copolymer obtained by polymerizing a plurality of monomers in combination. Of these monomer compounds, acrylic esters, methacrylic esters, vinyl esters, styrenes and olefins are preferably used. Further, in the present invention, grains having a fluorine atom or a silicon atom disclosed in JP-A's 62-14647, 62-17744 and 62-17743 may be employed. Among these, the grain compositions preferably used can be exemplified by polystyrene, polymethyl (meth)acrylate, polyethyl acrylate, poly(methyl methacrylate/methacrylic acid=95/5 (molar ratio), poly(styrene/styrenesulfonic acid=95/5 (molar ratio), polyacrylonitrile, poly(methyl methacrylate/ethyl acrylate/methacrylic acid=50/40/10), and silica. Moreover, grains of the present invention can use those having a reactive group (especially, gelatin) disclosed in JP-A-64-77052 and EP No. 307855. Furthermore, a great numbers of groups soluble in alkaline or acidic condition may be incorporated.

A binder of the layer containing a matting agent is not particularly limited and may be a lipophilic binder or a hydrophilic binder. As the lipophilic binder, known thermoplastic resin, thermosetting resin, radiation-curable resin, reaction-type resin and mixtures thereof can be used. The above-mentioned resins have Tg of −40° C. to 200° C., a weight average molecular weight of 10,000 to 300,000, and preferably 10,000 to 100,000. Examples of the above-mentioned thermoplastic resin include vinyl copolymers such as vinyl chloride-vinyl acetate copolymers, copolymers of vinyl chloride, vinyl acetate and vinyl alcohol, maleic acid and/or acrylic acid, vinyl chloride-vinylidene chloride copolymers, vinyl chloride-acrylonitrile copolymers, and ethylene-vinyl acetate copolymers; cellulose derivatives such as nitrocellulose, cellulose acetate propionate and cellulose acetate butyrate, acrylic resins, polyvinylacetal resin, polyvinyl butyral resin, a polyester polyurethane resin, polyether polyurethane resin, polycarbonate polyurethane resin, polyester resins, polyether resin, polyamide resins, amino resins; rubber based resin such as styrene butadiene resins and butadiene acrylonitirile resins; silicon resins and fluorine based resins.

The surface roughness Rq of the surface of a lightsensitive material defined in the present invention is a standard deviation of a roughness Z of the surface of the lightsensitive material, and is a value calculated from the following formula:

$$Rq=\sqrt{(\Sigma(Zi-Zave)^2/N)}$$

wherein Zave is an average of Z values in a given area and N is the number of points in the given area.

Specifically, it is measured with a scanning probe microscope, NanoScope III Contact AFM, manufactured by Digital Instruments Co., Ltd., and is defined by a value of Rms[Rq] calculated according to the method disclosed in NanoScope Command Reference Manual, p. 12 to 67.

The measurement is conducted by taking up data at 512×512 points per an area of 100 μm×100 μm. The Rq value is obtained through the above-described operation. The measurement is conducted by varying measuring points to arbitral 10 points and the obtained Rq values are averaged.

In the photographic material of the present invention, the roughness (Rq1) of the surface with which a heat source that heat develops the light sensitive material is to be brought into contact and the roughness (Rq2) of the surface reverse to that surface with respect to a support satisfy a relationship $Rq1/Rq2 \leqq 0.5$. The heat development temperature is 60° C. or more and 180° C. or less. The value of Rq1/Rq2 is preferably 0 or more and 0.5 or less, more preferably 0.1 or more and 0.4 or less, and still more preferably 0.2 or more and 0.3 or less. If the value of Rq1/Rq2 exceed 0.5, development-induced unevenness will be generated and the finishing will become poor. Each of Rq1and Rq2 has no particular limitation, but Rq1 is preferably 20 or more and 80 or less, and more preferably 25 or more and 40 or less. Rq2 is preferably 60 or more and 2000 or less, and more preferably 100 or more and 150 or less. The relationship between the Rq1 value and the Rq2 value defined in the present invention can be adjusted by selecting the kind of the compound, the grain size and the like of the matting.

A plate-like grain (hereinafter referred to as "tabular grain") used in the present invention is a silver halide grain having two opposing, parallel main planes. The tabular grain will be described in detail below.

The aspect ratio of the tabular grain of the present invention is defined as a value obtained by dividing the equivalent-circle diameter of two opposing parallel main planes (a diameter of a circle having the same projected area as the main planes) by the distance between the main planes (namely, the thickness of the grain). The number-average values calculated from the aspect ratios of grains is used.

The aspect ratio of the tabular grains of the present invention is preferably 5 or more and 100 or less. In order to exhibit the effect of the present invention, the aspect ratio is more preferably 8 or more and 60 or less, and particularly preferably 10 or more and 30 or less. Average aspect ratios less than 5 or those greater than 100 are undesirable because if the average aspect ratio is less than 5, the merit of the tabular grains (improvement in sensitivity and in image quality) cannot be fully used and because if the average aspect ratio exceeds 100, the pressure resistance becomes poor. Further, as for the tabular grains of the present invention, the ratio occupied by the tabular grains is preferably 60% or more, more preferably 80% or more, and particularly preferably 90% or more of the total projected area. A ratio of 50% or less is undesirable since the merit of tabular grains cannot be fully used.

The average grain thickness in the present invention is an arithmetical average of the thicknesses of all of the tabular grains. The average grain thickness of the tabular grains of the present invention is preferably 0.01 to 0.3 μm, more preferably 0.01 to 0.12 μm and particularly preferably 0.01 to 0.07 μm. An average grain thickness less than 0.01 μm and that greater than 0.3 μm are undesirable because if the average grain thickness is less than 0.01 μm, the pressure resistance becomes poor and because an average grain thickness exceeding 0.3 μm makes it difficult to attain the effect of the present invention.

In the present invention, the grain thickness and the aspect ratio within the above-described ranges may be selected depending upon the purpose. However, it is preferable to use tabular grains having a thin grain thickness and a high aspect ratio.

In the present invention, the diameter (equivalent-circle diameter) of the tabular grains may be selected arbitrary, but is preferably 0.3 to 20 μm, and more preferably 0.5 to 10 μm. The average equivalent-circle diameter, which is an arithmetical average of the total tabular grains, less than 0.3 μm and that greater than 20 μm are undesirable because if the average equivalent-circle diameter is less than 0.3 μm, it is difficult to attain the effect of the present invention and because if it exceeds 20 μm, the pressure resistance becomes poor.

The grain diameter and the grain thickness can be obtained from an electron micrograph according to the method disclosed in U.S. Pat. No. 4,434,226. One example of an aspect ratio measurement method comprises taking a transmission electron micrograph by a replica method and obtaining the diameter of a circle whose area is the same as the projected area of each grain (the equivalent-circle diameter) and the thickness of each grain. In this method, the thickness can be calculated from the length of a shadow of replica.

It is preferable that the tabular grains of the present invention be monodisperse. The variation coefficient of the grain diameter distribution of the total silver halide gains is preferably 35% or less, more preferably 25% or less, and particularly preferably 20% or less. When exceeding 35%, it is not undesirable from the viewpoint of uniformity among grains. The variation coefficient of grain diameter distribution is a value obtained in such a manner that a dispersion (standard deviation) of the equivalent-sphere diameters of the silver halide grains is divided by the average equivalent-sphere diameter and the resulting value is multiplied by 100. A silver halide emulsion comprising silver halide grains uniform in grain shape, with a low dispersion in grain size exhibits approximately a normal distribution in distribution of grain size. Therefore, the standard deviation can easily be calculated.

The preparation of monodisperse tabular grains is described in JP-A-63-11928. The description of monodisperse tabular hexagonal grains is found in JP-A-63-151618. The monodisperse tabular circular grain emulsion is described in JP-A-1-131541. Further, JP-A-2-838 discloses an emulsion wherein at least 95% of the total projected area is occupied by tabular grains having two twin planes parallel to the main plane and the size distribution of these tabular grains is monodisperse. EP 514742 A1 discloses a tabular grain emulsion having a variation coefficient of grain size of 10% or less, the emulsion being prepared using a polyalkylene oxide block co-polymer.

There are known the tabular grains whose main planes are (100) planes and the tabular grains whose main planes are (111) planes, both of which the technique of the present invention can be applied to. The silver bromide of the former type are disclosed in U.S. Pat. No. 4,063,951 and JP-A-5-281640, while the silver chloride of the former type are disclosed in EP 534395 A1 and U.S. Pat. No. 5,264,337. The tabular grains of the latter type can have various shapes wherein at least one twin plane is present, and those of silver chloride are described in U.S. Pat. Nos. 4,399,215, 4,983,508 and 5,183,732, and JP-A's-3-137632 and 3-116113.

As a method for forming the tabular grains, various methods can be used and, for example, the grain forming method disclosed in U.S. Pat. No. 5,494,789 can be used.

In order to form tabular grains having a high aspect ratio, it is important to grow small, twin nuclei. For this purpose, it is preferable to grow the nuclei at low temperature, high pBr and low pH, using a small amount of gelatin in a short time. As the kind of gelatin, gelatin with a low molecular weight, gelatin with a low methionine content, gelatin that has been phthalated, and the like are preferred.

After the formation of the nuclei, physical ripening is carried out to grow only tabular grain nuclei (parallel, multiple-layered twin nuclei) by eliminating other nuclei, i.e., nuclei of normal habit crystals, single-layered twin nuclei and non-parallel, multiple-layered twin nuclei, thereby causing the parallel, multiple-layered twin nuclei to remain selectively. Then, a soluble silver salt and a soluble halogen salt are added to the obtained nuclei to promote grain growth, and an emulsion comprising tabular grains is prepared.

It is also preferable to grow grains by supplying silver and halide through the addition of silver halide fine grains that have been prepared in advance or that are simultaneously prepared in another reaction vessel.

It is preferable that the tabular grains in the present invention have dislocation lines. The dislocation lines means linear lattice defects present in the boundary, on the slip planes of crystals, between a region that has already slipped and a region that has not yet slipped.

When tabular grains in the present invention have dislocation lines, the dislocation lines may be formed, for example, on the apex or fringe portions of grains or over the main plane of gains. As used herein, the fringe portion is the peripheral region of a tabular grain. More specifically, in the distribution of silver iodide from the edge to the center of a tabular grain, the fringe portion is a region outside a certain point at which the silver iodide content exceeds or becomes lower than the average silver iodide content of the whole grain for the first time when viewed from the edge.

When tabular grains have dislocation lines, the density of the dislocation lines is optional and any density may be selected, for example, 10 lines or more, 30 lines or more, 50 lines or more, per grain. The tabular grains used in the present invention may have dislocation lines inside the grains.

The technique of introducing dislocations into silver halide grains under control is disclosed in JP-A-63-220238. In this reference, the tabular grains into which dislocation lines have been introduced show much effect, compared to those free from dislocation lines, including improvement in photographic characteristics such as sensitivity and reciprocity law, improvement in keeping quality, a rise in latent image stability and reduction in pressure mark. According to the invention of the publication, the dislocation lines are introduced mainly in the edge part of tabular grains. On the other hand, the tabular grains having dislocation lines introduced in the core part are disclosed in U.S. Pat. No. 5,238,796.

The dislocation lines in silver halide grains can be observed by the direct method using a transmission electron microscope at a low temperature as described in, e.g., J. F. Hamilton, Photo, Sci. Eng., vol. 11, p. 57 (1967) and T. Shiozawa, J. Soc. Photo Sci. Japan, vol. 35, p. 213 (1972). More specifically, the silver halide grains separated from an emulsion, taking care so as not supply such pressure as to cause dislocation therein, are put on a mesh for observation with an electron microscope, and observed using a transmission method as they are cooled for protection against damage (printout) caused by electron beams. Therein, the greater the grain thickness, the harder to pass the transmission of electron beams, so that clear observation can be made by the use of high-voltage electron microscope (at least 200 kV with respect to a grain thickness of 0.25 $\mu$m). By use of the electron microscopic photographs of the grain taken in the above-described way, the location and number of dislocation lines found in each grain viewed from the position perpendicular to the main plane of the grain can be obtained.

As the tabular grains in the present invention, silver bromide, silver chlorobromide, silver iodobromide, silver iodochloride, silver chloride, silver chloroiodobromide and the like can be used. It is preferable to use silver bromide, silver iodobromide, and silver chloroiodobromide.

When the silver halide grains have a phase containing iodides or chlorides, the phase may be uniformly distributed within the grain or they may be localized. Other silver salts, such as silver rhodanide, silver sulfide, silver selenide, silver carbonate, silver phosphate and silver salts of organic acids, may be contained as separate grains or as part of the silver halide grains.

The preferable range of silver iodide content in the tabular grains of the present invention is preferably 0.1 to 20 mol %, more preferably 0.1 to 15 mol %, and particularly preferably 0.2 to 10 mol %. A silver iodide content of less than 0.1 mol % is undesirable because it is difficult to obtain the effects of enhancing dye adsorption and increasing the intrinsic sensitivity. A silver iodide content exceeding 20 mol % is also undesirable because the developing speed generally lowers.

The coefficient of variation of distribution of silver iodide content between grains of the tabular grains of the present invention is preferably 30% or less, more preferably 25% or less, and particularly preferably 20% or less. If it exceeds 30%, it is not preferable from the viewpoint of uniformity between grains. The silver iodide content of individual tabular grain can be measured by analyzing the composition of the grain one by one with an X-ray microanalyzer. The coefficient of variation of distribution of silver iodide content used herein is a value obtained by dividing the standard deviation of the silver iodide content distribution of individual grain by the average silver iodide content.

The tabular grains in the present invention may be epitaxial silver halide grains comprising host tabular grains having, on surfaces thereof, at least one kind of silver salt epitaxy.

In the present invention, a silver salt epitaxy may be formed in selected portions in the surface of a host tabular grain, and alternatively, may be formed restrictedly in corners or edges (that is, sites present on side faces and sides of a grain when viewing the tabular grain from a position perpendicular to the main plane) of the host tabular grain.

In the case of forming a silver salt epitaxy, it is preferable to form the silver salt epitaxy in selected sites in the surfaces of host tabular grains uniformly in individual grain and between the grains. As a concrete site-direct method of a silver salt epitaxy, there are known a method, which is disclosed in U.S. Pat. No. 4,435,501, of causing host grains to adsorb a spectral sensitizing dye (for example, a cyanine dye) or an aminoazaindene (for example, adenine) before the formation of the silver salt epitaxy, a method of causing host grains to contain silver iodide, and the like. These methods may be employed. Further, it is also possible to add iodide ions before the formation of the silver salt epitaxy, thereby precipitating them on host grains. These site-directing methods may be chosen case by case and may be employed in combination of them.

In the case of forming a silver salt epitaxy, the ratio of the area occupied by the silver salt epitaxy with respect to the surface are of the host tabular grain on which the silver salt epitaxy is formed is preferably 1 to 50%, more preferably 2 to 40%, and particularly preferably 3 to 30%.

In the case of forming a silver salt epitaxy, the amount of silver in the silver salt epitaxy relative to the total amount of silver in the silver halide tabular grains is preferably 0.3 to 50 mol %, more preferably 0.3 to 25 mol %, and particularly preferably 0.5 to 15 mol %.

The composition of the silver salt epitaxy can be selected depending on a situation, and it may be silver halide containing any of a chloride ion, a bromide ion and an iodide ion. However, it is preferably a silver halide containing at least a chloride ion. Silver chloride easily forms an epitaxy because it forms a face-centered cubic lattice structure that is the same as silver bromide and silver iodobromide, which form host tabular grains. However, there is a difference between the lattice spaces formed of two kinds of silver halides, and therefore, this will cause the formation of an epitaxy junction which contributes the increase in photographic sensitivity.

The content of the silver chloride contained in a silver halide epitaxy is preferably greater than the content of the silver chloride contained in host tabular grains by at least 10 mol %, more preferably by at least 15 mol %, and particularly preferably by at least 20 mol %. A difference between the silver chloride contents of the epitaxy and the host of less than 10 mol % is undesirable because it makes the effect difficult to be obtained.

In the introduction of a halide ion to a silver halide epitaxy, it is preferable, for the purpose of increasing its introduction amount, to introduce a halide ion in the order depending on the composition of the epitaxy. For example, when forming an epitaxy in which a greater amount of silver chloride is contained in the inside portion, a greater amount of silver bromide is contained in the intermediate portion and a greater amount of silver iodide is contained in the outside portion, the addition of these halide ions is conducted in the order, a chloride ion, a bromide ion and then an iodide ion, thereby making the solubility of a silver halide containing the halide ion added smaller than the solubilities of the other silver halides to precipitate the silver halide, thereby forming a layer rich in the silver halide. Silver salts other than silver halides, such as silver rhodanide, silver sulfide, silver selenide, silver carbonate, silver phosphate and silver salts of organic acids, may be contained in a silver salt epitaxy.

Examples of a method for forming a silver salt epitaxy include a method of adding a halide ion, a method of adding an aqueous silver nitride solution and an aqueous halide solution by the double jet method, and a method of adding silver halide fine grains. These methods may be selected case by case and also may be used in combination. In the formation of a silver salt epitaxy, the temperature, pH and pAg of the system, the kind and concentration of a protective colloid such as gelatin, the presence, kind and concentration of a silver halide solvent, and the like may be selected widely.

In the case of an epitaxial silver halide grain, for maintaining the form of a host tabular grain or site-directing of a silver salt epitaxy to the edge/corner sites of the grain, it is preferable that the silver iodide content in the outside region, this being the portion that precipitates lastly and forming the edge/corner sites of the grain, of the host tabular grain is at least 1 mol % higher than the silver iodide content in the center region. At this time, the silver iodide content in the outside region is preferably 1 to 20 mol %, and more preferably 5 to 15 mol %. A content of less than 1 mol % is undesirable because the above-described effect cannot be obtained. A content exceeding 20 mol % is also undesirable because the development speed lowers. In this case, the ratio of the total silver amount in the outside region containing silver iodide relative to the total silver amount of the host tabular grains is preferably 10 to 30% and more preferably 10 to 25%. An mount less than 10% and an amount exceeding 30% are undesirable because the above-described effect cannot be obtained. At this time, the silver iodide content in the center region is preferably 0 to 10 mol %, more preferably 1 to 8 mol %, and particularly preferably 1 to 6 mol %. A content exceeding 10 mol % is undesirable because the development speed lowers.

In the tabular grains to be used in the present invention, it is possible to use any conventional dopant that is known to be useful for silver halide face-centered cubic crystal lattice structure. Examples of the conventional dopant include Fe, Co, Ni, Ru, Rh, Pd, Re, Os, Ir, Pt, Au, Hg, Pb and Tl. These dopants may be present in a host emulsion and/or in a silver salt epitaxially arranged on a grain surface.

A description will be made below to the above-mentioned emulsion used in the present invention and the other emulsions used together with that emulsion.

The silver halide grain in the other emulsions to be used in the present invention may be a grain having a regular crystal form such as cubic, octahedral and tetradecahedral, a grain having an irregular crystal form such as spherical and plate-like, a grain having a crystal defect such as a twin face, or a composite form of these grains. With respect to the grain diameter of the silver halide grain, the emulsion used in the invention may comprise fine grains having a grain size of about 0.2 $\mu$m or less or large grains having a projected area diameter of up to about 3 $\mu$m, and the emulsion may be either a polydisperse or monodisperse emulsion.

More concretely, the photographic emulsions to be used in the present invention(s) can be selected from the silver halide emulsions prepared by methods described in, e.g., U.S. Pat. No. 4,500,626, column 50, U.S. Pat. No. 4,628, 021, Research Disclosure (hereinafter abbreviated as RD) No. 17029 (1978), RD No. 17643 (1978), pp. 22 to 23, RD No. 18716 (1979), p. 648, RD No. 307105 (1989), pp. 863 to 865, JP-A's-62-253159, 64-13546, 2-236546 and 3-110555; P. Glafkides, Chemie et Phisque Photographique, Paul Montel, 1967; G. F. Duffin, Photographic Emulsion Chemistry, Focal Press, 1966; and V. L. Zelikman et al., Making, Coating Photographic Emulsion, Focal Press, 1964, and the like.

In a lightsensitive material of the present invention, it is possible to mix, in a single layer, two or more types of emulsions different in at least one of characteristics of a lightsensitive silver halide emulsion, i.e., a grain size, grain size distribution, halogen composition, grain shape, and sensitivity. Further, it is also possible to mix, in a single layer, an emulsion comprising the tabular grains of the present invention and an emulsion outside the scope of the present invention.

In the process for preparing the lightsensitive silver halide emulsion of the present invention, it is preferable that a treatment to remove excessive salt, i.e., desalting, be conducted. As means for the desalting, employable methods include a Noodle water-washing method in which salt is removed by gelation of gelatin and a flocculation method which utilizes such materials as an inorganic salt comprising a polyvalent anion (e.g., sodium sulfate), an anionic surfactant, an anionic polymer (e.g., sodium polystyrenesulfonate) or a gelatin derivative (e.g., aliphatic-acylated gelatin, aromatic-acylated gelatin and aromatic-carbamoylated gelatin). A flocculation method is most preferably used.

The lightsensitive silver halide emulsion for use in the present invention may contain, for various purposes, a heavy metal such as iridium, rhodium, platinum, cadmium, zinc, thallium, lead, iron and osmium. These compounds may be used individually or in combination of two or more thereof. The addition amount varies depending on the use purpose, however, it is generally on the order of from $10^{-9}$ to $10^{-3}$ mol per mol of silver halide. The heavy metal may be incorporated uniformly into the grain or may be localized in the inside or on the surface of the grain. Specifically, emulsions described in JP-A's-2-236542, 1-116637 and the like are preferably used.

At the stage of forming grains of the lightsensitive silver halide emulsion of the present invention, a rhodanate, an ammonia, a tetra-substituted thiourea compound, an organic thioether derivative described in Jpn. Pat Appln. KOKOKU Publication No. (hereinafter referred to as JP-B-) 47-11386, a sulfur-containing compound described in JP-A-53-144319 and the like may be used as a silver halide solvent.

With respect to other conditions, description in P. Glafkides, Chimie et Phisigue Photographique, Paul Montel (1967), G. F. Duffin, Photographic Emulsion Chemistry, The Focal Press (1966) and V. L. Zelikman et al, Making and Coating Photographic Emulsion, The Focal Press (1964) may be referred to. More specifically, any of an acid process, a neutral process and an ammonia process may be used, and as a method of reacting a soluble silver salt with a soluble halogen salt, any of a single jet method, a double jet method and a combination thereof may be used. In order to obtain a monodisperse emulsion, a double jet method is preferably used.

A reverse mixing method of forming grains in excessive silver ions may also be used. A so-called controlled double jet method, which is one form of the double jet method, of keeping a constant pAg in the liquid phase where the silver halide is formed may also be used.

Further, in order to accelerate growth of grains, the addition concentration, the addition amount or the addition rate of silver salt and halogen salt to be added may be increased (see, JP-A's-55-142329 and 55-158124, U.S. Pat. No. 3,650,757, and the like). The reaction solution may be stirred by any known stirring method.

Further, the temperature and pH of the reaction solution during the formation of silver halide grains may be selected depending on the purpose. The pH is preferably in the range of 2.2 to 7.0, and more preferably 2.5 to 6.0.

The lightsensitive silver halide emulsion is usually a silver halide emulsion subjected to chemical sensitization. In the chemical sensitization of the lightsensitive silver halide emulsion for use in the present invention, chalcogen sensitization such as sulfur sensitization, selenium sensitization and tellurium sensitization, noble metal sensitization using gold, platinum, palladium or the like, and reduction sensitization, which are all known to the emulsion for normal type lightsensitive materials, may be used individually or in combination (see, JP-A-3-110555). The chemical sensitization may also be performed in the presence of a nitrogen-containing heterocyclic compound (see, JP-A-62-253159). Further, an antifoggant that will be described later, may be added after completion of the chemical sensitization. Specifically, the methods described in JP-A's-5-45833 and 62-40446 may be used.

At the time of chemical sensitization, the pH is preferably from 5.3 to 10.5, more preferably from 5.5 to 8.5, and the pAg is preferably from 6.0 to 10.5, more preferably from 6.8 to 9.0.

The lightsensitive silver halide for use in the present invention is coated in an amount of, in terms of silver, from 0.01 to 10 $g/m^2$, and particularly preferably 6 $g/m^2$ or less.

The lightsensitive silver halide emulsion for use in the present invention may be spectrally sensitized with a methine dye or the like so that the lightsensitive silver halide emulsion can have spectral sensitivity such as green sensitivity and red sensitivity. Further, spectral sensitization in the blue region may be applied to the blue-sensitive emulsion, if desired.

Examples of the dye used include a cyanine dye, a merocyanine dye, a complex cyanine dye, a complex merocyanine dye, a holopolar cyanine dye, a hemicyanine dye, a styryl dye and a hemioxonol dye. Specific examples thereof include the sensitizing dyes described in U.S. Pat. No. 4,617,257, and JP-A's-59-180550, 64-13546, 5-45828, 5-45834 and the like.

These sensitizing dyes may be used individually or in combination and the combination of sensitizing dyes is often used for the purpose of supersensitization or for controlling the wavelength of spectral sensitization.

In combination with a sensitizing dye, a dye which itself has no spectral sensitization effect or a compound which absorbs substantially no visible light, but which exhibits supersensitization, may be contained in the emulsion (those described, for example, in U.S. Pat. No. 3,615,641 and JP-A-63-23145).

With respect to the timing when the spectral sensitizing dye is added to the emulsion, it may be added before, during or after chemical sensitization or may be added before or after nucleation of silver halide grains according to U.S. Pat. Nos. 4,183,756 and 4,225,666. The sensitizing dye or the supersensitizing dye may be added as a solution in an organic solvent such as methanol, a dispersion, for example, in gelatin, or a solution in a surface active agent. The addition amount is generally in the order of from $10^{-8}$ to $10^{-2}$ mol per mol of silver halide.

The photographic additives useful in the invention are described in the Research Disclosures, the disclosures of which are incorporated herewith by reference, and associating descriptions are set forth below.

| | Types of Additives | RD17643 (December, 1978) | RD18716 (November, 1979) | RD307105 (November, 1989) |
|---|---|---|---|---|
| 1. | Chemical sensitizers | page 23 | page 648 right column | page 866 |
| 2. | Sensitivity increasing agents | | page 648 right column | |
| 3. | Spectral sensitizers, super-sensitizers | pages 23–24 | page 648, right column to page 649, right column | pages 866–868 |
| 4. | Brighteners | page 24 | page 647, right column | page 868 |
| 5. | Light absorbents, filter dyes, ultraviolet absorbents | pages 25–26 | page 649, right column to page 650, left column | page 873 |
| 6. | Binders | page 26 | page 651, left column | pages 873–874 |
| 7. | Plasticizers, lubricants | page 27 | page 650, right column | page 876 |
| 8. | Coating aids, surfactants | pages 26–27 | page 650, right column | pages 875–876 |
| 9. | Antistatic agents | page 27 | page 650, right column | pages 876–877 |
| 10. | Matting agents | | | pages 878–879 |

Next, lightsensitive silver halide emulsion containing tabular silver halide grains having adsorbed a sensitizing dye so that the grains have a maximum spectral absorption wavelength of less than 500 nm and a light absorption intensity of 60 or more or have a maximum spectral absorption wavelength of 500 nm or more and a light absorption intensity of 100 or more, will be explained.

In the present invention, the light absorption intensity refers to a light absorption area intensity per grain surface area realized by a sensitizing dye. It is defined as an integral value, over wave number ($cm^{-1}$), of optical density Log (Io/(Io−I)), wherein Io represents the quantity of incident light on each unit surface area of grains and I represents the quantity of light absorbed by the sensitizing dye on the surface. The range of integration is from 5000 $cm^{-1}$ to 35,000 $cm^{-1}$.

With respect to the silver halide photographic emulsion of the present invention, it is preferred that the tabular silver halide grains meeting the following requirements occupy 50% or more of the total projected area of silver halide grains contained in the emulsion to be used. That is, when the tabular silver halide grains have maximum spectral absorption wavelength of less than 500 nm, the tabular grains have 60 or more light absorption intensity, or when the tabular silver halide grains have maximum spectral absorption wavelength of 500 nm or more, the tabular grains have 100 or more light absorption intensity. With respect to the grains having 500 nm or more maximum spectral absorption wavelength, the light absorption intensity is preferably 150 or more, more preferably 170 or more, and most preferably 200 or more. With respect to the grains having less than 500 nm maximum spectral absorption wavelength, the light absorption intensity is preferably 90 or more, more preferably 100 or more, and most preferably 120 or more. In both instances, although there is no particular upper limit, the light absorption intensity is preferably up to 2000, more preferably up to 1000, and most preferably up to 500. With respect to the grains having less than 500 nm maximum spectral absorption wavelength, the maximum spectral absorption wavelength is preferably 350 nm or more and more preferably 700 nm or less.

As one method of measuring the light absorption intensity, there can be mentioned the method of using a microscopic spectrophotometer. The microscopic spectrophotometer is a device capable of measuring an absorption spectrum of minute area, whereby a transmission spectrum of each grain can be measured. With respect to the measurement of an absorption spectrum of each grain by the microscopic spectrophotometry, reference can be made to the report of Yamashita et al. (page 15 of Abstracts of Papers presented before the 1996 Annual Meeting of the Society of Photographic Science and Technology of Japan). The absorption intensity per grain can be determined from the absorption spectrum. Because the light transmitted through grains is absorbed by two surfaces, i.e., upper surface and lower surface, however, the absorption intensity per grain surface area can be determined as ½ of the absorption intensity per grain obtained in the above manner. At that time, although the interval for absorption spectrum integration is from 5000 $cm^{-1}$ to 35,000 $cm^{-1}$ in view of the definition of light absorption intensity, experimentally, it is satisfactory to integrate over an interval where absorption by the sensitizing dye exists from which about 500 $cm^{-1}$ is taken and to which about 500 $cm^{-1}$ is added, i.e., the absorption interval of the sensitizing dye±about 500 $cm^{-1}$.

Apart from the microscopic spectrophotometry, the method of arranging grains in such a manner that the grains are not piled one upon another and measuring a transmission spectrum is also practical.

The light absorption intensity is a value unequivocally determined from the oscillator strength and number of adsorbed molecules per area with respect to the sensitizing dye. If, with respect to the sensitizing dye, the oscillator strength, dye adsorption amount and grain surface area are measured, these can be converted into the light absorption intensity.

The oscillator strength of a sensitizing dye can be experimentally determined as a value proportional to the absorption area intensity (optical density×$cm^{-1}$) of sensitizing dye solution, so that the light absorption intensity can be calculated within an error of about 10% by the formula:

$$\text{light absorption intensity}=0.156\times A\times B/C$$

wherein A represents the absorption area intensity per M of the dye (optical density×$cm^{-1}$), B represents the adsorption amount of the sensitizing dye (mol/molAg) and C represents the grain surface area ($m^2$/molAg).

Calculation of the light absorption intensity through this formula gives substantially the same value as the integral value, over wave number ($cm^{-1}$), of light absorption intensity (Log (Io/(Io−I))) measured in accordance with the aforementioned definition.

For increasing the light absorption intensity, there can be employed any of the method of adsorbing more than one layer of dye chromophore on grain surfaces, the method of increasing the molecular absorption coefficient of dye and the method of decreasing a dye-occupied area. Of these, the method of adsorbing more than one layer of dye chromophore on grain surfaces (multi-layer adsorption of sensitizing dye) is preferred.

The expression "adsorption of more than one layer of dye chromophore on grain surfaces" used herein means the presence of more than one layer of dye bound in the vicinity of silver halide grains. Thus, it is meant that dye present in a dispersion medium is not contained. Even if a dye chromophore is connected with a substance adsorbed on grain surfaces through a covalent bond, when the connecting group is so long that the dye chromophore is present in the dispersion medium, the effect of increasing the light absorption intensity is slight and hence it is not regarded as the more than one layer adsorption. Further, in the so-called multi-layer adsorption wherein more than one layer of dye chromophore is adsorbed on grain surfaces, it is required that a spectral sensitization be brought about by a dye not directly adsorbed on grain surfaces. For meeting this requirement, the transfer of excitation energy from the dye not directly adsorbed on silver halide to the dye directly adsorbed on grains is inevitable. Therefore, when the transfer of excitation energy must occur in more than 10 stages, the final transfer efficiency of excitation energy will unfavorably be low. As an example thereof, there can be mentioned such a case that, as experienced in the use of polymer dyes of, for example, JP-A-2-113239, most of dye chromophore is present in a dispersion medium, so that more than 10 stages are needed for the transfer of excitation energy. In the present invention, it is preferred that the number of excitation energy transfer stages per molecule range from 1 to 3.

The terminology "chromophore" used herein means an atomic group which is the main cause of molecular absorption bands as described on pages 985 and 986 of Physicochemical Dictionary (4th edition, published by Iwanami Shoten, Publishers in 1987), for example, any atomic group selected from among C=C, N=N and other atomic groups having unsaturated bonds.

Examples thereof include a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarium dye, a croconium dye, an azamethine dye, a coumarin dye, an allylidene dye, an anthraquinone dye, a triphenylmethane dye, an azo dye, an azomethine dye, a spiro compound, a metallocene dye, a fluorenone dye, a fulgide dye, a perillene dye, a phenazine dye, a phenothiazine dye, a quinone dye, an indigo dye, a diphenylmethane dye, a polyene dye, an acridine dye, an acridinone dye, a diphenylamine dye, a quinacridone dye, a quinophthalone dye, a phenoxazine dye, a phthaloperillene dye, a porphyrin dye, a chlorophyll dye, a phthalocyanine dye and a metal complex dye. Of these, there can preferably be employed polymethine chromophores such as a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarium dye, a croconium dye and an azamethine dye. More preferred are a cyanine dye, a merocyanine dye, a trinuclear merocyanine dye, a tetranuclear merocyanine dye and a rhodacyanine dye. Especially preferred are a cyanine dye, a merocyanine dye and a rhodacyanine dye, and most preferably is a cyanine dye.

Details of these dyes are described in, for example, F. M. Harmer, "Heterocyclic Compounds-Cyanine Dyes and Related Compounds", John Wiley & Sons, New York, London, 1964 and D. M. Sturmer, "Heterocyclic Compounds-Special topics in heterocyclic chemistry", chapter 18, section 14, pages 482 to 515, John Wiley & Sons, New York, London, 1977. With respect to the general formulae for the cyanine dye, merocyanine dye and rhodacyanine dye, those shown in U.S. Pat. No. No. 5,340,694, columns 21 to 22, (XI), (XII) and (XIII), are preferred. In the formulae, the numbers n12, n15, n17 and n18 are not limited as long as each of these is an integer of 0 or greater (preferably, 4 or less).

The adsorption of a dye chromophore on silver halide grains is preferably carried out in at least 1.5 layers, more preferably at least 1.7 layers, and most preferably at least 2 layers. Although there is no particular upper limit, the number of layers is preferably 10 or less, more preferably 5 or less.

The expression "adsorption of more than one layer of chromophore on silver halide grain surfaces" used herein means that the adsorption amount of dye chromophore per area is greater than a one-layer saturated coating amount, this one-layer saturated coating amount defined as the saturated adsorption amount per area attained by a dye which exhibits the smallest dye-occupied area on silver halide grain surfaces among the sensitizing dyes added to the emulsion. The number of adsorption layers means the adsorption amount evaluated on the basis of one-layer saturated coating amount. With respect to dyes having dye chromophores connected to each other by covalent bonds, the dye-occupied area of unconnected individual dyes can be employed as the basis.

The dye-occupied area can be determined from an adsorption isothermal line showing the relationship between free dye concentration and adsorbed dye amount, and a grain surface area. The adsorption isothermal line can be determined with reference to, for example, A. Herz et al. "Adsorption from Aqueous Solution", Advances in Chemistry Series, No. 17, page 173 (1968).

The adsorption amount of a sensitizing dye onto emulsion grains can be determined by two methods. The one method comprises centrifuging an emulsion having undergone a dye adsorption to thereby separate the emulsion into emulsion grains and a supernatant aqueous solution of gelatin, determining an unadsorbed dye concentration from the measurement of spectral absorption of the supernatant, and subtracting the same from the added dye amount to thereby determine the adsorbed dye amount. The other method comprises depositing emulsion grains, drying the same, dissolving a given weight of the deposit in a 1:1 mixture of an aqueous solution of sodium thiosulfate and methanol, and effecting a spectral absorption measurement thereof to thereby determine the adsorbed dye amount. When a plurality of sensitizing dyes are employed, the absorption amount of each dye can be determined by high-performance liquid chromatography or other techniques. With respect to the method of determining the dye absorption amount by measuring the dye amount in a supernatant, reference can be made to, for example, W. West et al., Journal of Physical Chemistry, vol. 56, page 1054 (1952). However, even unadsorbed dye may be deposited when the addition amount of dye is large, so that an accurate absorption amount may not always be obtained by the method of measuring the dye concentration of the supernatant. On the other hand, in the method in which the absorption amount of dye is determined by dissolving deposited silver halide grains, the deposition velocity of emulsion grains is overwhelmingly faster, so that grains and deposited dye can easily be separated from each other. Thus, only the amount of dye adsorbed on grains can accurately be determined. Therefore, this method is most reliable as a means for determining the dye absorption amount.

As one method of measuring the surface area of silver halide grains, there can be employed the method wherein a transmission electron micrograph is taken according to the replica method and wherein the configuration and size of each individual grain are measured and calculated. In this method, the thickness of tabular grains is calculated from the length of shadow of the replica. With respect to the method of taking a transmission electron micrograph, reference can be made to, for example, Denshi Kenbikyo Shiryo Gijutsu Shu (Electron Microscope Specimen Technique Collection) edited by the Kanto Branch of the Society of Electron Microscope of Japan and published by Seibundo Shinkosha in 1970 and P. B. Hirsch, "Electron Microscopy of Thin Crystals", Buttwrworths, London (1965).

When a multi-layer of dye chromophore is adsorbed on silver halide grains in the present invention, although the reduction potentials and oxidation potentials of the dye chromophore of the first layer, namely the layer directly adsorbed on silver halide grains, vs. the dye chromophore of the second et seq. layers are not particularly limited, it is preferred that the reduction potential of the dye chromophore of the first layer be noble to the remainder of the reduction potential of the dye chromophore of the second et seq. layers minus 0.2V.

Although the reduction potential and oxidation potential can be measured by various methods, the measurement is preferably carried out by the use of phase discrimination second harmonic a.c. polarography, whereby accurate values can be obtained. The method of measuring potentials by the use of phase discrimination second harmonic a.c. polarography is described in Journal of Imaging Science, vol. 30, page 27 (1986).

The dye chromophore of the second et seq. layers preferably consists of a luminescent dye. With respect to the type of luminescent dye, those having the skeletal structure of dye for use in dye laser are preferred. These are edited in, for example, Mitsuo Maeda, Laser Kenkyu (Laser Research), vol. 8, pp. 694, 803 and 958 (1980) and ditto, vol. 9, page 85 (1981), and F. Sehaefer, "Dye Lasers", Springer (1973).

Moreover, the absorption maximum wavelength of dye chromophore of the first layer in the silver halide photographic lightsensitive material is preferably greater than that of dye chromophore of the second et seq. layers. Further, preferably, the light emission of dye chromophore of the second et seq. layers and the absorption of dye chromophore of the first layer overlap each other. Also, it is preferred that the dye chromophore of the first layer form a J-association product. Still further, for exhibiting absorption and spectral sensitivity within a desired wavelength range, it is preferred that the dye chromophore of the second et seq. layers also form a J-association product.

The meanings of terminologies employed in the present invention are set forth below.

Dye-occupied area: Area occupied by each molecule of dye, which can experimentally be determined from adsorption isothermal lines. With respect to dyes having dye chromophores connected to each other by covalent bonds, the dye-occupied area of unconnected individual dyes can be employed as the basis.

One-layer saturated coating amount: Dye adsorption amount per grain surface area at one-layer saturated coating, which is the inverse number of the smallest dye-occupied area exhibited by added dyes.

Multi-layer adsorption: In such a state that the adsorption amount of dye chromophore per grain surface area is greater than the one-layer saturated coating amount.

Number of adsorption layers: Adsorption amount of dye chromophore per grain surface area on the basis of one-layer saturated coating amount.

The first preferable method for realizing silver halide grains of less than 500 nm maximum spectral absorption wavelength and 60 or more light absorption intensity, or 500 nm or more maximum spectral absorption wavelength and 100 or more light absorption intensity, is any of those using the following specified dyes.

For example, there can preferably be employed the method of using a dye having an aromatic group, or using a cationic dye having an aromatic group and an anionic dye having an aromatic group in combination as described in JP-A's 10-239789, 8-269009, 10-123650 and 8-328189, the method of using a dye of polyvalent charge as described in JP-A-10-171058, the method of using a dye having a pyridinium group as described in JP-A-10-104774, the method of using a dye having a hydrophobic group as described in JP-A-10-186559, and the method of using a dye having a coordination bond group as described in JP-A-10-197980.

The method of using a dye having at least one aromatic group is most preferred. In particular, the method wherein a positively charged dye, or a dye having intra-molecularly offset charges, or a dye having no charges is used alone, and the method wherein positively and negatively charged dyes are used in combination, at least one thereof having at least one aromatic group as a substituent, are preferred.

The aromatic group will now be described in detail. The aromatic group may be a hydrocarbon aromatic group or a heteroaromatic group. Further, the aromatic group may be a group having the structure of a polycyclic condensed ring resulting from mutual condensation of hydrocarbon aromatic rings or mutual condensation of heteroaromatic rings, or a polycyclic condensed ring consisting of a combination of an aromatic hydrocarbon ring and an aromatic heterocycle. The aromatic group may have a substituent. Examples of preferred aromatic rings contained in the aromatic group include benzene, naphthalene, anthracene, phenanthrene, fluorene, triphenylene, naphthacene, biphenyl, pyrrole, furan, thiophene, imidazole, oxazole, thiazole, pyridine, pyrazine, pyrimidine, pyridazine, indolizine, indole, benzofuran, benzothiophene, isobenzofuran, quinolizine, quinoline, phthalazine, naphthyridine, quinoxaline, quinoxazoline, quinoline, carbazole, phenanthridine, acridine, phenanthroline, thianthrene, chromene, xanthene, phenoxathiin, phenothiazine and phenazine. The above hydrocarbon aromatic rings are more preferred. Benzene and naphthalene are especially preferred. Benzene is most preffered.

For example, any of those aforementioned as examples of dye chromophores can be used as the dye. The dyes aforementioned as examples of polymethine dye chromophores can preferably be employed.

More preferred are a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarium dye, a croconium dye and an azamethine dye. Still more preferred are a cyanine dye, a merocyanine dye, a trinuclear merocyanine dye, a tetranuclear merocyanine dye and a rhodacyanine dye. Especially preferred are a cyanine dye, a merocyanine dye and a rhodacyanine dye. A cyanine dye is most preferred.

The following methods of using a dye (a) and (b) are preferred. Of them, the method (b) is more preferred.

(a) The method comprises using at least one of cationic, betaine and nonionic methine dyes.

(b) The method comprises using at least one cationic methine dye and at least one anionic methine dye in combination.

Although the cationic dye for use in the present invention is not particularly limited as long as the charges of dye exclusive of counter ions are cationic, it is preferred that the cationic dye be a dye having no anionic substituents. Further, although the anionic dye for use in the present invention is not particularly limited as long as the charges of dye exclusive of counter ions are anionic, it is preferred that the anionic dye be a dye having at least one anionic substituent. The betaine dye for use in the present invention is a dye which, although having charges in its molecule, forms such an intra-molecular salt that the molecule as a whole has no charges. The nonionic dye for use in the present invention is a dye having no charges at all in its molecule.

The anionic substituent refers to a substituent having a negative charge, and can be, for example, a proton-dissociable acid group, at least 90% of which is dissociated at a pH of 5 to 8. Examples of suitable anionic substituents include a sulfo group, a carboxyl group, a sulfato group, a phosphoric acid group, a boric acid group, an alkylsulfonylcarbamoylalkyl group (e.g., methanesulfonylcarbamoylmethyl), an acylcarbamoylalkyl group (e.g., acetylcarbamoylmethyl), an acylsulfamoylalkyl group (e.g., acetylsulfamoylmethyl) and an alkylsulfonylsulfamoylalkyl group (e.g., methanesulfonylsulfamoylmethyl). A sulfo group and a carboxyl group are preferably employed, and a sulfo group is more preferably employed. As the cationic substituent, there can be mentioned, for example, a substituted or unsubstituted ammonium group and pyridinium group.

Although silver halide grains of less than 500 nm maximum spectral absorption wavelength and 60 or more light absorption intensity, or 500 nm or more maximum spectral absorption wavelength and 100 or more light absorption intensity, can be realized by the above preferred method, the dye of the second layer is generally adsorbed in the form of a monomer, so that most often the absorption width and spectral sensitivity width are larger than those desired. Therefore, for realizing a high sensitivity within a desired wavelength region, it is requisite that the dye adsorbed into the second layer form a J-association product. Further, the J-association product is preferred from the viewpoint of transmitting light energy absorbed by the dye of the second layer to the dye of the first layer with a proximate light absorption wavelength by the energy transfer of the Förster type, because of the high fluorescent yield and slight Stokes shift exhibited thereby.

For forming the J-association product of the dye of the second layer from a cationic dye, a betaine dye, a nonionic dye or an anionic dye, it is preferred that the addition of dye adsorbed as the first layer be separated from the addition of dye adsorbed in the formation of the second et seq. layers, and it is more preferred that the structure of the dye of the first layer be different from that of the dye of the second et seq. layers. With respect to the dye of the second et seq. layers, it is preferred that a cationic dye, a betaine dye and a nonionic dye be added individually, or a cationic dye and an anionic dye be added in combination.

The dye of the first layer, although not particularly limited, preferably consists of a cationic dye, a betaine dye, a nonionic dye or an anionic dye, more preferably a cationic dye, a betaine dye or a nonionic dye. In the second layer, it is preferred that a cationic dye, a betaine dye or a nonionic dye be used alone. When a cationic dye and an anionic dye are used in combination, which is also a preferred use in the second layer, the ratio of cationic dye to anionic dye in the dye of the second layer is preferably in the range of 0.5 to 2, more preferably 0.75 to 1.33, and most preferably 0.9 to 1.11.

The second preferable method for realizing silver halide grains of less than 500 nm maximum spectral absorption wavelength and 60 or more light absorption intensity, or 500 nm or more maximum spectral absorption wavelength and 100 or more light absorption intensity, comprises utilizing a dye compound (linked dye) having two or more dye chromophore portions linked to each other by a covalent bond through a linking group.

The usable dye chromophore is not particularly limited, and, for example, the aforementioned dye chromophores can be employed. The aforementioned polymethine dye chromophores are preferred. More preferred are a cyanine dye, a merocyanine dye, a rhodacyanine dye and an oxonol dye. Especially preferred are a cyanine dye, a rhodacyanine dye and a merocyanine dye. A cyanine dye is most preferable.

The linking group refers to a single bond or, preferably, a divalent substituent. This linking group preferably consists of an atom or atomic group including at least one member selected from among a carbon atom, a nitrogen atom, a sulfur atom and an oxygen atom. Also, the linking group preferably includes a divalent substituent having 0 to 100 carbon atoms, more preferably 1 to 20 carbon atoms, constituted of one member or a combination of at least two members selected from among an alkylene group (e.g., methylene, ethylene, propylene, butylene or pentylene), an arylene group (e.g., phenylene or naphthylene), an alkenylene group (e.g., ethenylene or propenylene), an alkynylene group (e.g., ethynylene or propynylene), an amido group, an ester group, a sulfoamido group, a sulfonic ester group, a ureido group, a sulfonyl group, a sulfinyl group, a thioether group, an ether group, a carbonyl group, —N(Va)— (wherein Va represents a hydrogen atom or a monovalent substituent) and a heterocyclic divalent group (e.g., 6-chloro-1,3,5-triazine-2,4-diyl group, pyrimidine-2,4-diyl group or quinoxarine-2,3-diyl group). The linking group may further have a substituent, and may contain an aromatic ring or a nonaromatic hydrocarbon ring or heterocycle. As especially preferred linking groups, there can be mentioned alkylene groups each having 1 to 10 carbon atoms (e.g., methylene, ethylene, propylene and butylene), arylene groups each having 6 to 10 carbon atoms (e.g., phenylene and naphthylene), alkenylene groups each having 2 to 10 carbon atoms (e.g., ethenylene and propenylene), alkynylene groups each having 2 to 10 carbon atoms (e.g., ethynylene and propynylene), and divalent substituents each comprising one member or a combination of two or more members selected from among an ether group, an amido group, an ester group, a sulfoamido group and a sulfonic ester group and having 1 to 10 carbon atoms.

The linking group is preferably one capable of energy transfering or electron moving by through-bond interaction. The through-bond interaction includes, for example, tunnel interaction and super-exchange interaction. Especially, the through-bond interaction based on super-exchange interaction is preferred. The through-bond interaction and super-exchange interaction are as defined in Shammai Speiser, Chem. Rev., vol. 96, pp. 1960–1963, 1996. As the linking group capable of inducing an energy transfer or electron moving by such an interaction, there can preferably be employed those described in Shammai Speiser, Chem. Rev., vol. 96, pp. 1967–1969, 1996.

Preferred examples thereof include the method of using dyes linked to each other by methine chains as described in JP-A-9-265144, the method of using a dye comprising oxonol dyes linked to each other as described in JP-A-10-226758, the method of using linked dyes of specified structure as described in JP-A's 10-110107, 10-307358, 10-307359, 10-310715 and 10-204306, the method of using linked dyes of specified structure as described in JP-A's 2000-231174, 2000-231172 and 2000-231173, and the method of using a dye having a reactive group to thereby form a linked dye in the emulsion as described in JP-A-2000-81678.

Examples of especially preferably employed dyes will be listed below, to which, however, the present invention is in no way limited.

(I) Specific Examples of a Cation Dye or Betaine Dye

Y

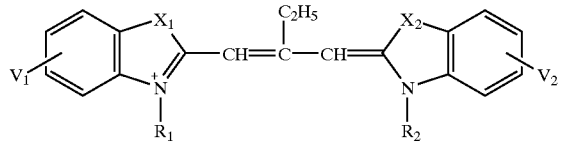

| | $X_1$ | $X_2$ | $V_1$ | $V_2$ |
|---|---|---|---|---|
| D-1 | O | O | 5-Ph | 5'-Ph |
| D-2 | O | O | 5-Ph | 5'-Ph |
| D-3 | O | S | 5-Ph | 5'-Ph |
| D-4 | O | S | 5-Ph | 5'-Ph |
| D-5 | O | O | 4,5-Benzo | 4',5'-Benzo |
| D-6 | O | O | 5,6-Benzo | 5',6'-Benzo |
| D-7 | O | O | 5,6-Benzo | 5',6'-Benzo |
| D-8 | O | O | 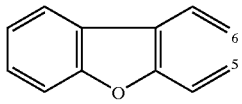 | 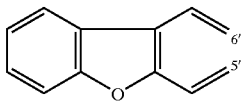 |
| D-9 | O | O | 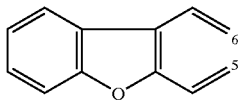 | 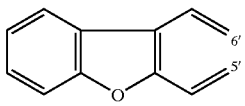 |
| D-10 | O | O | 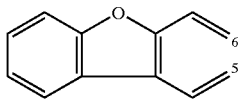 | 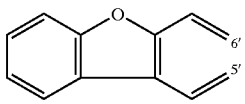 |
| D-11 | S | S | 5-Ph | 5'-Ph |
| D-12 | S | S | 5-Cl | 5'-Cl |
| D-13 | S | S | 5,6-Benzo | 5',6'-Benzo |

| | $R_1$ | $R_2$ | Y |
|---|---|---|---|
| D-1 | 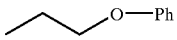 | 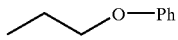 | 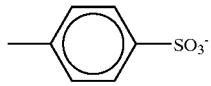 |
| D-2 | 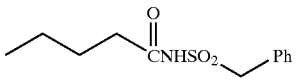 | 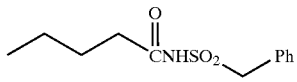 | $Br^-$ |
| D-3 | 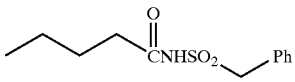 | 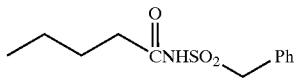 | 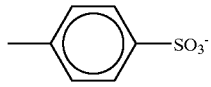 |
| D-4 | 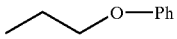 | 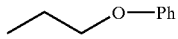 | $Br^-$ |
| D-5 | 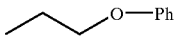 | 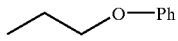 | 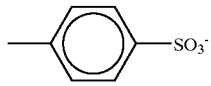 |
| D-6 | 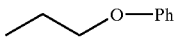 | 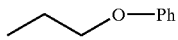 | 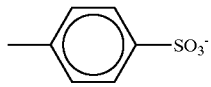 |

-continued
| | | | |
|---|---|---|---|
| D-7 | 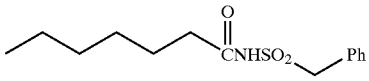 | 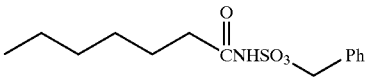 | 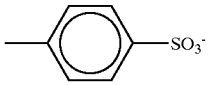 |
| D-8 | 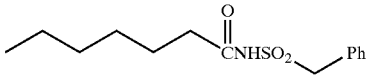 | 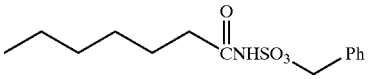 | 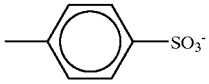 |
| D-9 | 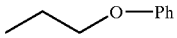 | 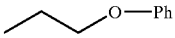 | 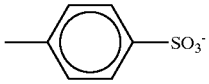 |
| D-10 | 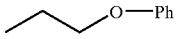 | 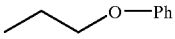 | 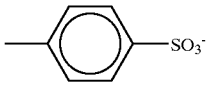 |
| D-11 | 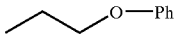 | 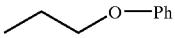 | 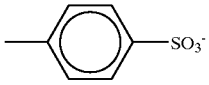 |
| D-12 | 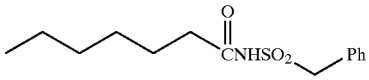 | 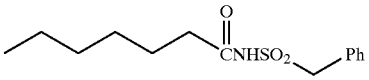 | 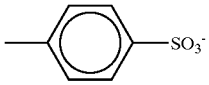 |
| D-13 | 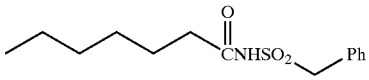 | 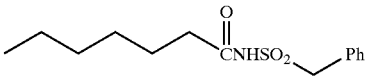 | 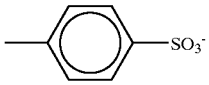 |
Y
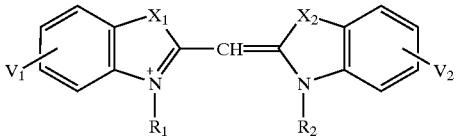
| | $X_1$ | $X_2$ | $V_1$ | $V_2$ |
|---|---|---|---|---|
| D-14 | S | S | 5-Ph | 5'-Ph |
| D-15 | S | S | 5-Ph | 5'-Ph |
| D-16 | S | S | 5,6-Benzo | 5',6'-Benzo |
| D-17 | S | O | 5,6-Benzo | 5',6'-Benzo |
| D-18 | O | O | 5,6-Benzo | 5',6'-Benzo |
| D-19 | S | S | 5,6-Benzo | 5',6'-Benzo |
| D-20 | S | S | 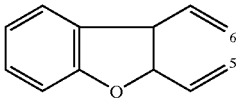 | 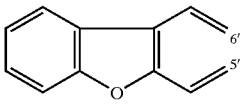 |
| | $R_1$ | $R_2$ | Y |
|---|---|---|---|
| D-14 | 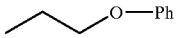 | 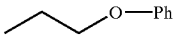 | 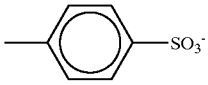 |
| D-15 | 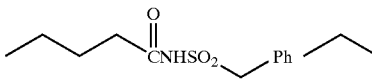 | 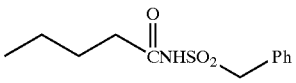 | 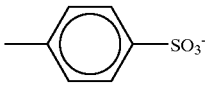 |
| D-16 | 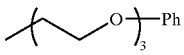 | 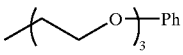 | 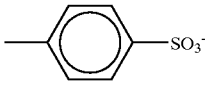 |

-continued
| | | | |
|---|---|---|---|
| D-17 | 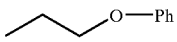 | 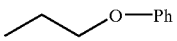 | 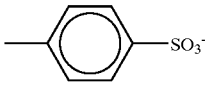 |
| D-18 | 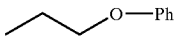 | 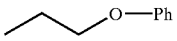 | 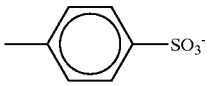 |
| D-19 | 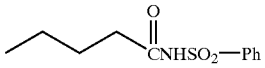 | 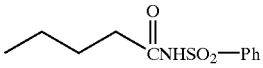 | 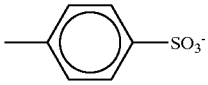 |
| D-20 | 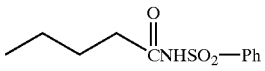 | 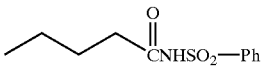 | 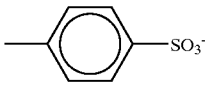 |
(II) Specific Examples of an Anion Dye
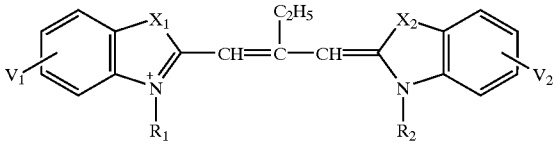
| | $X_1$ | $X_2$ | $V_1$ | $V_2$ | $R_1$ | $R_2$ | Y |
|---|---|---|---|---|---|---|---|
| D-21 | O | O | 5-Ph | 5'-Ph | 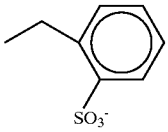 | 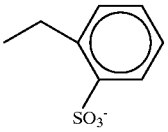 | $Na^+$ |
| D-22 | O | O | 5-Ph | 5'-Ph | 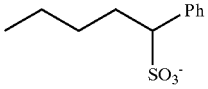 | 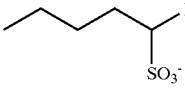 | $Na^+$ |
| D-23 | O | S | 5-Ph | 5'-Ph | 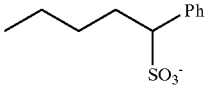 | 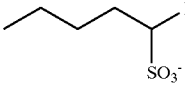 | $HN^+(C_2H_5)_3$ |
| D-24 | S | S | 5-Ph | 5'-Ph | 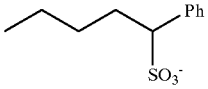 | 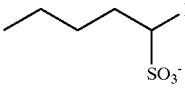 | $HN^+(C_2H_5)_3$ |
| D-25 | S | S | 5-Ph | 5'-Ph | 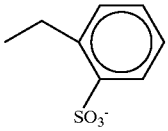 | 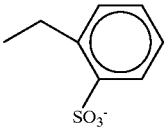 | $HN^+(C_2H_5)_3$ |
| D-26 | O | O | 5,6-Benzo | 5',6'-Benzo | 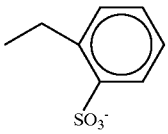 | 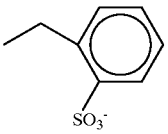 | $HN^+(C_2H_5)_3$ |

-continued
Y
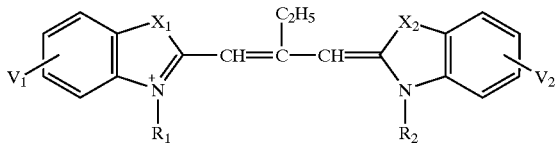
| | $X_1$ | $X_2$ | $V_1$ | $V_2$ | $R_1$ | $R_2$ | Y |
|---|---|---|---|---|---|---|---|
| D-27 | O | O | 4,5-Benzo | 5',6'-Benzo | 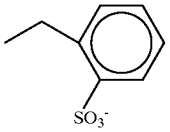 | 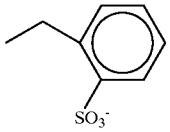 | $HN^+(C_2H_5)_3$ |
| D-28 | O | O | 5,6-Benzo | 5',6'-Benzo | 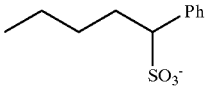 | 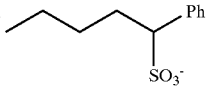 | $HN^+(C_2H_5)_3$ |
| D-29 | O | O | 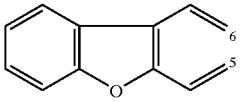 | 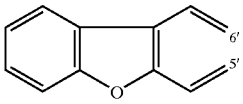 | 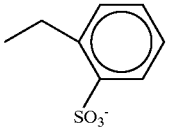 | 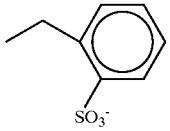 | $HN^+(C_2H_5)_3$ |
| D-30 | S | S | 5-Cl | 5'-Cl | 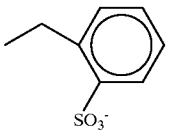 | 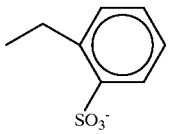 | $HN^+(C_2H_5)_3$ |
Y
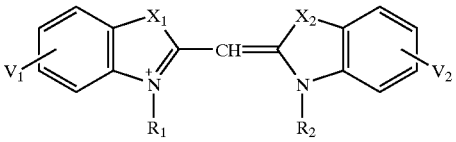
| | $X_1$ | $X_2$ | $V_1$ | $V_2$ | $R_1$ | $R_2$ | Y |
|---|---|---|---|---|---|---|---|
| D-31 | S | S | 5-Ph | 5'-Ph | 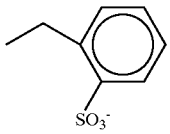 | 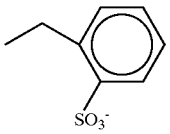 | $Na^+$ |
| D-32 | S | S | 5,6-Benzo | 5',6'-Benzo | 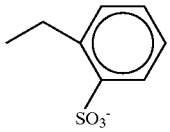 | 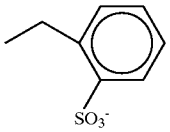 | $Na^+$ |
| D-33 | S | O | 5,6-Benzo | 5',6'-Benzo | 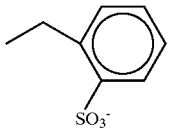 | 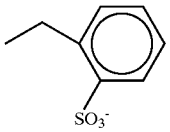 | $Na^+$ |

-continued

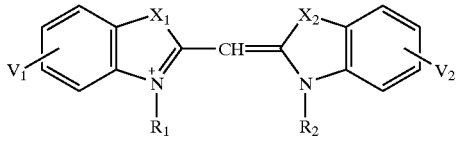

| | $X_1$ | $X_2$ | $V_1$ | $V_2$ | $R_1$ | $R_2$ | Y |
|---|---|---|---|---|---|---|---|
| D-34 | O | O | 5,6-Benzo | 5',6'-Benzo | 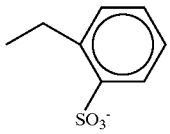 | 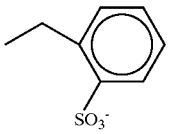 | $Na^+$ |
| D-35 | S | O | 5,6-Benzo | 5'-Ph | 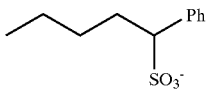 | 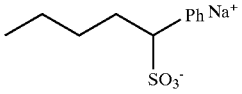 | $Na^+$ |

(III) Specific Examples of a Linked Dye

D-36

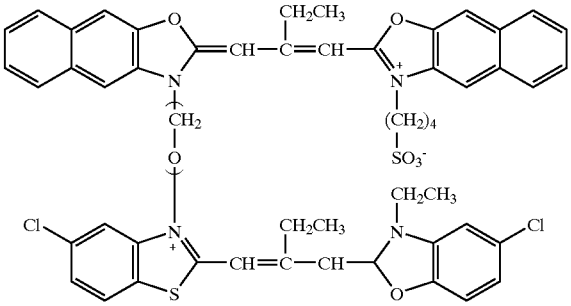

The dyes for use in the present invention can be synthesized by the methods described in, for example, F. M. Harmer, "Heterocyclic Compounds-Cyanine Dyes and Related Compounds", John Wiley & Sons, New York, London, 1964, D. M. Sturmer, "Heterocyclic Compounds-Special topics in heterocyclic chemistry", chapter 18, section 14, pages 482 to 515, John Wiley & Sons, New York, London, 1977, and Rodd's Chemistry of Carbon Compounds, 2nd. Ed. vol. IV, part B, 1977, chapter 15, pages 369 to 422, Elsevier Science Publishing Company Inc., New York.

In the present invention, organic metal salts can also be favorably used as oxidizers together with lightsensitive silver halide emulsions. Of these organic metal salts, organic silver salt is most preferably used.

An organosilver salt which can be employed in the present invention is one that is relatively stable when exposed to light but forms a silver image when heated at 80° C. or higher in the presence of exposed photo-catalyst (for example, latent image of lightsensitive silver halide) and a reducing agent. The organosilver salt may be any organic substance containing a source capable of reducing silver ions. A silver salt of organic acid, especially a silver salt of long-chain aliphatic carboxylic acid (having 10 to 30, preferably 15 to 28, carbon atoms), is preferred. A complex of organic or inorganic silver salt containing a ligand having a complex stability constant of 4.0 to 10.0 is also preferred. A silver supply material can preferably constitute about 5 to 30% by weight of each image forming layer.

Preferred organosilver salts include silver salts of organic compounds having a carboxyl group. Examples thereof include silver salts of aliphatic carboxylic acids and silver salts of aromatic carboxylic acids, to which however the present invention is in no way limited. Preferred examples of aliphatic carboxylic acid silver salts include silver behenate, silver stearate, silver oleate, silver laurate, silver caproate, silver myristate, silver palmitate, silver maleate, silver fumarate, silver tartrate, silver linolate, silver butyrate, silver camphorate and mixtures thereof.

Also, use can be made of silver salts of compounds containing a mercapto or thione group or derivatives thereof. Preferred examples of these compounds include silver salt of 3-mercapto-4-phenyl-1,2,4-triazole, silver salt of 2-mercaptobenzimidazole, silver salt of 2-mercapto-5-aminothiadiazole, silver salt of 2-(ethylglycolamido) benzothiazole, thioglycolic acid silver salts such as silver salt of s-alkylthioglycolic acid (wherein the alkyl group has 12 to 22 carbon atoms), dithiocarboxylic acid silver salts such as silver salt of dithioacetic acid, thioamide silver salt, silver salt of 5-carboxyl-1-methyl-2-phenyl-4-thiopyridine, mercaptotriazine silver salt, silver salt of 2-mercaptobenzoxazole, silver salts of U.S. Pat. No. 4,123,274 including silver salts of 1,2,4-mercaptothiazole derivatives such as silver salt of 3-amino-5-benzylthio-1,2,4-thiazole, and thione compound silver salts such as silver salt of 3-(3-carboxyethyl)-4-methyl-4-thiazoline-2-thione described in U.S. Pat. No. 3,301,678. Further, use can be made of compounds containing an imino group. Preferred examples of these compounds include benzotriazole silver salts and derivatives thereof, for example, benzotriazole silver salts such as silver salt of methylbenzotriazole and silver salts of halogenated benzotriazoles such as silver salt of 5-chlorobenzotriazole, silver salts of 1,2,4-triazole or 1-H-tetrazole described in U.S. Pat. No. 4,220,709, and silver salts of imidazole and imidazole derivatives. Still further, use can be made of various silver acetylide compounds as described in, for example, U.S. Pat. Nos. 4,761,361 and 4,775,613. These organosilver salts may be used in combination.

Preferred particular examples of organosilver salts for use in the present invention are set forth in JP-A-1-100177, which are silver salts obtained by reacting at least one member selected from among the compounds of the following general formulae (I), (II) and (III) with a silver ion supplier such as silver nitrate.

(I)

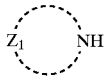

(II)

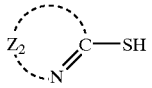

(III)

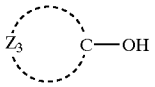

In the formulae, each of $Z_1$, $Z_2$ and $Z_3$ independently represents an atomic group required for forming a 5 to 9-membered heterocycle, which heterocycle includes a monocycle and a condenced polycycle. Herein, the heterocycle comprehends a product of condensation with a benzene ring or naphthalene ring.

The compound for use in the production of the organosilver salt in the present invention will be described in detail below.

In the general formula (I), $Z_1$ represents an atomic group required for forming a 5 to 9-membered (especially, 5-, 6- or 9-membered) heterocycle. As the heterocycle completed by $Z_1$ of the general formula (I), a 5-, 6- or 9-membered heterocycle containing at least one nitrogen atom is preferred. More preferred is a 5-, 6- or 9-membered heterocycle containing two or more nitrogen atoms, or containing at least one nitrogen atom together with an oxygen atom or sulfur atom. Herein, the heterocycle comprehends a product of condensation with a benzene ring or naphthalene ring. The heterocycle formed with $Z_1$ may have a substituent. As the substitiuents those generally known as a substituent capable of substituting to a heterocycle or a benzen ring may be referred to. Examples of such compounds include benzotriazoles, benzotriazoles described in, for example, JP-A-58-118638 and JP-A-58-118639, benzimidazoles, pyrazoloazoles described in JP-A-62-96940 {for example, 1H-imidazo[1,2-b]pyrazoles, 1H-pyrazolo[1,5-b]pyrazoles, 1H-pyrazolo[5,1-c][1,2,4]triazoles, 1H-pyrazolo[1,5-b][1,2,4]triazoles, 1H-pyrazolo[1,5-d]tetrazoles and 1H-pyrazolo[1,5-a]benzimidazoles}, triazoles, 1H-tetrazoles, carbazoles, saccharins, imidazoles and 6-aminopurines.

Among the compounds of the general formula (I), the compounds of the following general formula (I-1) are preferred.

(I-1)

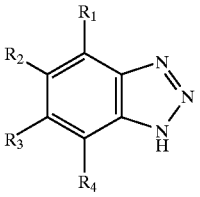

In the formula, each of $R_1$, $R_2$, $R_3$ and $R_4$ independently represents a hydrogen atom, a halogen atom, an alkyl group, an aralkyl group, an alkenyl group, an alkoxy group, an aryl group, a hydroxy group, a sulfo group or a salt thereof (for example, sodium salt, potassium salt or ammonium salt), a carboxy group or a salt thereof (for example, sodium salt, potassium salt or ammonium salt), —CN, —$NO_2$, —NRR', —COOR, —CONRR', —$NHSO_2R$ or —$SO_2NRR'$ (provided that each of R and R' represents a hydrogen atom, an alkyl group, an aryl group or an aralkyl group).

Examples of the compounds of the general formula (I) include benzotriazole, 5-butylbenzotriazole, 4-hydroxybenzotriazole, 5-hydroxybenzotriazole, 4-sulfobenzotriazole, 5-sulfobenzotriazole, sodium benzotriazole-4-sulfonate, sodium benzotriazole-5-sulfonate, potassium benzotriazole-4-sulfonate, potassium benzotriazole-5-sulfonate, ammonium benzotriazole-4-sulfonate, ammonium benzotriazole-5-sulfonate, 4-carboxybenzotriazole, 5-carboxybenzotriazole, 4-sulfo-5-benzenesulfonamidobenzotriazole, 4-sulfo-5-hydroxycarbonylmethoxybenzotriazole, 4-sulfo-5-ethoxycarbonylmethoxybenzotriazole, 4-hydroxy-5-carboxybenzotriazole, 4-sulfo-5-carboxymethylbenzotriazole, 4-sulfo-5-ethoxycarbonylmethylbenzotriazole, 4-sulfo-5-phenylbenzotriazole, 4-sulfo-5-(p-nitrophenyl)benzotriazole, 4-sulfo-5-(p-sulfophenyl)benzotriazole, 4-sulfo-5-methoxy-6-chlorobenzotriazole, 4-sulfo-5-chloro-6-carboxybenzotriazole, 4-carboxy-5-chlorobenzotriazole, 4-carboxy-5-methylbenzotriazole, 4-carboxy-5-nitrobenzotriazole, 4-carboxy-5-aminobenzotriazole, 4-carboxy-5-methoxybenzotriazole, 4-hydroxy-5-aminobenzotriazole, 4-hydroxy-5-acetamidobenzotriazole, 4-hydroxy-5-benzenesulfonamidobenzotriazole, 4-hydroxy-5-hydroxycarbonylmethoxybenzotriazole, 4-hydroxy-5-ethoxycarbonylmethoxybenzotriazole, 4-hydroxy-5-carboxymethylbenzotriazole, 4-hydroxy-5-ethoxycarbonylmethylbenzotriazole, 4-hydroxy-5-phenylbenzotriazole, 4-hydroxy-5-(p-nitrophenyl)benzotriazole, 4-hydroxy-5-(p-sulfophenyl)benzotriazole, 4-sulfo-5-chlorobenzotriazole, 4-sulfo-5-methylbenzotriazole, 4-sulfo-5-methoxybenzotriazole, 4-sulfo-5-cyanobenzotriazole, 4-sulfo-5-aminobenzotriazole, 4-sulfo-5-acetoamidobenzotriazole, sodium benzotriazole-4-caroboxylate, sodium benzotriazole-5-caroboxylate, potassium benzotriazole-4-caroboxylate, potassium benzotriazole-5-caroboxylate, ammonium benzotriazole-4-caroboxylate, ammonium benzotriazole-5-caroboxylate, 5-carbamoylbenzotriazole, 4-sulfamoylbenzotriazole, 5-carboxy-6-hydroxybenzotriazole, 5-carboxy-7-sulfobenzotriazole, 4-hydroxy-5-sulfobenzotriazole, 4-hydroxy-7-sulfobenzotriazole, 5,6-dicarboxybenzotriazole, 4,6-dihydroxybenzotriazole, 4-hydroxy-5-chlorobenzotriazole, 4-hydroxy-5-methylbenzotriazole, 4-hydroxy-5-methoxybenzotriazole, 4-hydroxy-5-nitrobenzotriazole, 4-hydroxy-5-cyanobenzotriazole, 4-carboxy-5-acetamidobenzotriazole, 4-carboxy-5-ethoxycarbonylmethoxybenzotriazole, 4-carboxy-5-carboxymethylbenzotriazole, 4-carboxy-5-phenylbenzotriazole, 4-carboxy-5-(p-nitrophenyl)benzotriazole, 4-carboxy-5-methyl-7-sulfobenzotriazole, imidazole, benzimidazole, pyrazole, urazole, 6-aminopurine,

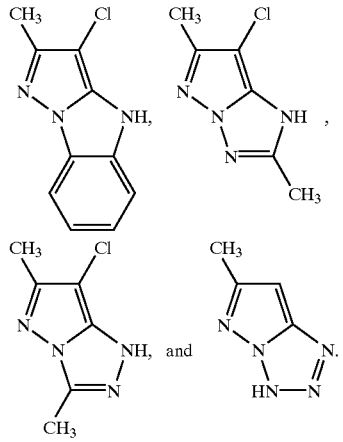

These may be used in combination.

The compounds represented by the general formula (II) will now be described. In the general formula (II), $Z_2$ represents an atomic group required for forming a 5 to 9-membered (especially, 5-, 6- or 9-membered) heterocycle, which heterocycle includes a monocycle and a condenced polyheterocycle. As the heterocycle completed by $Z_2$ of the above general formula (including C and N of the formula), a 5-, 6- or 9-membered heterocycle containing at least one nitrogen atom is preferred. More preferred is a 5-, 6- or 9-membered heterocycle containing two or more nitrogen atoms, or containing at least one nitrogen atom together with an oxygen atom or sulfur atom. Herein, the heterocycle comprehends a product of condensation with a benzene ring or naphthalene ring. The heterocycle formed with $Z_2$ may have a substituent. As the substitiuents those generally known as a substituent capable of substituting to a heterocycle or a benzene ring may be referred to. Examples of such compounds include 2-mercaptobenzothiazoles, 2-mercaptobenzinidazoles, 2-mercaptothiadiazoles and 5-mercaptotetrazoles.

Particular examples of the compounds represented by the above general formula (II) include the following compounds, to which, however, the present invention is in no way limited.

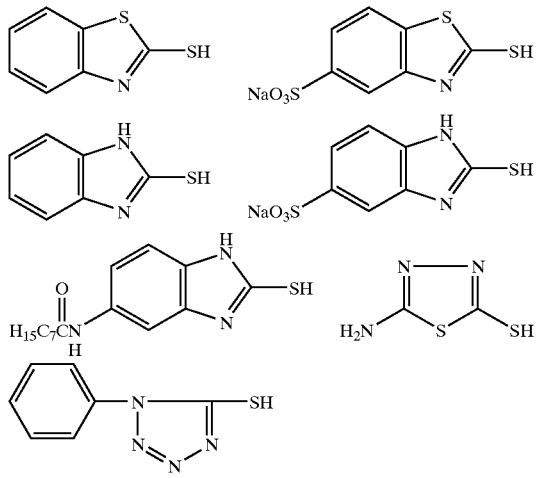

-continued

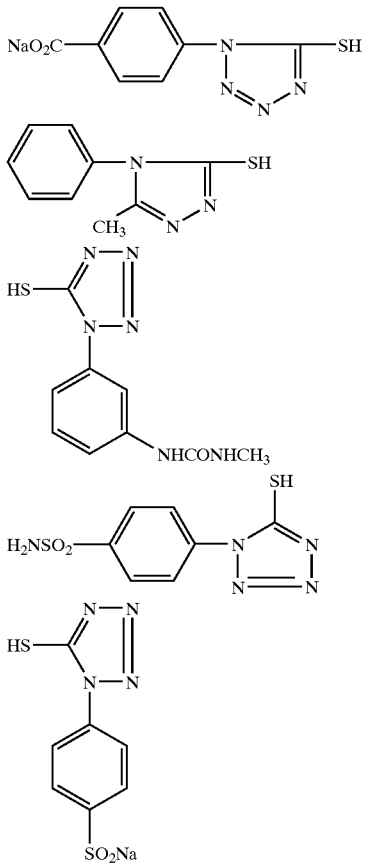

The compounds represented by the general formula (III) will be described below. In the general formula (III), $Z_3$ represents an atomic group required for forming a 5 to 9-membered (especially, 5-, 6- or 9-membered) heterocycle. As the heterocycle completed by $Z_3$ of the above general formula, a 5-, 6- or 9-membered heterocycle containing at least one nitrogen atom is preferred. More preferred is a 5-, 6- or 9-membered heterocycle containing two or more nitrogen atoms, or containing at least one nitrogen atom together with an oxygen atom or sulfur atom. Herein, the heterocycle comprehends a product of condensation with a benzene ring, or naphthalene ring, or nitrogen-containing heterocycle having various substituents. Examples of the compounds include hydroxytetrazaindenes, hydroxypyrimidines, hydroxypyridazines an hydroxypyrazines.

Specific examples of the compounds represented by the above general formula (III) include the following compounds, to which, however, the present invention is in no way limited.

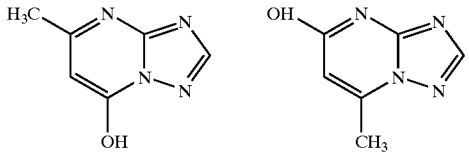

-continued

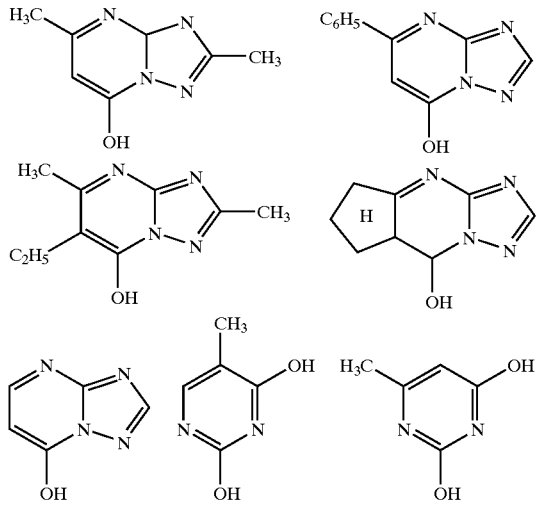

Among the compounds represented by the general formula (I), (II) and (III), the compounds represented by formula (I) is preferable In the present invention, any of the compounds of the general formulae (I), (II) and (III) is mixed with silver nitrate in an appropriate reaction medium to thereby form a silver salt of the compound (hereinafter referred to as "organosilver salt"). Part of the silver nitrate can be replaced by another silver ion supplier (for example, silver chloride or silver acetate).

The method of adding such reactants is arbitrary. A compound of the general formula (I) to (III) may first be placed in a reaction vessel and thereafter loaded with silver nitrate. Alternatively, silver nitrate may first be placed in a reaction vessel and thereafter loaded with a compound of the general formula (I) to (III). Still alternatively, part of a compound of the general formula (I) to (III) may first be placed in a reaction vessel, subsequently loaded with part of silver nitrate, and thereafter sequentially loaded with the remainders of compound of the general formula (I) to (III) and silver nitrate. Still alternatively, silver nitrate and a compound of the general formula (I) to (III) may be simultaneously placed in a reaction vessel. During the reaction, it is preferred to effect agitation.

Although the compound of the general formula (I) to (III) is generally mixed with silver nitrate at a proportion of 0.8 to 100 mol per mol of silver, the reactants can be used outside this proportion, depending on the type of the compound. The addition rates of silver nitrate and the compound may be regulated so as to control the silver ion concentration during the reaction.

The layer to be loaded with the organosilver salt is not limited, and the organosilver salt may be incorporated in one layer or a plurality of layers. Incorporating the organosilver salt in a layer containing no lightsensitive silver halide emulsion in the hydrophilic colloid layers provided on the side having silver halide emulsion layers, such as a protective layer, an interlayer or a so-called substratum disposed between a support and an emulsion layer, is preferred from the viewpoint of storage life improvement.

This organosilver salt can be jointly used in an amount of 0.01 to 10 mol, preferably 0.05 to 1 mol, per mol of lightsensitive silver halide that is contained in the layer to which the organosilver salt is added. It is appropriate for the coating amount total of lightsensitive silver halide and organosilver salt to be in the range of 0.01 to 10 g/m$^2$, preferably 0.1 to 6 g/m$^2$, in terms of silver.

The silver halide emulsion and/or organosilver salt of the present invention can be protected against additional fogging and can be stabilized so as to be free from sensitivity change during storage by the use of an antifoggant, a stabilizer and a stabilizer precursor. As a suitable antifoggant, stabilizer and stabilizer precursor which can be used individually or in combination, there can be mentioned thiazonium salts described in U.S. Pat. Nos. 2,131,038 and 2,694,716; azaindenes described in U.S. Pat. Nos. 2,886,437 and 2,444,605; mercury salts described in U.S. Pat. No. 2,728,663; urazoles described in U.S. Pat. No. 3,287,135; sulfocatechols described in U.S. Pat. No. 3,235,652; oximes, nitrons and nitroindazoles described in GB No. 623,448; polyvalent metal salts described in U.S. Pat. No. 2,839,405; thiuronium salts described in U.S. Pat. No. 3,220,839; palladium, platinum and gold salts described in U.S. Pat. Nos. 2,566,263 and 2,597,915; halogenated organic compounds described in U.S. Pat. Nos. 4,108,665 and 4,442,202; triazines described in U.S. Pat. Nos. 4,128,557, 4,137,079, 4,138,365 and 4,459,350; and phosphorus compounds described in U.S. Pat. No. 4,411,985.

As the antifoggant which can preferably be employed in the present invention, there can be mentioned organic halides, examples of which include compounds disclosed in, for example, JP-A's 50-119624, 50-120328, 51-121332, 54-58022, 56-70543, 56-99335, 59-90842, 61-129642, 62-129845, 6-208191, 7-5621, 7-2781 and 8-15809, and U.S. Pat. Nos. 5,340,712, 5,369,000 and 5,464,737.

The antifoggant for use in the present invention may be added to a coating liquid in the form of any of, for example, a solution, powder and a solid particulate dispersion. The solid particulate dispersion is obtained by the use of known atomizing means (for example, ball mill, vibration ball mill, sand mill, colloid mill, jet mill or roller mill). In the preparation of the solid particulate dispersion, use may be made of a dispersion auxiliary.

The lightsensitive material of the present invention may contain benzoic acids for attaining sensitivity enhancement and fogging prevention. Although the benzoic acids for use in the present invention may be any of benzoic acid derivatives, compounds described in, for example, U.S. Pat. Nos. 4,784,939 and 4,152,160 can be mentioned as providing preferable forms of structures thereof.

The benzoic acids of the present invention, although may be added to any portion of the lightsensitive material, is preferably added to a layer of the lightsensitive layer side, more preferably to a layer containing an organosilver salt. The timing of addition of benzoic acids of the present invention may be any stage of the process for preparing the coating liquid. In the addition to a layer containing an organosilver salt, the addition, although may be effected at any stage between preparation of the organosilver salt to preparation of the coating liquid, is preferably carried out between preparation of the organosilver salt and just before coating operation. With respect to the method of adding the benzoic acids of the present invention, the addition may be effected in the form of, for example, any of powder, a solution and a particulate dispersion. Also, the addition may be effected in the form of a solution wherein the benzoic acid is mixed with other additives such as a sensitizing dye and a reducing agent. The addition amount of benzoic acids of the present invention, although not limited, is preferably in the range of $1\times10^{-6}$ to 2 mol, more preferably $1\times10^{-3}$ to 0.5 mol, per mol of silver.

The lightsensitive material of the present invention can be loaded with a mercapto compound, a disulfide compound and a thione compound in order to control development through development inhibition or acceleration, to enhance spectral sensitization efficiency and to prolong storage life before and after development.

When a mercapto compound is used in the present invention, although the structure thereof is not limited, compounds of the formula Ar—SM or Ar—S—S—Ar can preferably be employed. In the formula, M represents a hydrogen atom or an alkali metal atom. Ar represents an aromatic ring group or condensed aromatic ring group containing at least one nitrogen, sulfur, oxygen, selenium or tellurium atom. Preferably, the heteroaromatic ring includes benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazolinone. This heteroaromatic ring may have a substituent, for example, selected from the group consisting of halogens (e.g., Br and Cl), hydroxy, amino, carboxy, alkyls (e.g., alkyls having 1 or more carbon atoms, preferably 1 to 4 carbon atoms) and alkoxies (e.g., alkoxies having 1 or more carbon atoms, preferably 1 to 4 carbon atoms). As mercapto-substituted heteroaromatic compounds, there can be mentioned, for example, 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobisbenzothiazole, 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole and 2-mercapto-4-phenyloxazole. The present invention is however in no way limited to these.

The addition amount of these mercapto compounds is preferably in the range of 0.001 to 1.0 mol, more preferably 0.01 to 0.3 mol, per mol of silver in an emulsion layer.

In the lightsensitive material of the present invention there can preferably be employed a silver halide solvent. For example, there can preferably be employed thiosulfates, sulfites, thiocyanates, thioether compounds described in JP-B-47-11386, compounds having a 5- or 6-membered imido group, such as uracil or hydantoin, described in JP-A-8-179458, compounds having a carbon to sulfur double bond as described in JP-A-53-144319, and mesoionic thiolate compounds such as trimethyltriazolium thiolate as described in Analytica Chimica Acta, vol. 248, pages 604 to 614 (1991). Also, compounds which can fix and stabilize silver halides as described in JP-A-8-69097 can be used as the silver halide solvent.

The amount of silver halide solvent contained in the lightsensitive material is in the range of 0.01 to 100 mmol/$m^2$, preferably 0.1 to 50 mmol/$m^2$, and more preferably 10 to 50 mmol/$m^2$. The molar ratio of silver halide solvent to coating silver of the lightsensitive material is in the range of 1/20 to 20, preferably 1/10 to 10, and more preferably 1/3 to 3. The silver halide solvent may be added to a solvent such as water, methanol, ethanol, acetone, dimethylformamide or methylpropylglycol, or an alkali or acid aqueous solution, or may be dispersed so as to form a solid particulate dispersion, before the addition to the coating liquid. The silver halide solvents may be used individually. Also, preferably, a plurality thereof can be used in combination.

Hydrophilic binders are preferably employed in the lightsensitive material and constituent layers thereof. Examples of such hydrophilic binders include those described in the aforementioned RD's and JP-A-64-13546, pages 71 to 75. In particular, transparent or translucent hydrophilic binders are preferred, which can be constituted of, for example, natural compounds including a protein, such as gelatin or a gelatin derivative, and a polysaccharide, such as a cellulose derivative, starch, gum arabic, dextran or pulluran, or synthetic polymer compounds, such as polyvinyl alcohol, modified polyvinyl alcohol (e.g., terminal-alkylated Poval MP 103 and MP 203 produced by Kuraray Co., Ltd.), polyvinylpyrrolidone and an acrylamide polymer. Also, use can be made of highly water absorbent polymers described in, for example, U.S. Pat. No. 4,960,681 and JP-A-62-245260, namely, a homopolymer of any of vinyl monomers having —COOM or —$SO_3$M (M is a hydrogen atom or an alkali metal), a copolymer of such vinyl monomers and a copolymer of any of such vinyl monomers and another vinyl monomer (e.g., sodium methacrylate or ammonium methacrylate, Sumikagel L-5H produced by Sumitomo Chemical Co., Ltd.). These binders can be used individually or in combination. A combination of gelatin and other binder mentioned above is preferred. The gelatin can be selected from among lime-processed gelatin, acid-processed gelatin and delimed gelatin which is one having a content of calcium and the like reduced in conformity with variable purposes. These can be used in combination.

Polymer latex is also preferably employed as the binder in the present invention. The polymer latex is a dispersion of a water-insoluble hydrophobic polymer, as fine particles, in a water-soluble dispersion medium. The state of dispersion is not limited, and the polymer latex may be any of a latex comprising a polymer emulsified in a dispersion medium, a product of emulsion polymerization, a micelle dispersion, and a molecular dispersion of molecular chains per se due to the presence of partial hydrophilic structure in polymer molecule. With respect to the polymer latex for use in the present invention, reference can be made to, for example, Gosei Jushi Emulsion (Synthetic Resin Emulsion) edited by Taira Okuda and Hiroshi Inagaki and published by Polymer Publishing Association (1978), Gosei Latex no Oyo (Application of Synthetic Latex) edited by Takaaki Sugimura, Yasuo Kataoka, Soichi Suzuki and Keiji Kasahara and published by Polymer Publishing. Association (1993), and Gosei Latex no Kagaku (Chemistry of Synthetic Latex) edited by Soichi Muroi and published by Polymer Publishing Association (1970).

The average particle diameter of dispersed particles is preferably in the range of about 1 to 50,000 nm, more preferably 5 to 1000 nm. The particle diameter distribution of dispersed particles is not particularly limited. The polymer species for use in the polymer latex are, for example, an acrylic resin, a vinyl acetate resin, a polyester resin, a polyurethane resin, a rubber resin, a vinyl chloride resin, a vinylidene chloride resin and a polyolefin resin.

The polymer may be linear, or branched, or crosslinked. The polymer may be a product of polymerization of a single monomer, known as a homopolymer, or a copolymer obtained by polymerization of a plurality of monomers. The copolymer may be a random copolymer, or a block copolymer.

The molecular weight of the polymer is preferably in the range of about 0.5 to 1000 thousand, more preferably 1 to 500 thousand, in terms of number average molecular weight Mn. When the molecular weight is extremely small, the mechanical strength of the lightsensitive layer is unsatisfactory. On the other hand, when the molecular weight is extremely large, the film forming properties are unfavorably deteriorated.

With respect to the polymer of the polymer latex for use in the present invention, the equilibrium water content at 25° C. 60% RH is preferably 2 wt % or less, more preferably 1 wt % or less. The lower limit of the equilibrium water content, although not particularly limited, is preferably 0.01 wt %, more preferably 0.03 wt %. With respect to the definition and measuring method of the equilibrium water content, reference can be made to, for example, "Kobunshi Kogaku Koza 14, Kobunshi Zairyo Shiken Hou (Polymer Engineering Course 14, Polymer Material Testing Method)" edited by the Society of Polymer Science of Japan and published by Chijin Shokan Co., Ltd. Specifically, the equilibrium water content at 25° C. 60% RH can be expressed by the following formula including the mass $W_1$ of polymer humidity-controlled and equilibrated in an atmosphere of 25° C. 60% RH and the mass $W_0$ of polymer absolutely dried at 25° C.:

$$\text{"Equilibrium water content at 25° C. 60% RH"} = \{(W_1 - W_0)/W_0\} \times 100 (\text{wt } \%)$$

These polymers are commercially available, and the following polymers can be used in the form of polymer latexes. Examples of acrylic resins include Cevian A-4635, 46583 and 4601 (produced by Daicel Chemical Industries, Ltd.) and Nipol Lx811, 814, 821, 820 and 857 (produced by Nippon Zeon Co., Ltd.). Examples of polyester resins include Finetex ES650, 611, 675 and 850 (produced by Dainippon Ink & Chemicals, Inc.) and WD-size, WMS (produced by Eastman Chemical). Examples of polyurethane resins include Hydran AP10, 20, 30 and 40 (produced by Dainippon Ink & Chemicals, Inc.). Examples of rubber resins include Lacstar 7310K, 3307B, 4700H, 7132C and DS206 (produced by Dainippon Ink & Chemicals, Inc.) and Nipol Lx416, 433, 410, 438C and 2507 (produced by Nippon Zeon Co., Ltd.). Examples of vinyl chloride resins include G351 and G576 (produced by Nippon Zeon Co., Ltd.). Examples of vinylidene chloride resins include L502 and L513 (produced by Asahi Chemical Industry Co., Ltd.). Examples of olefin resins include Chemipearl S120 and SA100 (produced by Mitsui Chemicals, Inc.). These polymers may be used individually in the form of polymer latexes, or a plurality thereof may be blended together before use according to necessity.

It is especially preferred that the polymer latex for use in the present invention consist of a latex of styrene/butadiene copolymer. In the styrene/butadiene copolymer, the weight ratio of styrene monomer units to butadiene monomer units is preferably in the range of 50:50 to 95:5. The ratio of styrene monomer units and butadiene monomer units to the whole copolymer is preferably in the range of 50 to 99% by weight. The preferred range of molecular weight thereof is as aforementioned.

As the latex of styrene/butadiene copolymer preferably employed in the present invention, there can be mentioned, for example, commercially available Lacstar 3307B, 7132C and DS206 and Nipol Lx416 and Lx 433.

In the present invention, it is appropriate for the coating amount of binder to be in the range of 1 to 20 g/m$^2$, preferably 2 to 15 g/m$^2$, and more preferably 3 to 12 g/m$^2$. In the binder, the gelatin content is in the range of 50 to 100 wt. %, preferably 70 to 100 wt. %.

Next, the developing agent and/or its precursor that are preferably contained in the lightsensitive material of the present invention will be described.

As the color developing agent, although p-phenylenediamine derivatives or p-aminophenol derivatives can be used, it is preferred to employ the compounds of the aforementioned general formulae (1) to (5).

(1)

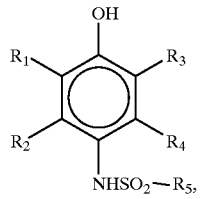

(2)

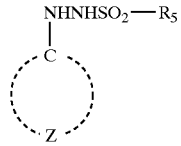

(3)

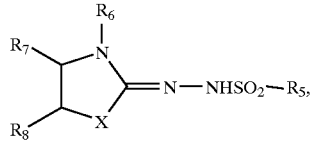

(4)

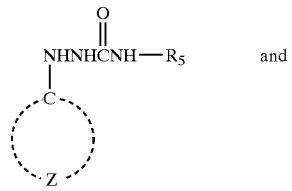

and (5)

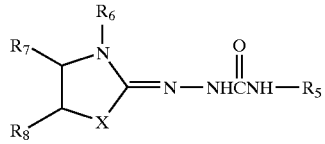

The compounds of the general formula (1) are those generally termed "sulfonamidophenols".

In the general formula (1), each of $R_1$ to $R_4$ independently represents a hydrogen atom, a halogen atom (e.g., chloro or bromo), an alkyl group (e.g., methyl, ethyl, isopropyl, n-butyl or t-butyl), an aryl group (e.g., phenyl, tolyl or xylyl), an alkylcarbonamido group (e.g., acetylamino, propionylamino or butyroylamino), an arylcarbonamido group (e.g., benzoylamino), an alkylsulfonamido group (e.g., methanesulfonylamino or ethanesulfonylamino), an arylsulfonamido group (e.g., benzenesulfonylamino or toluenesulfonylamino), an alkoxy group (e.g., methoxy, ethoxy or butoxy), an aryloxy group (e.g., phenoxy), an alkylthio group (e.g., methylthio, ethylthio or butylthio), an arylthio group (e.g., phenylthio or tolylthio), an alkylcarbamoyl group (e.g., methylcarbamoyl, dimethylcarbamoyl, ethylcarbamoyl, diethylcarbamoyl, dibutylcarbamoyl, piperidylcarbamoyl or morpholinylcarbamoyl), an arylcarbamoyl group (e.g., phenylcarbamoyl, methylphenylcarbamoyl, ethylphenylcarbamoyl or benzylphenylcarbamoyl), a carbamoyl group, an alkylsulfamoyl group (e.g., methylsulfamoyl, dimethylsulfamoyl, ethylsulfamoyl, diethylsulfamoyl, dibutylsulfamoyl, piperidylsulfamoyl or morpholynosulfamoyl), an arylsulfamoyl group (e.g., phenylsulfamoyl, methylphenylsulfamoyl, ethylphenylsulfamoyl or benzylphenylsulfamoyl), a sulfamoyl group, a cyano group, an alkylsulfonyl group (e.g., methanesulfonyl or ethanesulfonyl), an arylsulfonyl group (e.g., phenylsulfonyl, 4-chlorophenylsulfonyl or p-toluenesulfonyl), an alkoxycarbonyl group (e.g., methoxycarbonyl, ethoxycarbonyl or butoxycarbonyl), an aryloxycarbonyl group (e.g., phenoxycarbonyl), an alkylcarbonyl group (e.g., acetyl, propionyl or butyroyl), an arylcarbonyl group (e.g., benzoyl or alkylbenzoyl), or an acyloxy group (e.g., acetyloxy, propionyloxy or butyroyloxy). Among $R_1$ to $R_4$, each of $R_2$ and $R_4$ preferably represents a hydrogen atom. $R_1$ to $R_4$ are preferably such electron attractive substituents that the total of Hammett's constant σp values thereof is 0 or greater. The upper limit of the Hammett's constant σp values thereof is not particularly limited, but 1 is preferable.

$R_5$ represents an alkyl group (e.g., methyl, ethyl, butyl, octyl, lauryl, cetyl or stearyl), an aryl group (e.g., phenyl, tolyl, xylyl, 4-methoxyphenyl, dodecylphenyl, chlorophenyl, trichlorophenyl, nitrochlorophenyl, triisopropylphenyl, 4-dodecyloxyphenyl or 3,5-di-(methoxycarbonyl)phenyl) or a heterocyclic group (e.g., pyridyl).

The compounds of the general formula (2) are those generally termed "sulfonylhydrazines". The compounds of the general formula (4) are those generally termed "carbamoylhydrazines".

In the general formulae (2) and (4), $R_5$ represents an alkyl group (e.g., methyl, ethyl, butyl, octyl, lauryl, cetyl or stearyl), an aryl group (e.g., phenyl, tolyl, xylyl, 4-methoxyphenyl, dodecylphenyl, chlorophenyl, dichlorophenyl, trichlorophenyl, nitrochlorophenyl, triisopropylphenyl, 4-dodecyloxyphenyl or 3,5-di-(methoxycarbonyl)phenyl) or a heterocyclic group (e.g., pyridyl). Z represents an atomic group forming an aromatic ring, preferably a 5- to 6-membered aromatic ring. When the aromatic ring is a heterocyclic aromatic ring, a heterocycle or a benzen ring may be condenced thereto. The aromatic ring formed by Z must have satisfactory electron withdrawing properties for providing the above compounds with a silver development activity. Accordingly, a nitrogen-containing aromatic ring, or an aromatic ring such as one comprising a benzene ring having electron attractive groups introduced therein, is preferred. As such an aromatic ring, there can be preferably employed, for example, a pyridine ring, a pyrazine ring, a pyrimidine ring, a quinoline ring or a quinoxaline ring.

When Z is a benzene ring, as substituents thereof, there can be mentioned, for example, an alkylsulfonyl group (e.g., methanesulfonyl or ethanesulfonyl), a halogen atom (e.g., chloro or bromo), an alkylcarbamoyl group (e.g., methylcarbamoyl, dimethylcarbamoyl, ethylcarbamoyl, diethylcarbamoyl, dibutylcarbamoyl, piperidylcarbamoyl or morpholynocarbamoyl), an arylcarbamoyl group (e.g., phenylcarbamoyl, methylphenylcarbamoyl, ethylphenylcarbamoyl or benzylphenylcarbamoyl), a carbamoyl group, an alkylsulfamoyl group (e.g., methylsulfamoyl, dimethylsulfamoyl, ethylsulfamoyl, diethylsulfamoyl, dibutylsulfamoyl, piperidylsulfamoyl or morpholynosulfamoyl), an arylsulfamoyl group (e.g., phenylsulfamoyl, methylphenylsulfamoyl, ethylphenylsulfamoyl or benzylphenylsulfamoyl), a sulfamoyl group, a cyano group, an alkylsulfonyl group (e.g., methanesulfonyl or ethanesulfonyl), an arylsulfonyl group (e.g., phenylsulfonyl, 4-chlorophenylsulfonyl or p-toluenesulfonyl), an alkoxycarbonyl group (e.g., methoxycarbonyl, ethoxycarbonyl or butoxycarbonyl), an aryloxycarbonyl group (e.g., phenoxycarbonyl), an alkylcarbonyl group (e.g., acetyl, propionyl or butyroyl), and an arylcarbonyl group (e.g., benzoyl or alkylbenzoyl). The sum of, Hammett's constant σ values of these substituent is preferably 1 or more. The upper limit of the sum of σ values is preferably 3.8.

The compounds of the general formula (3) are those generally termed "sulfonylhydrazones". The compounds of the general formula (5) are those generally termed "carbamoylhydrazones".

In the general formulae (3) and (5), $R_5$ represents an alkyl group (e.g., methyl, ethyl, butyl, octyl, lauryl, cetyl or stearyl), an aryl group (e.g., phenyl, tolyl, xylyl, 4-methoxyphenyl, dodecylphenyl, chlorophenyl, dichlorophenyl, trichlorophenyl, nitrochlorophenyl, triisopropylphenyl, 4-dodecyloxyphenyl or 3,5-di-(methoxycarbonyl)phenyl) or a heterocyclic group (e.g., pyridyl). $R_6$ represents a substituted or unsubstituted alkyl group (e.g., methyl or ethyl). X represents any of an oxygen atom, a sulfur atom, a selenium atom and a tertiary nitrogen atom substituted with at least one of an alkyl and aryl groups. Of these, an alkyl-substituted tertiary nitrogen atom is preferred. $R_7$ and $R_8$ each represent a hydrogen atom or a substituent, provided that $R_7$ and $R_8$ may be bonded to each other to thereby form a double bond or a ring. The substituent represented by $R_7$ and $R_8$ are the same as mentioned above for $R_1$ to $R_4$.

Particular examples of the compounds represented by the general fourmulae (1) to (5) will be set forth below, to which, however, the compounds of the present invention are not limited.

D-1

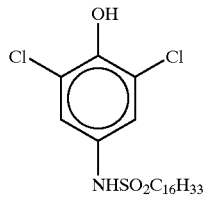

D-2

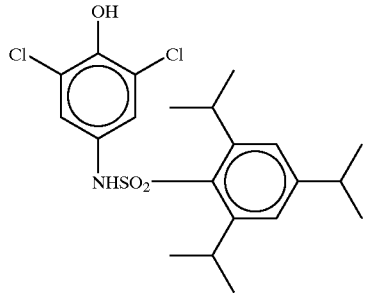

D-3

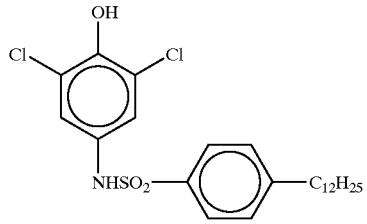

-continued
D-4
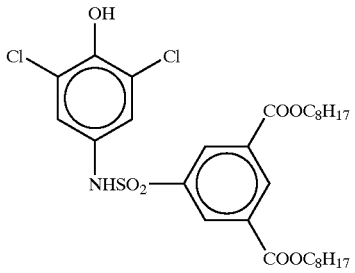
D-5
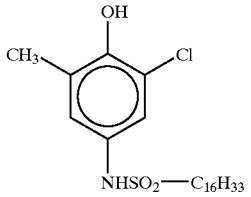
D-6
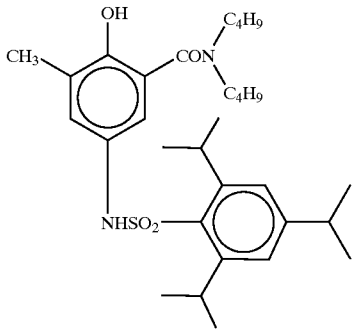
D-7
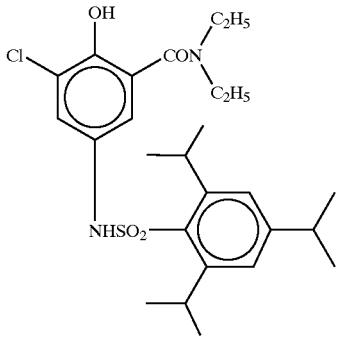
D-8
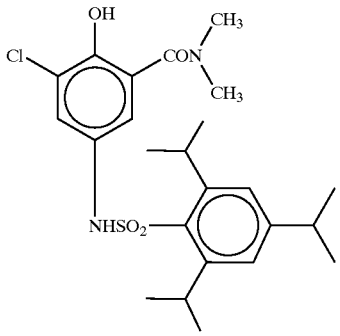
-continued
D-9
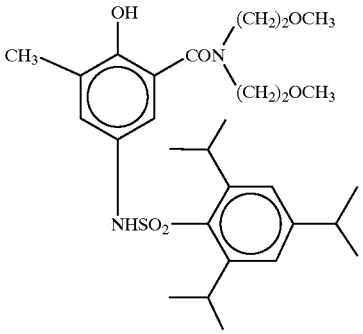
D-10
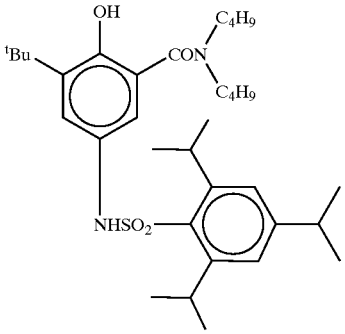
D-11
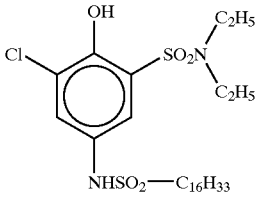
D-12
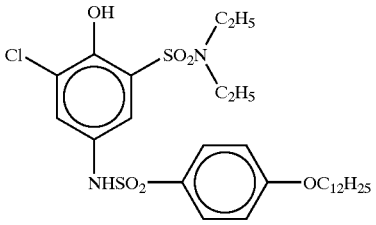
D-13
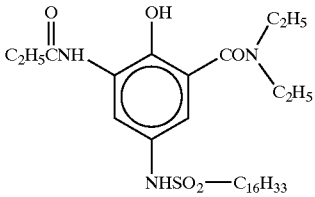
D-14
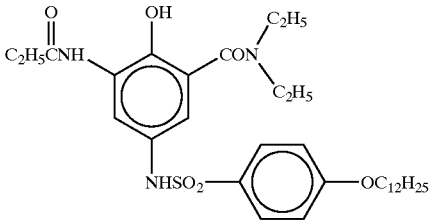

-continued
D-15
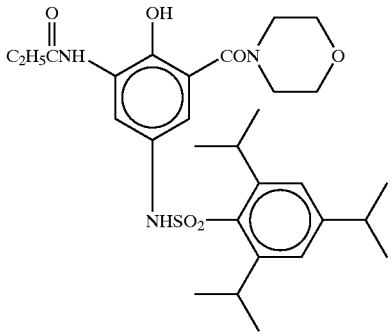
D-16
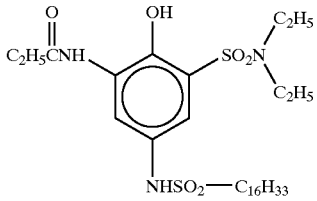
D-17
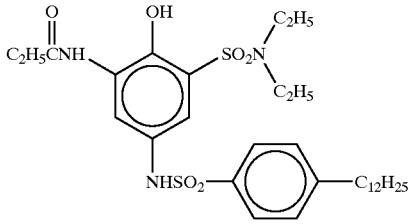
D-18
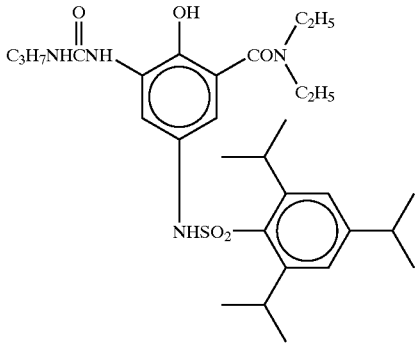
D-19
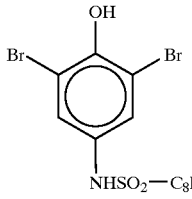
D-20
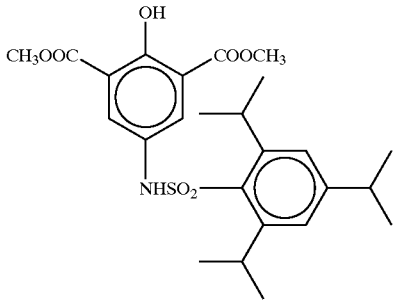
-continued
D-21
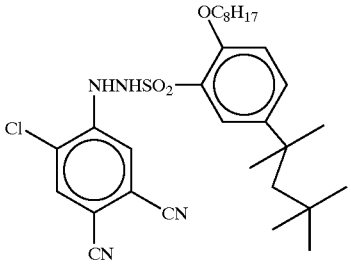
D-22
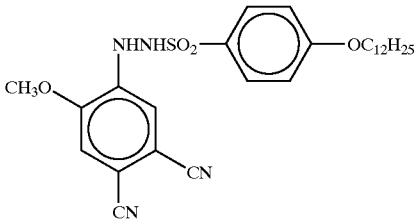
D-23
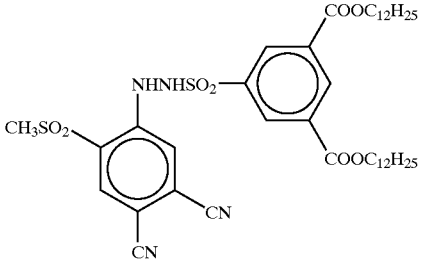
D-24
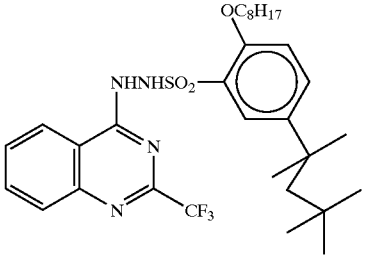
D-25
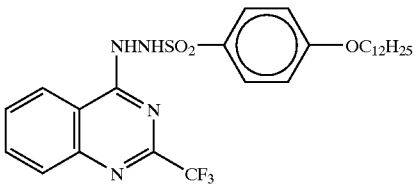
D-26
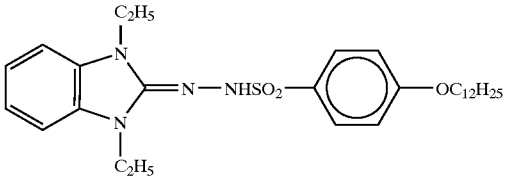
D-27
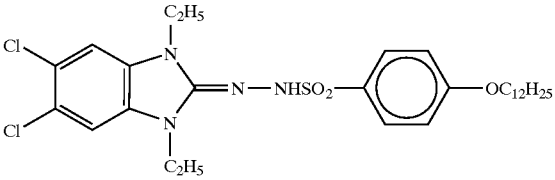

-continued
D-28
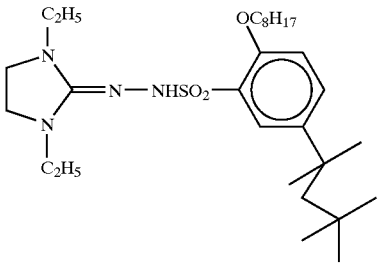
D-29
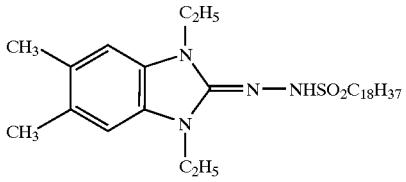
D-30
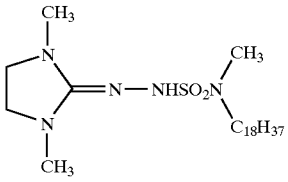
D-31
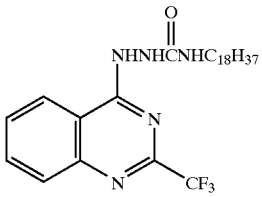
D-32
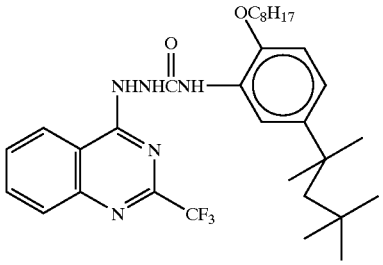
D-33
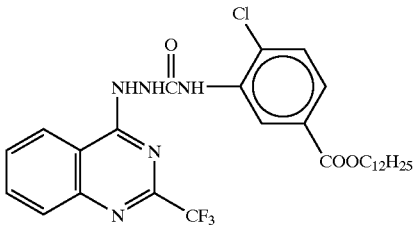
-continued
D-34
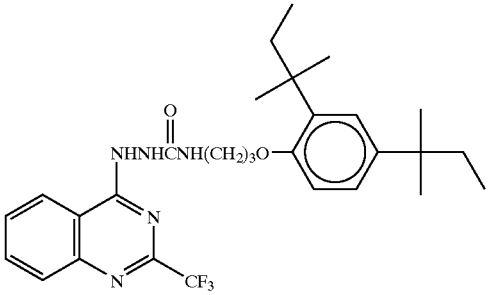
D-35
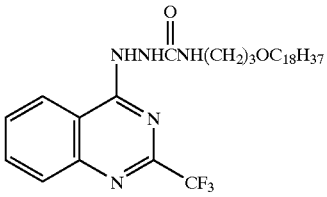
D-36
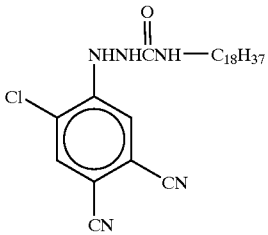
D-37
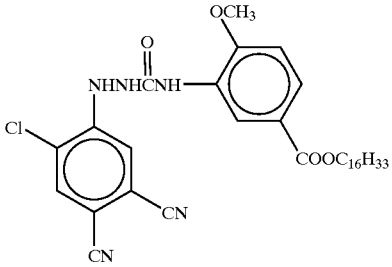
D-38
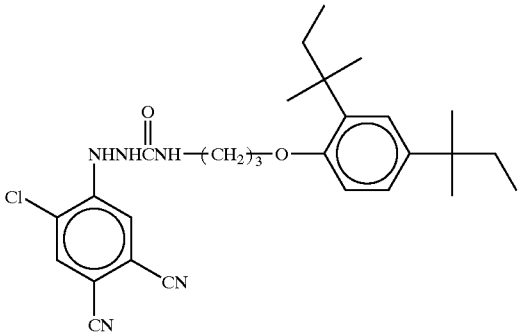

-continued
D-39
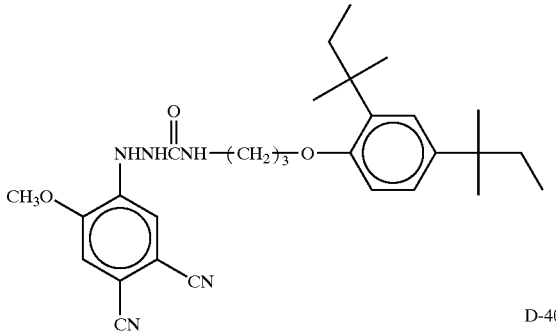
D-40
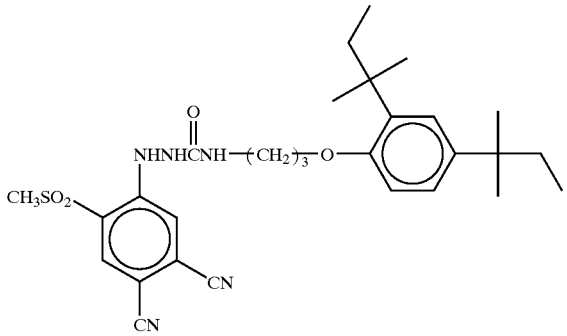
D-41
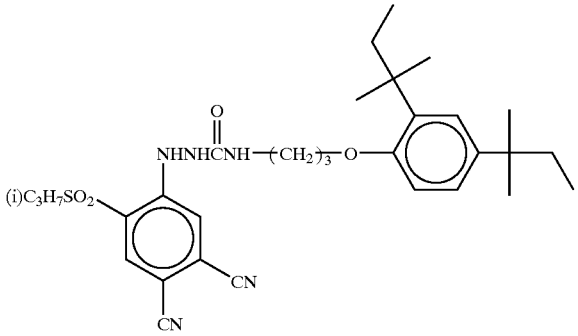
D-42
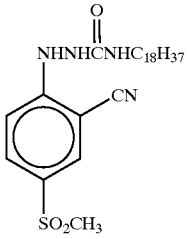
D-43
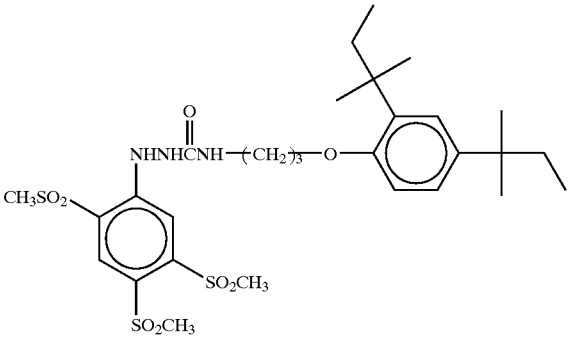
-continued
D-44
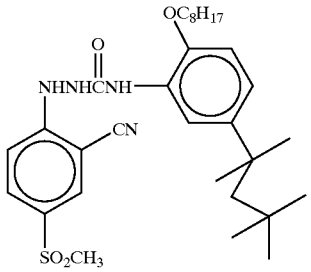
D-45
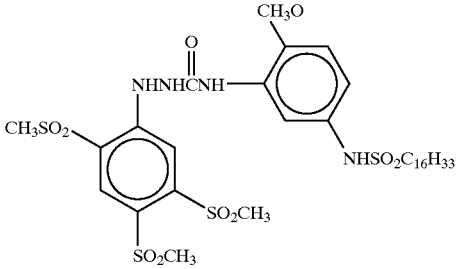
D-46
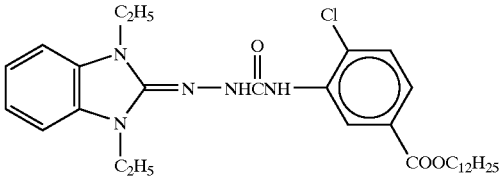
D-47
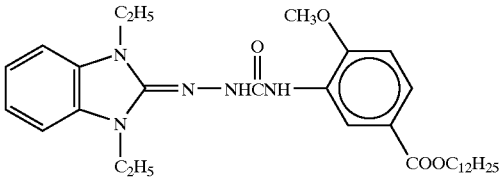
D-48
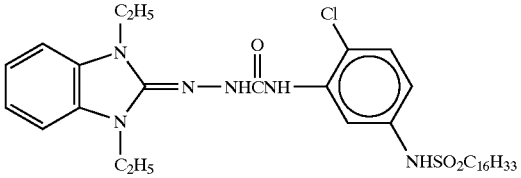

-continued

D-49

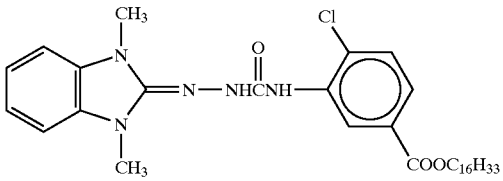

D-50

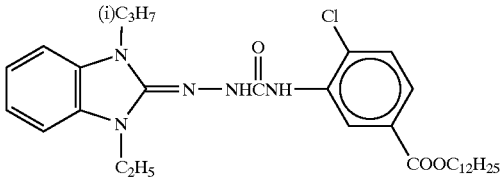

D-51

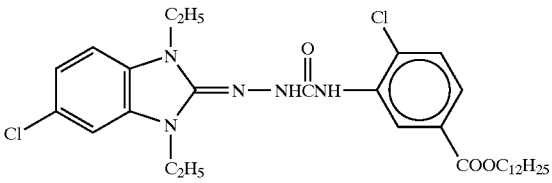

D-52

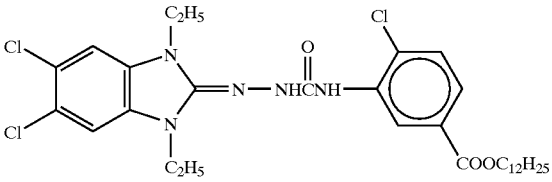

D-53

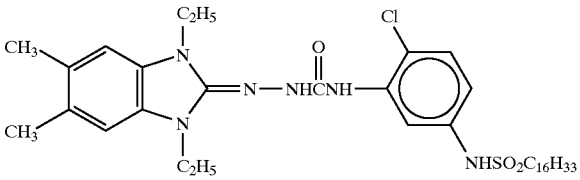

D-54

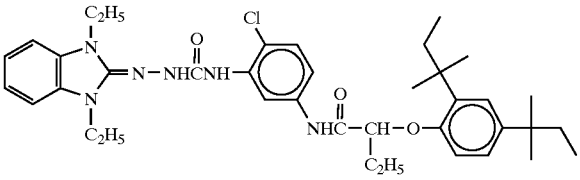

D-55

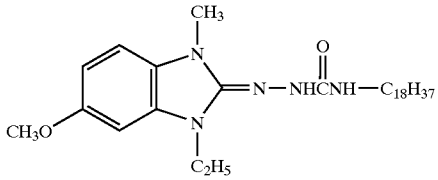

D-56

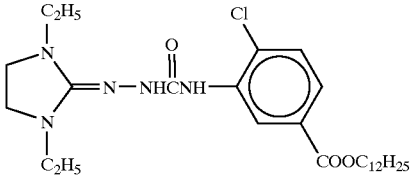

-continued

D-57

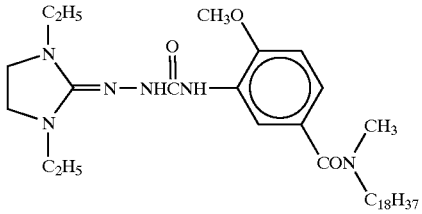

D-58

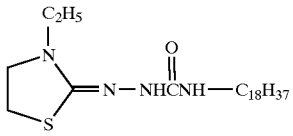

D-59

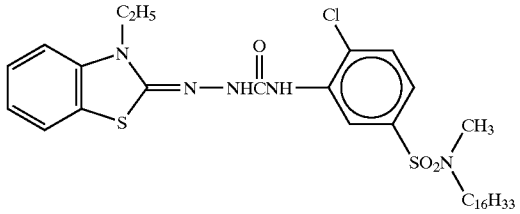

D-60

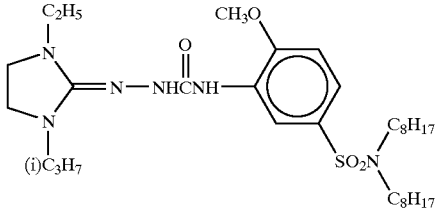

Now, the compounds represented by the general formula (6) of the present invention will be described in detail.

(6)

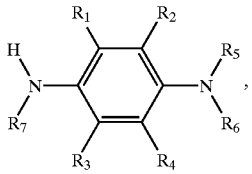

Each of $R_1$, $R_2$, $R_3$ and $R_4$ independently represents a hydrogen atom or a substituent. The substituent represented by $R_1$, $R_2$, $R_3$ or $R_4$ can be a halogen atom, an alkyl group (including a cycloalkyl and a bicycloalkyl), an alkenyl group (including a cycloalkenyl and a bicycloalkenyl), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including anilino), an acylamino group, an aminocarbonylamino group, an alkoxycarbonylamino group, an aryloxycarbonylamino group, a sulfamoylamino group, an alkyl- or arylsulfonylamino group, a mercapto group, an alkylthio group, an arylthio group, a heterocyclic thio group, a sulfamoyl group, a sulfo group, an alkyl- or arylsulfinyl group, an alkyl- or arylsulfonyl group, an acyl group, an aryloxycarbonyl group, an alkoxycarbonyl group, a carbamoyl group, an aryl- or heterocyclic azo group, an imido group, a phosphino group, a phosphinyl group, a phosphinyloxy group, a phosphinylamino group, or a silyl group.

More specifically, the substituent represented by $R_1$, $R_2$, $R_3$ or $R_4$ can be a halogen atom (e.g., a chlorine atom, a bromine atom or an iodine atom); an alkyl group [representing a linear, branched or cyclic substituted or unsubstituted alkyl group, and including an alkyl group (preferably an alkyl group having 1 to 30 carbon atoms, such as methyl, ethyl, n-propyl, isopropyl, t-butyl, n-octyl, eicosyl, 2-chloroethyl, 2-cyanoethyl or 2-ethylhexyl), a cycloalkyl group (preferably a substituted or unsubstituted cycloalkyl group having 3 to 30 carbon atoms, such as cyclohexyl, cyclopentyl or 4-n-dodecylcyclohexyl), a bicycloalkyl group (preferably a substituted or unsubstituted bicycloalkyl group having 5 to 30 carbon atoms, which is a monovalent group corresponding to a bicycloalkane having 5 to 30 carbon atoms from which one hydrogen atom is removed, such as bicyclo[1,2,2]heptan-2-yl or bicyclo[2,2,2]octan-3-yl), and a tricyclo or more cycle structure; the alkyl contained in the following substituents (for example, the alkyl of alkylthio group) also means the alkyl group of this concept]; an alkenyl group [representing a linear, branched or cyclic substituted or unsubstituted alkenyl group, and including an alkenyl group (preferably a substituted or unsubstituted alkenyl group having 2 to 30 carbon atoms, such as vinyl, allyl, prenyl, geranyl or oleyl), a cycloalkenyl group (preferably a substituted or unsubstituted cycloalkenyl group having 3 to 30 carbon atoms, which is a monovalent group corresponding to a cycloalkene having 3 to 30 carbon atoms from which one hydrogen atom is removed, such as 2-cyclopenten-1-yl or 2-cyclohexen-1-yl), and a bicycloalkenyl group (substituted or unsubstituted bicycloalkenyl group, preferably a substituted or unsubstituted bicycloalkenyl group having 5 to 30 carbon atoms, which is a monovalent group corresponding to a bicycloalkene having one double bond from which one hydrogen atom is removed, such as bicyclo[2,2,1]hept-2-en-1-yl or bicyclo[2,2,2]oct-2-en-4-yl)]; an alkynyl group (preferably a substituted or unsubstituted alkynyl group having 2 to 30 carbon atoms, such as ethynyl, propargyl or trimethylsilylethynyl); an aryl group (preferably a substituted or unsubstituted aryl group having 6 to 30 carbon atoms, such as phenyl, p-tolyl, naphthyl, m-chlorophenyl or o-hexadecanoylaminophenyl); a heterocyclic group (preferably a monovalent group corresponding to a 5- or 6-membered substituted or unsubstituted aromatic or nonaromatic heterocyclic compound from which one hydrogen atom is removed, and to which an aromatic hydrocarbon ring such as benzene ring may be condenced (among the substituents to be described later, the heterocyclic group of the groups each having a heterocyclic group (e.g., the heterocyclic group of heterocyclic thio group) also means the heterocyclic group of such a concept mentioned above), more preferably a 5- or 6-membered aromatic heterocyclic group having 3 to 30 carbon atoms, such as 2-furyl, 2-thienyl, 2-pyrimidinyl or 2-benzothiazolyl); a cyano group; a hydroxyl group; a nitro group; a carboxyl group; an alkoxy group (preferably a substituted or unsubstituted alkoxy group having 1 to 30 carbon atoms, such as methoxy, ethoxy, isopropoxy, t-butoxy, n-octyloxy or 2-methoxyethoxy); an aryloxy group (preferably a substituted or unsubstituted aryloxy group having 6 to 30 carbon atoms, such as phenoxy, 2-methylphenoxy, 4-t-butylphenoxy, 3-nitrophenoxy or 2-tetradecanoylaminophenoxy); a silyloxy group (preferably a silyloxy group having 3 to 20 carbon atoms, such as trimethylsilyloxy or t-butyldimethylsilyloxy); a heterocyclic oxy group (preferably a substituted or unsubstituted heterocyclic oxy group having 2 to 30 carbon atoms, such as 1-phenyltetrazol-5-oxy or 2-tetrahydropyranyloxy); an acyloxy group (preferably a formyloxy group, a substituted or unsubstituted alkylcarbonyloxy group having 2 to 30 carbon atoms or a substituted or unsubstituted arylcarbonyloxy group having 7 to 30 carbon atoms, such as formyloxy, acetyloxy, pivaloyloxy, stearoyloxy, benzoyloxy or p-methoxyphenylcarbonyloxy); a carbamoyloxy group (preferably a substituted or unsubstituted carbamoyloxy group having 1 to 30 carbon atoms, such as N,N-dimethylcarbamoyloxy, N,N-diethylcarbamoyloxy, morpholinocarbonyloxy, N,N-di-n-octylaminocarbonyloxy or N-n-octylcarbamoyloxy); an alkoxycarbonyloxy group (preferably a substituted or unsubstituted alkoxycarbonyloxy group having 2 to 30 carbon atoms, such as methoxycarbonyloxy, ethoxycarbonyloxy, t-butoxycarbonyloxy or n-octylcarbonyloxy); an aryloxycarbonyloxy group (preferably a substituted or unsubstituted aryloxycarbonyloxy group having 7 to 30 carbon atoms, such as phenoxycarbonyloxy, p-methoxyphenoxycarbonyloxy or p-n-hexadecyloxyphenoxycarbonyloxy); an amino group (preferably an amino group, a substituted or unsubstituted alkylamino group having 1 to 30 carbon atoms or a substituted or unsubstituted anilino group having 6 to 30 carbon atoms, such as amino, methylamino, dimethylamino, anilino, N-methylanilino or diphenylamino); an acylamino group (preferably an formylamino group, a substituted or unsubstituted alkylcarbonylamino group having 2 to 30 carbon atoms or a substituted or unsubstituted arylcarbonylamino group having 7 to 30 carbon atoms, such as formylamino, acetylamino, pivaloylamino, lauroylamino, benzoylamino or 3,4,5-tri-n-octyloxyphenylcarbonylamino); an aminocarbonylamino group (preferably a substituted or unsubstituted aminocarbonylamino group having 1 to 30 carbon atoms, such as carbamoylamino, N,N-dimethylaminocarbonylamino, N,N-diethylaminocarbonylamino or morpholinocarbonylamino); an alkoxycarbonylamino group (preferably a substituted or unsubstituted alkoxycarbonylamino group having 2 to 30 carbon atoms, such as methoxycarbonylamino, ethoxycarbonylamino, t-butoxycarbonylamino, n-octadecyloxycarbonylamino or N-methylmethoxycarbonylamino); an aryloxycarbonylamino group (preferably a substituted or unsubstituted aryloxycarbonylamino group having 7 to 30 carbon atoms, such as phenoxycarbonylamino, p-chlorophenoxycarbonylamino or m-n-octyloxyphenoxycarbonylamino); a sulfamoylamino group (preferably a substituted or unsubstituted sulfamoylamino group having 0 to 30 carbon atoms, such as sulfamoylamino, N,N-dimethylaminosulfonylamino or N-n-octylaminosulfonylamino); an alkyl- or arylsulfonylamino group (preferably a substituted or unsubstituted alkylsulfonylamino group having 1 to 30 carbon atoms or a substituted or unsubstituted arylsulfonylamino group having 6 to 30 carbon atoms, such as methylsulfonylamino, butylsulfonylamino, phenylsulfonylamino, 2,3,5-trichlorophenylsulfonylamino or p-methylphenylsulfonylamino); a mercapto group; an alkylthio group (preferably a substituted or unsubstituted alkylthio group having 1 to 30 carbon atoms, such as methylthio, ethylthio or n-hexadecylthio); an arylthio group (preferably a substituted or unsubstituted arylthio group having 6 to 30 carbon atoms, such as phenylthio, p-chlorophenylthio or m-methoxyphenylthio); a heterocyclic thio group (preferably a substituted or unsubstituted heterocyclic thio group having 2 to 30 carbon atoms, such as 2-benzothiazolylthio or 1-phenyltetrazol-5-ylthio); a sulfamoyl group (preferably a substituted or unsubstituted sulfamoyl group having 0 to 30 carbon atoms, such as N-ethylsulfamoyl, N-(3-dodecyloxypropyl)sulfamoyl, N,N-dimethylsulfamoyl, N-acetylsulfamoyl, N-benzoylsulfamoyl or N-(N'-phenylcarbamoyl)sulfamoyl); a sulfo group; an alkyl- or arylsulfinyl group (preferably a substituted or unsubstituted alkylsulfinyl group having 1 to 30 carbon atoms or a substituted or unsubstituted arylsulfinyl group having 6 to 30 carbon atoms, such as methylsulfinyl, ethylsulfinyl, phenylsulfinyl or p-methylphenylsulfinyl); an alkyl- or arylsulfonyl group (preferably a substituted or unsubstituted alkylsulfonyl group having 1 to 30 carbon atoms or a substituted or unsubstituted arylsulfonyl group having 6 to 30 carbon atoms, such as methylsulfonyl, ethylsulfonyl, phenylsulfonyl or p-methylphenylsulfonyl); an acyl group (preferably a formyl group, a substituted or unsubstituted alkylcarbonyl group having 2 to 30 carbon atoms or a substituted or unsubstituted arylcarbonyl group having 7 to 30 carbon atoms, such as acetyl, pivaloyl, 2-chloroacetyl, stearoyl, benzoyl or p-n-octyloxyphenylcarbonyl); an aryloxycarbonyl group (preferably a substituted or unsubstituted aryloxycarbonyl group having 7 to 30 carbon atoms, such as phenoxycarbonyl, o-chlorophenoxycarbonyl, m-nitrophenoxycarbonyl or p-t-butylphenoxycarbonyl); an alkoxycarbonyl group (preferably a substituted or unsubstituted alkoxycarbonyl group having 2 to 30 carbon atoms, such as methoxycarbonyl, ethoxycarbonyl, t-butoxycarbonyl or n-octadecyloxycarbonyl); a carbamoyl group (preferably a substituted or unsubstituted carbamoyl group having 1 to 30 carbon atoms, such as carbamoyl, N-methylcarbamoyl, N,N-dimethylcarbamoyl, N,N-di-n-octylcarbamoyl or N-(methylsulfonyl)carbamoyl); an aryl- or heterocyclic azo group (preferably a substituted or unsubstituted arylazo group having 6 to 30 carbon atoms or a substituted or unsubstituted heterocyclic azo group having 3 to 30 carbon atoms, such as phenylazo, p-chlorophenylazo or 5-ethylthio-1,3,4-thiadiazol-2-ylazo); an imido group (preferably. N-succinimido or N-phthalimido); a phosphino group (preferably a substituted or unsubstituted phosphino group having 2 to 30 carbon atoms, such as dimethylphosphino, diphenylphosphino or methylphenoxyphosphino); a phosphinyl group (preferably a substituted or unsubstituted phosphinyl group having 0 to 30 carbon atoms, such as phosphinyl, dioctyloxyphosphinyl or diethoxyphosphinyl); a phosphinyloxy group (preferably a substituted or unsubstituted phosphinyloxy group having 2 to 30 carbon atoms, such as diphenoxyphosphinyloxy or dioctyloxyphosphinyloxy); a phosphinylamino group (preferably a substituted or unsubstituted phosphinylamino group having 2 to 30 carbon atoms, such as dimethoxyphosphinylamino or dimethylaminophosphinylamino); or a silyl group (preferably a substituted or unsubstituted silyl group having 0 to 30 carbon atoms, such as trimethylsilyl, t-butyldimethylsilyl or phenyldimethylsilyl).

When the groups represented by $R_1$ to $R_4$ are further substitutable groups, the groups represented by $R_1$ to $R_4$ may further have substituents. Preferred substituents are the same as the substituents described with respect to $R_1$ to $R_4$. When the substitution is effected by two or more substituents, the substituents may be identical with or different from each other.

Each of $R_5$ and $R_6$ independently represents an alkyl group, an aryl group, a heterocyclic group, an acyl group, an alkylsulfonyl group or an arylsulfonyl group. With respect to the preferred scope of the alkyl group, aryl group, heterocyclic group, acyl group, alkylsulfonyl group and arylsulfonyl group, these are the same as the alkyl group, aryl group, heterocyclic group, acyl group, alkylsulfonyl group and arylsulfonyl group described above, respectively, in connection with the substituents represented by $R_1$ to $R_4$. When the groups represented by $R_5$ and $R_6$ are further substitutable groups, the groups represented by $R_5$ and $R_6$ may further have substituents. Preferred substituents are the same as the substituents described with respect to $R_1$ to $R_4$. When the substitution is effected by two or more substituents, the substituents may be identical with or different from each other.

$R_1$ and $R_2$, $R_3$ and $R_4$, $R_5$ and $R_6$, $R_2$ and $R_5$, and/or $R_4$ and $R_6$ may be bonded to each other to thereby form a 5-membered, 6-membered or 7-membered ring.

In the general formula (6), $R_7$ represents $R_{11}$—O—CO—, $R_{12}$—CO—CO—, $R_{13}$—NH—CO—, $R_{14}$—$SO_2$—, $R_{15}$—W—C($R_{16}$)($R_{17}$)— or $(M)_{1/n}$OSO2—, wherein each of $R_{11}$, $R_{12}$, $R_{13}$ and $R_{14}$ represents an alkyl group, an aryl group or a heterocyclic group, $R_{15}$ represents a hydrogen atom or a block group, W represents an oxygen atom, a sulfur atom or >N—$R_{18}$, and each of $R_{16}$, $R_{17}$ and $R_{18}$ represents a hydrogen atom, an alkyl group or $(M)_{1/n}SO_2$—. The alkyl group, aryl group and heterocyclic group represented by $R_{11}$, $R_{12}$, $R_{13}$ and $R_{14}$ are the same as the alkyl group, aryl group and heterocyclic group described above, respectively, in connection with the substituents represented by $R_1$ to $R_4$. M represents a n-valence cation, such as, for example, Na+ and K+. n represents a natural number, preferably a natural number of 1 to 3. When the groups represented by $R_{11}$, $R_{12}$, $R_{13}$ and $R_{14}$ are further substitutable groups, the groups represented by $R_{11}$, $R_{12}$, $R_{13}$ and $R_{14}$ may further have substituents. Preferred substituents are the same as the substituents described with respect to $R_1$ to $R_4$. When the substitution is effected by two or more substituents, the substituents may be identical with or different from each other. When $R_{16}$, $R_{17}$ and $R_{18}$ represent alkyl groups, these are the same as the alkyl group described above in connection with the substituents represented by $R_1$ to $R_4$. When $R_{15}$ represents a block group, it is the same as the block group represented by BLK described later.

The compounds of the general formula (6) will now be described with respect to the preferred scope thereof.

Each of $R_1$ to $R_4$ preferably represents a hydrogen atom, a halogen atom, an alkyl group, an aryl group, an acylamino group, an alkyl- or arylsulfonylamino group, an alkoxy group, an aryloxy group, an alkylthio group, an arylthio group, an acyl group, an alkoxycarbonyl group, an aryloxycarbonyl group, a carbamoyl group, a cyano group, a hydroxyl group, a carboxyl group, a sulfo group, a nitro group, a sulfamoyl group, an alkylsulfonyl group, an arylsulfonyl group or an acyloxy group. Each of $R_1$ to $R_4$ more preferably represents a hydrogen atom, a halogen atom, an alkyl group, an acylamino group, an alkyl- or arylsulfonylamino group, an alkoxy group, an alkylthio group, an arylthio group, an alkoxycarbonyl group, a carbamoyl group, a cyano group, a hydroxyl group, a carboxyl group, a sulfo group, a nitro group, a sulfamoyl group, an alkylsulfonyl group or an arylsulfonyl group. It is especially preferred that, among $R_1$ to $R_4$, either of $R_1$ and $R_3$ be a hydrogen atom. Each of $R_5$ and $R_6$ preferably represents an alkyl group, an aryl group or a heterocyclic group, most preferably an alkyl group.

With respect to the compounds of the general formula (6), it is preferred that the formula weight of moiety excluding $R_7$ be 300 or more. Further, it is preferred that the oxidation potential in pH 10 water of p-phenylenediamine derivative, i.e., compound of the general formula (6) wherein $R_7$ is a hydrogen atom do not exceed 5 mV (vs. SCE).

$R_7$ preferably represents $R_{11}$—O—CO—, $R_{14}$—$SO_2$— or $R_{15}$—W—C($R_{16}$)($R_{17}$)—, most preferably $R_{11}$—O—CO—.

$R_{11}$ preferably represents an alkyl group, or a group containing a timing group capable of inducing a cleavage reaction with the use of electron transfer reaction as described in U.S. Pat. Nos. 4,409,323 and 4,421,845, or a group of the following formula (T-1) having a timing group whose terminal capable of inducing an electron transfer reaction is blocked.

BLK—W—(X=Y)$j$–$C$($R_{21}$)$R_{22}$—** Formula (T-1)

wherein BLK represents a block group; ** represents a position for bonding with —O—CO—; W represents an oxygen atom, a sulfur atom or >N—$R_{23}$; each of X and Y represents a methine or a nitrogen atom; j is 0, 1 or 2; and each of $R_{21}$, $R_{22}$ and $R_{23}$ represents a hydrogen atom or any of the same groups as the substituents described with respect to $R_1$ to $R_4$. When X and Y represent substituted methines, the substituents and any two of the substituents of $R_{21}$, $R_{22}$ and $R_{23}$ may be connected to each other to thereby form a cyclic structure (e.g., a benzene ring or a pyrazole ring). It is also possible to avoid such a cyclic structure formation.

As the block group represented by BLK, there can be employed known block groups, which include block groups such as acyl and sulfonyl groups as described in, for example, JP-B-48-9968, JP-A's 52-8828 and 57-82834, U.S. Pat. No. 3,311,476 and JP-B-47-44805 (U.S. Pat. No. 3,615,617); block groups utilizing the reverse Michael reaction as described in, for example, JP-B-55-17369 (U.S. Pat. No. 3,888,677), JP-B-55-9696 (U.S. Pat. No. 3,791,830), JP-B-55-34927 (U.S. Pat. No. No. 4,009,029), JP-A-56-77842 (U.S. Pat. No. 4,307,175) and JP-A's 59-105640, 59-105641 and 59-105642; block groups utilizing the formation of a quinone methide or quinone methide homologue through intramolecular electron transfer as described in, for example, JP-B-54-39727, U.S. Pat. Nos. 3,674,478, 3,932,480 and 3,993,661, JP-A-57-135944, JP-A-57-135945 (U.S. Pat. No. 4,420,554), JP-A's 57-136640 and 61-196239, JP-A-61-196240 (U.S. Pat. No. 4,702,999), JP-A-61-185743, JP-A-61-124941 (U.S. Pat. No. 4,639,408) and JP-A-2-280140; block groups utilizing an intramolecular nucleophilic substitution reaction as described in, for example, U.S. Pat. Nos. 4,358,525 and 4,330,617, JP-A-55-53330 (U.S. Pat. No. 4,310,612), JP-A's 59-121328 and 59-218439 and JP-A-63-318555 (EP No. 0295729); block groups utilizing a cleavage reaction of 5- or 6-membered ring as described in, for example, JP-A-57-76541 (U.S. Pat. No. 4,335,200), JP-A-57-135949 (U.S. Pat. No. 4,350,752), JP-A's 57-179842, 59-137945, 59-140445, 59-219741 and 59-202459, JP-A-60-41034 (U.S. Pat. No. 4,618,563), JP-A-62-59945 (U.S. Pat. No. 4,888,268), JP-A-62-65039 (U.S. Pat. No. 4,772,537), and JP-A's 62-80647, 3-236047 and 3-238445; block groups utilizing a reaction of addition of nucleophilic agent to conjugated unsaturated bond as described in, for example, JP-A's 59-201057 (U.S. Pat. No. 4,518,685), 61-43739 (U.S. Pat. No. 4,659,651), 61-95346 (U.S. Pat. No. 4,690,885), 61-95347 (U.S. Pat. No. 4,892,811), 64-7035, 4-42650 (U.S. Pat. No. 5,066,573), 1-245255, 2-207249, 2-235055 (U.S. Pat. No. 5,118,596) and 4-186344; block groups utilizing a β-leaving reaction as described in, for example, JP-A's 59-93442, 61-32839 and 62-163051 and JP-B-5-37299; block groups utilizing a nucleophilic substitution reaction of diarylmethane as described in JP-A-61-188540; block groups utilizing Lossen rearrangement reaction as described in JP-A-62-187850; block groups utilizing a reaction between an N-acyl derivative of thiazolidine-2-thione and an amine as described in, for example, JP-A's 62-80646, 62-144163 and 62-147457; block groups having two electrophilic groups and capable of reacting with a binucleophilic agent as described in, for example, JP-A's 2-296240 (U.S. Pat. No. 5,019,492), 4-177243, 4-177244, 4-177245, 4-177246, 4-177247, 4-177248, 4-177249, 4-179948, 4-184337 and 4-184338, PCT International Publication No. 92/21064, JP-A-4-330438, PCT International Publication No. 93/03419 and JP-A-5-45816; and block groups of JP-A's 3-236047 and 3-238445, all the contents of which disclosing the block groups are incorporated herein by reference. Of these block groups, block groups having two electrophilic groups and capable of reacting with a binucleophilic agent as described in, for example, JP-A's 2-296240 (U.S. Pat. No. 5,019,492), 4-177243, 4-177244, 4-177245, 4-177246, 4-177247, 4-177248, 4-177249, 4-179948, 4-184337 and 4-184338, PCT International Publication No. 92/21064, JP-A-4-330438, PCT International Publication No. 93/03419 and JP-A-5-45816 are especially preferred.

Particular examples of the timing group moieties, corresponding to the group of formula (T-1) from which BLK is removed, include the following. In the following, * represents a position for bonding with BLK, and ** represents a position for bonding with —O—CO—.

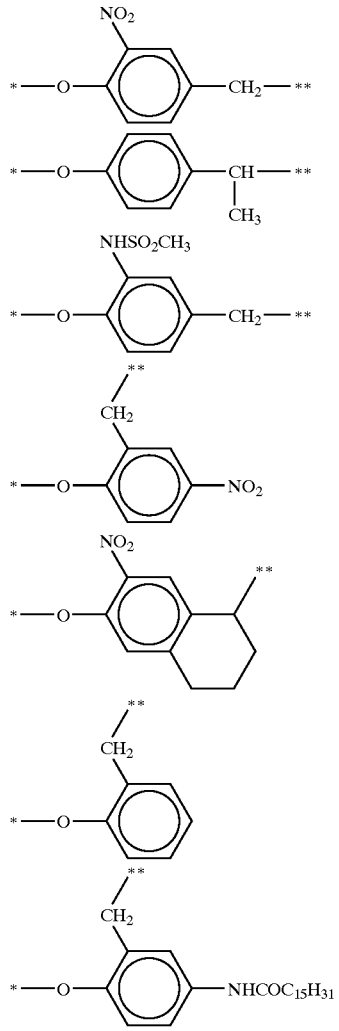

-continued

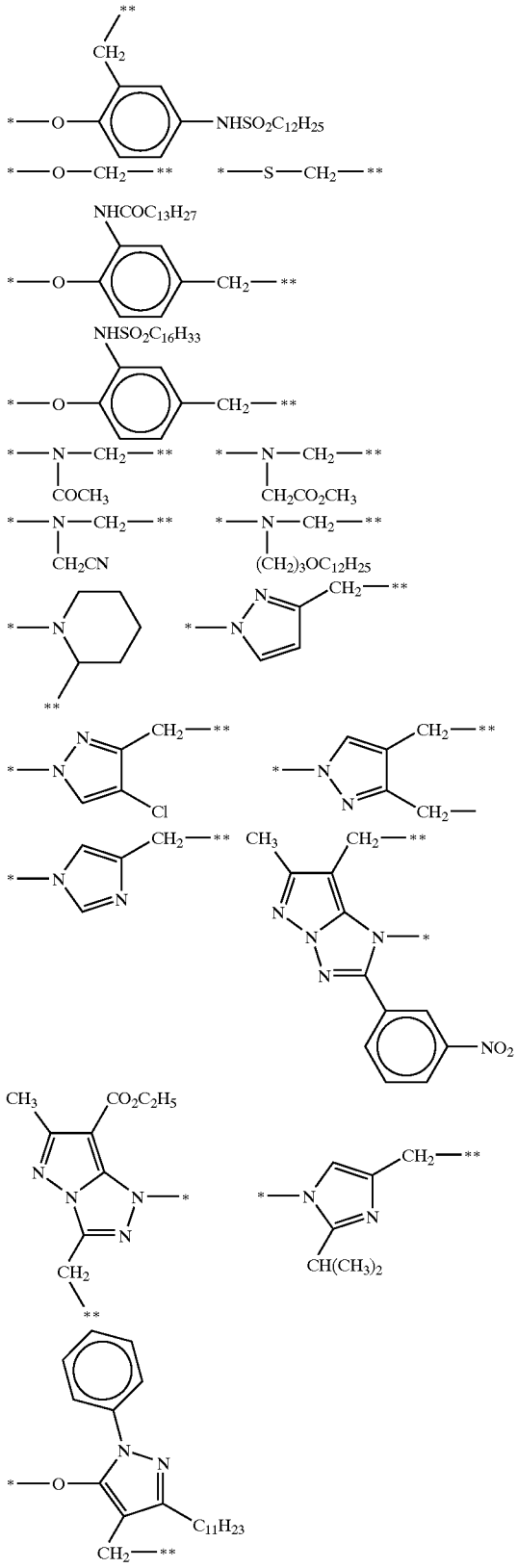

It is preferred that each of $R_{12}$ and $R_{13}$ be an alkyl or aryl group, and that $R_{14}$ be an aryl group. $R_{15}$ is preferably a block group, which is preferably the same as the preferred BLK contained in the group of the formula. (T-1). Each of $R_{16}$, $R_{17}$ and $R_{18}$ preferably represents a hydrogen atom.

Particular examples of the compounds represented by the general formula (6) of the present invention will be set forth below, to which, however, the present invention is in no way limited.

DEVP-1

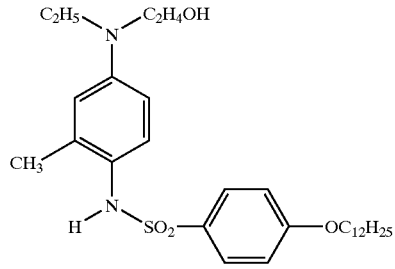

DEVP-2

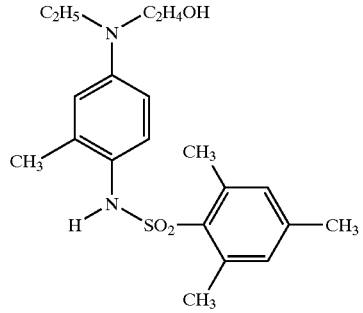

DEVP-3

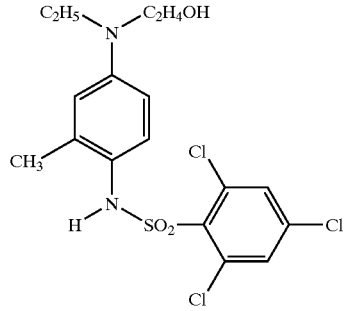

DEVP-4

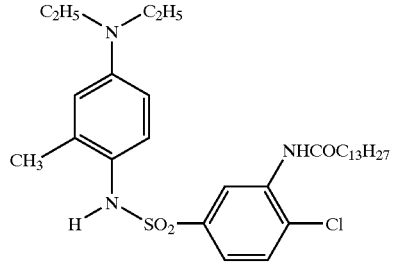

DEVP-5

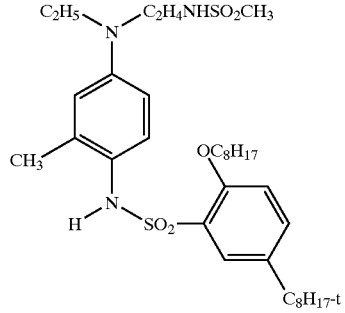

-continued
DEVP-6
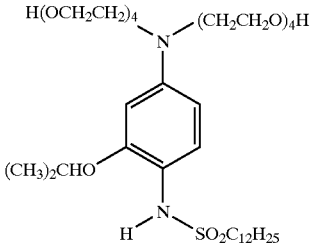
DEVP-7
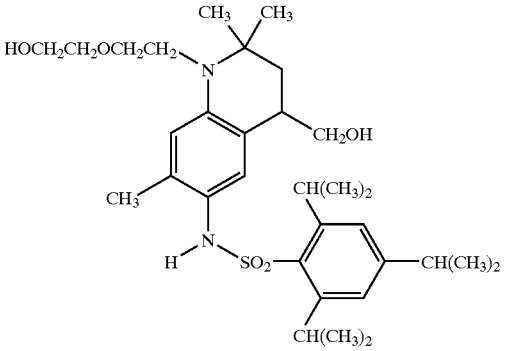
DEVP-8
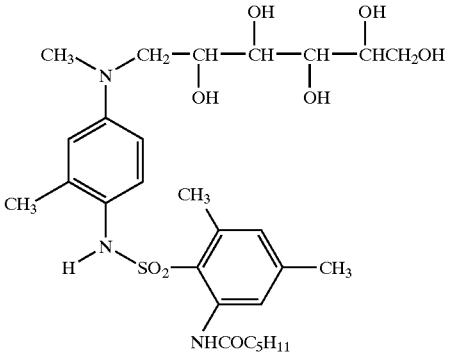
DEVP-9
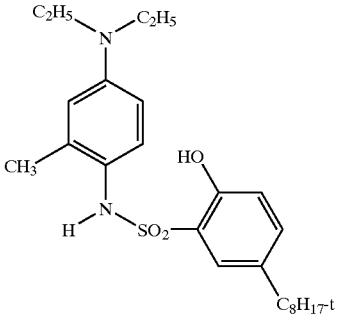
DEVP-10
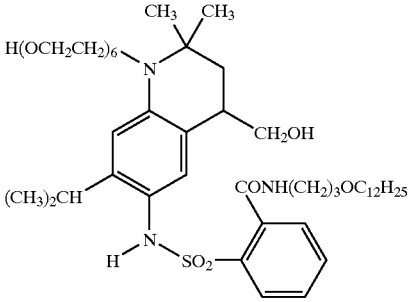
-continued
DEVP-11
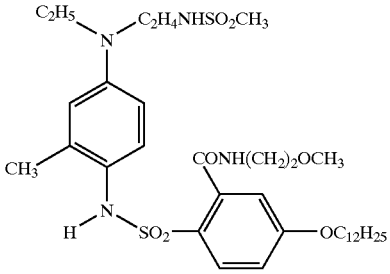
DEVP-12
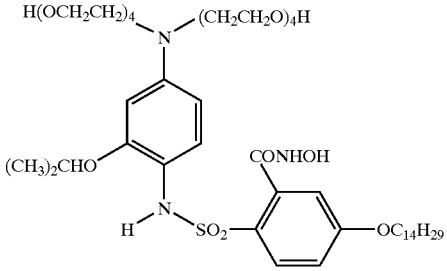
DEVP-13
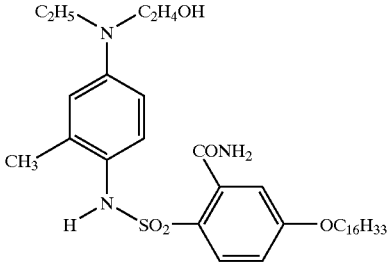
DEVP-14
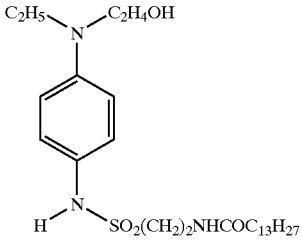
DEVP-15
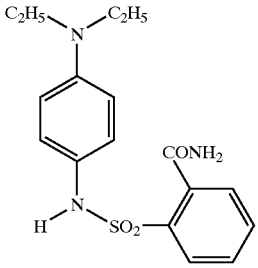
DEVP-16
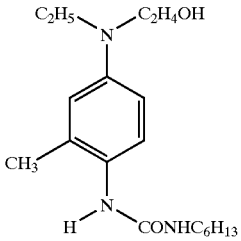

-continued
DEVP-17
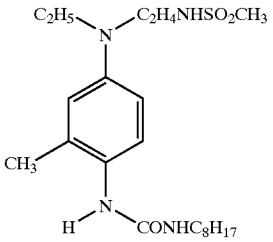
EVP-18
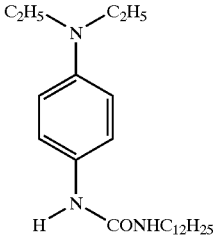
DEVP-19
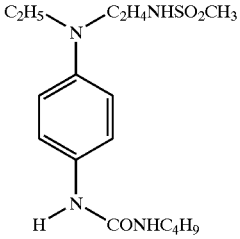
EVP-20
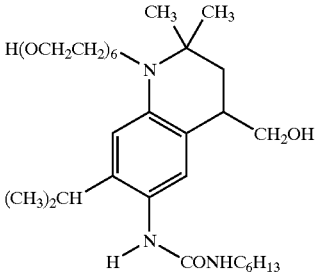
DEVP-21
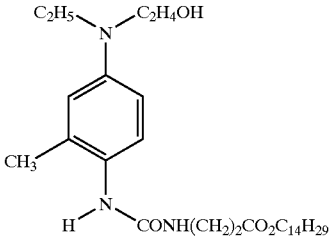
EVP-22
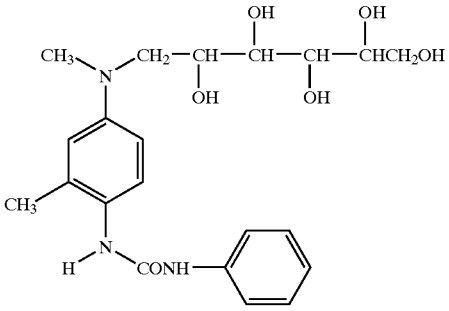
-continued
DEVP-23
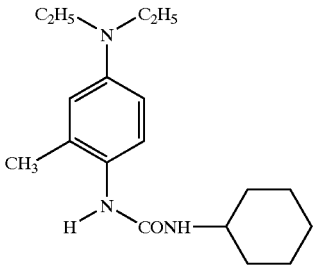
DEVP-24
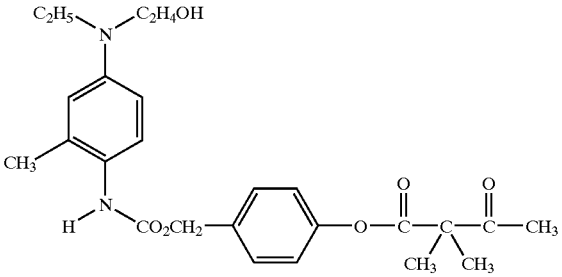
EVP-25
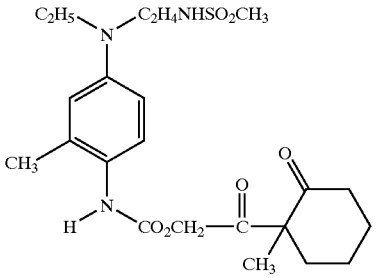
DEVP-26
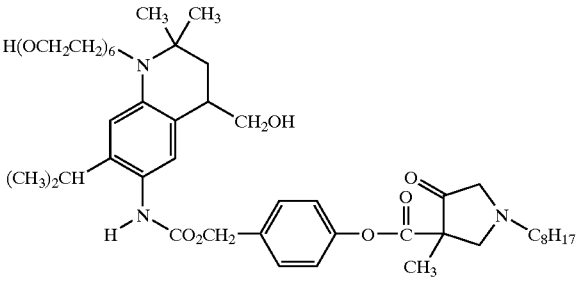
DEVP-27
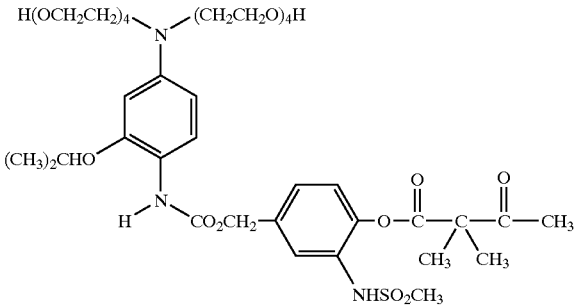

-continued
DEVP-28
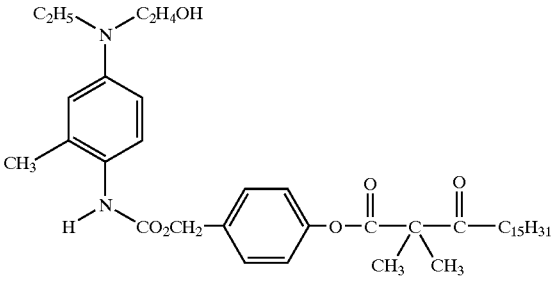
DEVP-29
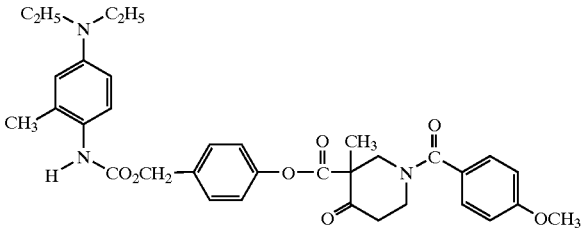
DEVP-30
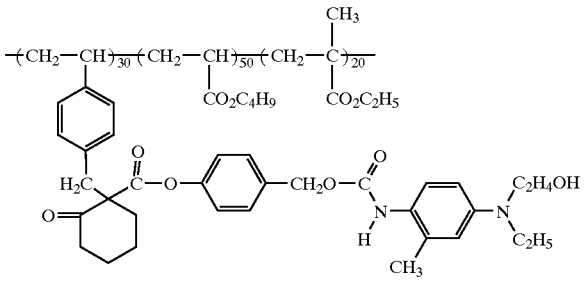
DEVP-31
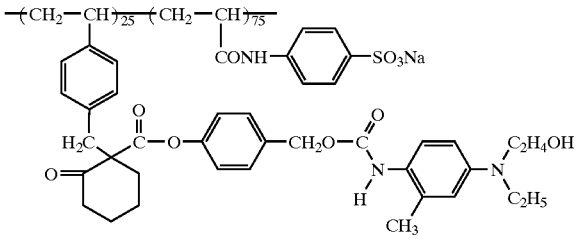
DEVP-32
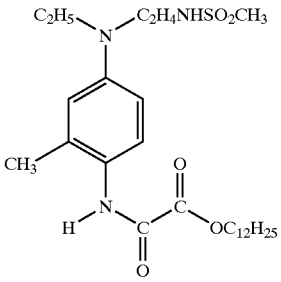
-continued
DEVP-33
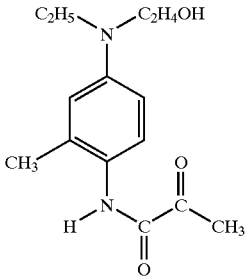
EVP-34
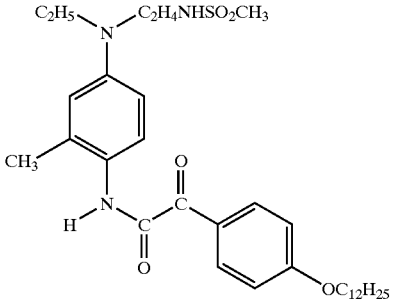
DEVP-35
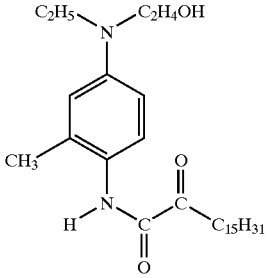
EVP-36
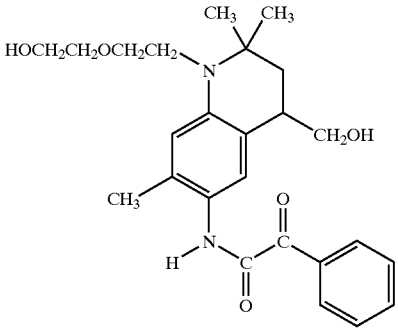
DEVP-37
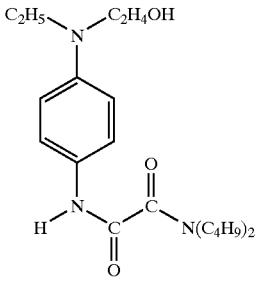

-continued
EVP-38
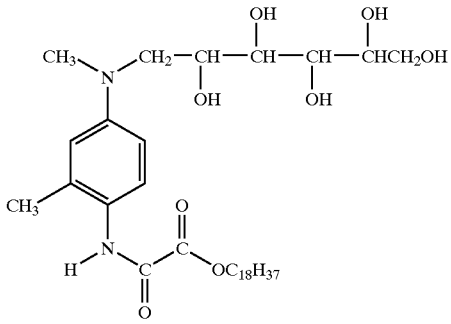
DEVP-39
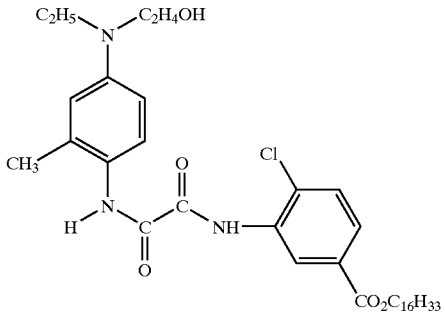
DEVP-40
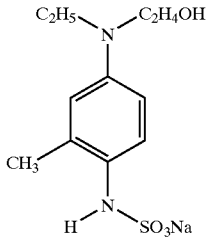
DEVP-41
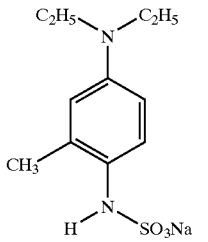
EVP-42
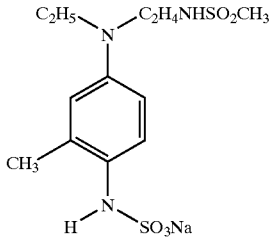
-continued
DEVP43
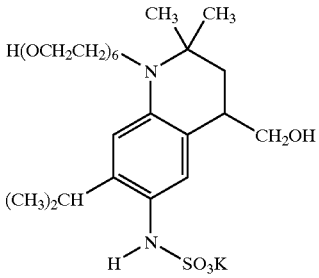
EVP-44
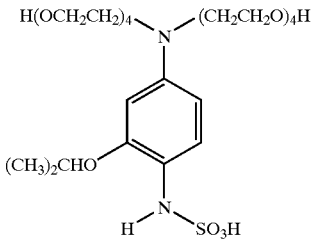
DEVP-45
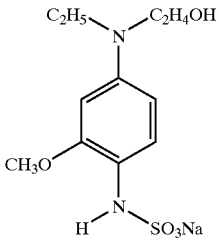
EVP-46
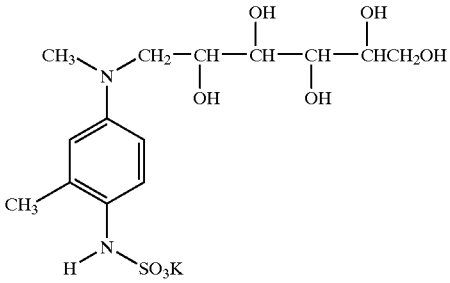
DEVP-47
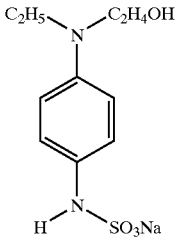
Compounds of U.S. Pat. Nos. 5,242,783 and 4,426,441 and JP-A's 62-227141, 5-257225, 5-249602, 6-43607 and 7-333780, the disclosures of which are incorporated herein by reference, are also preferably employed as the compound of the general formula (6) for use in the present invention.

Any of the compounds of the general formulae (1), although the addition amount thereof can be varied widely, is preferably used in a molar amount of 0.01 to 100 times, more preferably 0.1 to 10 times, the amount of a coupler that is used in combination with this compound.

Of the compounds represented by formulae (1) to (6), compounds represented by formulae (1), (4) and (6) are preferable.

The compounds of the general formulae (1) to (6) can be added to a coating liquid in the form of any of, for example, a solution, powder, a solid fine grain dispersion, an emulsion and an oil protection dispersion. The solid particulate dispersion is obtained by the use of known atomizing means (for example, ball mill, vibration ball mill, sand mill, colloid mill, jet mill or roll mill). In the preparation of the solid particulate dispersion, use may be made of a dispersion auxiliary.

The above compounds are used individually or in combination as the color developing agent or precursor thereof. A different developing agent and/or its precursor may be used in each layer. The total use amount of developing agent is in the range of 0.05 to 20 mmol/$m^2$, preferably 0.1 to 10 mmol/$m^2$.

Various dye-forming couplers may be used in the light-sensitive material of the invention.

The couplers preferably used in the present invention are compounds generally termed "active methylenes, 5-pyrazolones, pyrazoloazoles, phenols, naphthols or pyrrolotriazoles". Compounds cited in RD No. 38957 (September 1996), pages 616 to 624, "x. Dye image formers and modifiers", can preferably be used as the above couplers.

The above couplers can be classified into so-termed 2-equivalent couplers and 4-equivalent couplers.

As the group which acts as an anionic split-off group of 2-equivalent couplers, there can be mentioned, for example, a halogen atom (e.g., chlorine or bromine), an alkoxy group (e.g., methoxy or ethoxy), an aryloxy group (e.g., phenoxy, 4-cyanophenoxy or 4-alkoxycarbonylphenyloxy), an alkylthio group (e.g., methylthio, ethylthio or butylthio), an arylthio group (e.g., phenylthio or tolylthio), an alkylcarbamoyl group (e.g., methylcarbamoyl, dimethylcarbamoyl, ethylcarbamoyl, diethylcarbamoyl, dibutylcarbamoyl), a heterocyclicarbamoyl (e.g., piperidylcarbamoyl or morpholinocarbamoyl), an arylcarbamoyl group (e.g., phenylcarbamoyl, methylphenylcarbamoyl, ethylphenylcarbamoyl or benzylphenylcarbamoyl), a carbamoyl group, an alkylsulfamoyl group (e.g., methylsulfamoyl, dimethylsulfamoyl, ethylsulfamoyl, diethylsulfamoyl, dibutylsulfamoyl, piperidylsulfamoyl or morpholinosulfamoyl), an arylsulfamoyl group (e.g., phenylsulfamoyl, methylphenylsulfamoyl, ethylphenylsulfamoyl or benzylphenylsulfamoyl), a sulfamoyl group, a cyano group, an alkylsulfonyl group (e.g., methanesulfonyl or ethanesulfonyl), an arylsulfonyl group (e.g., phenylsulfonyl, 4-chlorophenylsulfonyl or p-toluenesulfonyl), an alkylcarbonyloxy group (e.g., acetyloxy, propionyloxy or butyroyloxy), an arylcarbonyloxy group (e.g., benzoyloxy, toluyloxy or anisyloxy), and a nitrogen-containing heterocycle (e.g., imidazolyl or benzotriazolyl).

As the group which acts as a cationic split-off group of 4-equivalent couplers, there can be mentioned, for example, a hydrogen atom, a formyl group, a carbamoyl group, a substituted methylene group (the substituent is, for example, an aryl group, a sulfamoyl group, a carbamoyl group, an alkoxy group, an amino group or a hydroxyl group), an acyl group, and a sulfonyl group.

Besides the above compounds described in RD No. 38957, the following couplers can also preferably be employed.

As active methylene couplers, there can be employed couplers represented by the formulae (I) and (II) of EP No. 502,424A; couplers represented by the formulae (1) and (2) of EP No. 513,496A; couplers represented by the formula (I) of claim 1 of EP No. 568,037A; couplers represented by the general formula (I) of column 1, lines 45–b 55, of U.S. Pat. No. 5,066,576; couplers represented by the general formula (I) of paragraph 0008 of JP-A-4-274425; couplers recited in claim 1 of page 40 of EP No. 498,381A1; couplers represented by the formula (Y) of page 4 of EP No. 447,969A1; and couplers represented by the formulae (II) to (IV) of column 7, lines 36–58, of U.S. Pat. No. 4,476,219.

As 5-pyrazolone magenta couplers, there can preferably be employed compounds described in JP-A's 57-35858 and 51-20826.

As pyrazoloazole couplers, there can preferably be employed imidazo[1,2-b]pyrazoles described in U.S. Pat. No. 4,500,630; pyrazolo[1,5-b][1,2,4]triazoles described in U.S. Pat. No. 4,540,654; and pyrazolo[5,1-c][1,2,4]triazoles described in U.S. Pat. No. 3,725,067. Of these, pyrazolo[1,5-b][1,2,4]triazoles are most preferred from the viewpoint of light fastness.

Also, there can preferably be employed pyrazoloazole couplers comprising a pyrazolotriazole group having a branched alkyl group directly bonded to 2-, 3- or 6-position thereof as described in JP-A-61-65245; pyrazoloazole couplers having a sulfonamido group in molecules thereof as described in JP-A-61-65245; pyrazoloazole couplers having an alkoxyphenylsulfonamido balast group as described in JP-A-61-147254; pyrazolotriazole couplers having an alkoxy or aryloxy group at 6-position thereof as described in JP-A's 62-209457 and 63-307453; and pyrazolotriazole couplers having a carbonamido group in molecules thereof as described in JP-A-2-201443.

As preferred examples of phenol couplers, there can be mentioned, for example, 2-alkylamino-5-alkylphenol couplers described in U.S. Pat. Nos. 2,369,929, 2,801,171, 2,772,162, 2,895,826 and 3,772,002; 2,5-diacylaminophenol couplers described in U.S. Pat. Nos. 2,772,162, 3,758,308, 4,126,396, 4,334,011 and 4,327,173, DE No. 3,329,729 and JP-A-59-166956; and 2-phenylureido-5-acylaminophenol couplers described in U.S. Pat. Nos. 3,446,622, 4,333,999, 4,451,559 and 4,427,767.

As preferred examples of naphthol couplers, there can be mentioned, for example, 2-carbamoyl-1-naphthol couplers described in U.S. Pat. Nos. 2,474,293, 4,052,212, 4,146,396, 4,228,233 and 4,296,200; and 2-carbamoyl-5-amido-1-naphthol couplers described in U.S. Pat. No. 4,690,889.

As preferred examples of pyrrolotriazole couplers, there can be mentioned those described in EP Nos. 488,248A1, 491,197A1 and 545,300.

Moreover, use can be made of couplers with the condensed ring phenol, imidazole, pyrrole, 3-hydroxypyridine, active methine, 5,5-condensed heterocycle and 5,6-condensed heterocycle structures.

As condensed ring phenol couplers, there can be employed those described in, for example, U.S. Pat. Nos. 4,327,173, 4,564,586 and 4,904,575.

As imidazole couplers, there can be employed those described in, for example, U.S. Pat. Nos. 4,818,672 and 5,051,347.

As pyrrole couplers, there can be employed those described in, for example, JP-A's 4-188137 and 4-190347.

As 3-hydroxypyridine couplers, there can be employed those described in, for example, JP-A-1-315736.

As active methine couplers, there can be employed those described in, for example, U.S. Pat. Nos. 5,104,783 and 5,162,196.

As 5,5-condensed heterocycle couplers, there can be employed, for example, pyrrolopyrazole couplers described in U.S. Pat. No. 5,164,289 and pyrroloimidazole couplers described in JP-A-4-174429.

As 5,6-condensed heterocycle couplers, there can be employed, for example, pyrazolopyrimidine couplers described in U.S. Pat. No. 4,950,585, pyrrolotriazine couplers described in JP-A-4-204730 and couplers described in EP No. 556,700.

In the present invention, besides the above couplers, use can also be made of couplers described in, for example, DE Nos. 3,819,051A and 3,823,049, U.S. Pat. Nos. 4,840,883, 5,024,930, 5,051,347 and 4,481,268, EP Nos. 304,856A2, 329,036, 354,549A2, 374,781A2, 379,110A2 and 386, 930A1, JP-A's 63-141055, 64-32260, 64-32261, 2-297547, 2-44340, 2-110555, 3-7938, 3-160440, 3-172839, 4-172447, 4-179949, 4-182645, 4-184437, 4-188138, 4-188139, 4-194847, 4-204532, 4-204731 and 4-204732.

These couplers are used in an amount of 0.05 to 10 mmol/$m^2$, preferably 0.1 to 5 mmol/$m^2$, for each color.

Furthermore, the following functional couplers may be contained.

As couplers for forming a colored dye with appropriate diffusibility, there can preferably be employed those described in U.S. Pat. No. 4,366,237, GB No. 2,125,570, EP No. 96,873B and DE No. 3,234,533.

As couplers for correcting any unneeded absorption of a colored dye, there can be mentioned yellow colored cyan couplers of formula (CI), (CII), (CIII), and (CIV) (especially YC-86 on page 84) described in EP No. 456,257A1; yellow colored magenta couplers ExM-7 (page 202) and Ex-1 (page 249), described in the same EP; magenta colored cyan couplers CC-9 (column 8) and CC-13 (column 10) described in U.S. Pat. No. 4,833,069; colorless masking couplers represented by the formula (2) (column 8) of U.S. Pat. No. 4,837,136 and represented by the formula (A) of claim 1 of WO 92/11575 (especially, compound examples of pages 36 to 45).

As compounds (including couplers) capable of reacting with a developing agent in an oxidized form to thereby release photographically useful compound residues, there can be mentioned the following:

Development inhibitor-releasing compounds: compounds represented by the formulae (I) to (IV) of page 11 (especially, T-101 (page 30), T-104 (page 31), T-113 (page 36), T-131 (page 45), T-144 (page 51) and T-158 (page 58)) of EP No. 378,236A1, compounds represented by the formula (I) of page 7 (especially, D-49 (page 51)) of EP No. 436,938A2, compounds represented by the formula (I) (especially, (23) (page 11)) of EP No. 568,037A, and compounds represented by the formulae (I), (II) and (III) of pages 5–6 (especially I-(1) on page 29) of EP No. 440, 195A2;

Bleaching accelerator-releasing compounds: compounds represented by the formulae (I) and (I') of page 5 (especially (60) and (61) on page 61) of EP No. 310,125A2 and compounds represented by the formula (I) of claim 1 (especially, (7) (page 7) of JP-A-6-59411;

Ligand-releasing compounds: compounds represented by LIG-X described in claim 1 (especially compounds in lines 21 to 41 of column 12) of U.S. Pat. No. 4,555,478;

Leuco dye-releasing compounds: compounds 1 to 6 of columns 3 to 8 of U.S. Pat. No. 4,749,641;

Fluorescent dye-releasing compounds: compounds represented by COUP-DYE of claim 1 (especially compounds 1 to 11 in columns 7 to 10) of U.S. Pat. No. 4,774,181;

Development accelerator or fogging agent-releasing compounds: compounds represented by the formulae (1), (2) and (3) of column 3 (especially, (I-22) in column 25) of U.S. Pat. No. 4,656,123 and ExZK-2 of page 75, lines 36 to 38, of EP No. 450,637A2; and Compounds which release a group becoming a dye only after its splitting off: compounds represented by the formula (I) of claim 1 (especially Y-1 to Y-19 in columns 25 to 36) of U.S. Pat. No. 4,857,447.

The following compounds are preferable as additives other than the couplers.

Dispersing medium for oil-soluble organic compounds: P-3, 5, 16, 19, 25, 30, 42, 49, 54, 55, 66, 81, 85, 86, and 93 (pages 140 to 144) of JP-A-62-215273;

Latex for impregnating oil-soluble organic compounds: latex described in U.S. Pat. No. 4,199,363;

Scavengers of an developing agent in an oxidized form: compounds represented by formula (I) in lines 54 to 62 of column 2 (especially, I-(1), (2) (6) and (12) (columns 4 to 5) of U.S. Pat. No. 4,978,606, the formula in lines 5 to 10 of column 2 (especially, compound 1 (column 3)) of U.S. Pat. No. 4,923,787;

Stain-preventing agents: formulas (I) to (III) in lines 30 to 33 on page 4, especially I-47, 72, III-1 and 27 (pages 24 to 48) of EP 298,321A;

Color-fading-preventing agents: A-6, 7, 20, 21, 23, 24, 25, 26, 30, 37, 40, 42, 48, 63, 90, 92, 94, and 164 (pages 69 to 118) of EP 298,321A, II-I to III-23, especially III-10, of columns 25 to 38 of U.S. Pat. No. 5,122,444, I-1 to III-4, especially II-2, on pages 8 to 12 of EP 471,347A, and A-1 to 48, especially A-39 and 42, in columns 32 to 40 of U.S. Pat. No. 5,139,931;

Substances that reduce use amount of a color-increasing agent or color-mixing-preventing agent: I-1 to II-15, especially I-46, on pages 5 to 24 of EP 41,132A;

Formalin scavengers: SCV-1 to 28, especially SCV-8, on pages 24 to 29 of EP 477,932A;

Film hardeners: H-1,4, 6, 8 and 14 on page 17 of JP-A-1-214845, Compounds (H-1 to 54) represented by formulas (VII) to (XII) in columns 13 to 23 of U.S. Pat. No. 4,618,573, Compounds (H-1 to 76), especially H-14, represented by formula (6) lower right on page 8 of JP-A-2-214852, compounds described in claim 1 of U.S. Pat. No. 3,325,287;

Development-inhibiting agent precursors: P-24, 37, and 39 (pages 6 to 7) of JP-A-62-168139, Compounds described in claim 1, especially compounds 28 and 29 in column 7 of U.S. Pat. No. 5,019,492;

Antiseptic and mildewproofing agents: I-1 to III-43, especially II-1, 9, 10, 18 and III-25, in columns 3 to 15 of U.S. Pat. No. 4,923,790;

Stabilizers and fogging-preventing agents: I-1 to (14), especially I-1, 60 (2) and (13), in columns 6 to 16 of U.S. Pat. No. 4,923,793, compounds 1 to 65, especially 36, in columns 25 to 32 of U.S. Pat. No. 4,952, 483;

Chemical sensitizers: triphenylphosphine selenide, compounds 50 of JP-A-5-40324;

Dyes: a-1 to b-20, especially a-1, 12, 18, 27, 35 and 36, and b-5, on pages 15 to 18, and V-1 to 23, especially V-1, on pages 27 to 29 of JP-A-3-156450, F-I-1 to F-II-43, especially F-I-11 and F-II-8, on pages 33 to 55 of EP 445,627A, III-1 to 36, especially III-1 and 3, on pages 17 to 28 of EP 457,153A, fine grain dispersions of Dye-1 to 124 on pages 8 to 26 of International Patent No. 88/04794, compounds 1 to 22, especially compound 1 on pages 6 to 11 of EP 319,999A, Compounds D-1 to 87 (pages 3 to 28) represented by formulas (1) to (3) of EP 519,306A, compounds 1 to 22 (column 3 to 10) represented by formula (I) of U.S. Pat. No. 4,268,622, compounds (1) to (31) (columns 2 to 9) represented by formula (I) of U.S. Pat. No. 4,923,788;

UV absorbents: compounds 101 to 427 (pages 6 to 9) and compounds (18b) to (18r) represented by formula (1) of JP-A-46-3335, compounds (3) to (66) (pages 10 to 44) represented by formula (I) and compounds HBT-1 to 10 (page 14) represented by formula (III) of EP 520,938A and compounds (1) to (31) represented by formula (I) (columns 2 to 9) of EP 521,823A.

These functional couplers and additives are preferably used in a molar amount of 0.05 to 10 times, more preferably 0.1 to 5 times, that of the aforementioned couplers which contribute to coloring.

Hydrophobic additives such as couplers and color developing agents can be introduced in layers of lightsensitive materials by known methods such as the method described in U.S. Pat. No. 2,322,027. In the introduction, use can be made of high-boiling organic solvents described in, for example, U.S. Pat. Nos. 4,555,470, 4,536,466, 4,536,467, 4,587,206, 4,555,476 and 4,599,296 and JP-B-3-62256, optionally in combination with low-boiling organic solvents having a boiling point of 50 to 160° C. With respect to dye donating couplers, high-boiling organic solvents, etc., a plurality thereof can be used in combination.

The amount of high-boiling organic solvents is 10 g or less, preferably 5g or less, and more preferably in the range of 1 to 0.1 g, per g of the hydrophobic additive to be used. The amount of high-boiling organic solvents is appropriately 1 milliliter (hereinafter also referred to as "mL") or less, more appropriately 0.5 mL or less, and most appropriately 0.3 mL or less, per g of binder.

Also, use can be made of the method of effecting a dispersion by polymer as described in JP-B-51-39853 and JP-A-51-59943, and the method of adding in the form of a fine grain dispersion as described in, for example, JP-A-62-30242.

With respect to compounds which are substantially insoluble in water, besides the above methods, the compounds can be atomized and dispersed in binders.

When hydrophobic compounds are dispersed in hydrophilic colloids, various surfactants can be employed. For example, use can be made of those described as surfactants in JP-A-59-157636, pages 37 and 38, and the above cited RDs. Further, use can be made of phosphoric ester surfactants described in JP-A's 7-56267 and 7-228589 and DE No. 1,932,299A.

For the lightsensitive material of the present invention, various antifoggants or photographic stabilizers may be used. Examples thereof include azoles and azaindenes described in RD No. 17643, pp. 24 to 25 (1978), nitrogen-containing carboxylic acids and phosphoric acids described in JP-A-59-168442, mercapto compounds and metal salts thereof described in JP-A-59-111636, and acetylene compounds described in JP-A-62-87957.

When a non-diffusible reducing agent or a color-developing agent is used, an electron-transferring agent and/or an electron-transferring agent precursor may be used in combination, if desired, so as to accelerate the movement of electrons between the non-diffusible reducing agent or color developing agent and the developable silver halide. The electron-transferring agent or the precursor thereof preferably has mobility greater than that of the non-diffusible reducing agent (electron-donor). Particularly useful electron-transferring agents are 1-phenyl-3-pyrazolidones or aminophenols.

In the lightsensitive material of the present invention, it is only required that at least one silver halide emulsion layer be formed on a support. A typical example is a silver halide photographic lightsensitive material having, on its support, at least one lightsensitive layer constituted by a plurality of silver halide emulsion layers which are sensitive to essentially the same color but have different speed. These lightsensitive layers include a unit lightsensitive layer which is sensitive to one of blue light, green light and red light. In a multilayered silver halide color photographic lightsensitive material, these unit lightsensitive layers are generally arranged in the order of red-, green- and blue-sensitive layers from a support. However, according to the intended use, this arrangement order may be reversed, or lightsensitive layers sensitive to the same color can sandwich another lightsensitive layer sensitive to a different color. Various non-lightsensitive layers can be formed between the silver halide lightsensitive layers and as the uppermost layer and the lowermost layer. These intermediate layers may contain, e.g., couplers described above, developing agents, DIR compounds, color-mixing inhibitors and dyes. As for a plurality of silver halide emulsion layers constituting respective unit lightsensitive layer, a two-layered structure of high- and low-speed emulsion layers can be preferably used in this order so as to the speed becomes lower toward the support as described in DE (German Patent) 1,121,470 or GB 923,045. Further, a non-lightsensitive layer may be provided between respective halide emulsion layers. Also, as described in JP-A's-57-112751, 62-200350, 62-206541 and 62-206543, layers can be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932 layers can be arranged from the farthest side from a support in the order of blue-sensitive layer/GH/RH/GL/RL. Furthermore, as described in JP-A's-56-25738 and 62-63936 layers can be arranged from the farthest side from a support in the order of blue-sensitive layer/GL/RL/GH/RH.

As described in JP-B-49-15495 three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different speeds, these layers can be arranged in the order of medium-speed emulsion layer/high-speed emulsion layer/low-speed emulsion layer from the farthest side from a support in a layer sensitive to one color as described in JP-A-59-202464. In addition, the order of high-speed emulsion layer/low-speed emulsion layer/medium-speed emulsion layer or low-speed emulsion layer/medium-speed emulsion layer/high-speed emulsion layer can be adopted. Furthermore, the arrangement can be changed as described above even when four or more layers are formed.

In order to improve color reproduction, an inter layer effect-donating layer (CL), whose spectral sensitivity distribution is different from those of the main lightsensitive layers of BL, GL and RL, can be arranged adjacent to the main lightsensitive layer or near the main lightsensitive layer, as described in U.S. Pat. Nos. 4,663,271, 4,705,744 and 4,707,436, and JP-A's-62-160448 and 63-89850.

Various layer structures and arrangements may be selected depending on the purpose of each lightsensitive material, as mentioned above.

In the present invention, a silver halide emulsion and a color-forming coupler and a color developing agent may be contained in the same layer, but may be separately added in different layers if there are in a reaction-capable condition. For example, when a layer containing a developing agent and a layer containing a silver halide emulsion are separately arranged, raw storability of a material can be accomplished.

Although the relationship between spectral sensitivity and coupler hue of each layer is arbitrary, the use of cyan coupler in a red-sensitive layer, magenta coupler in a green-sensitive layer and yellow coupler in a blue-sensitive layer enables direct projection exposure on conventional color paper or the like.

In the lightsensitive material, various non-lightsensitive layers such as a protective layer, a substratum, an interlayer, a yellow filter layer and an antihalation layer may be provided between aforementioned silver halide emulsion layers, or as an uppermost layer or a lowermost layer. The opposite side of the support can be furnished with various auxiliary layers such as a back layer.

For example, the lightsensitive material can be provided with a layer arrangement as described in the above patents; a substratum as described in U.S. Pat. No. 5,051,335; an interlayer containing a solid pigment as described in JP-A's 1-167838 and 61-20943; an interlayer containing a reducing agent and a DIR compound as described in JP-A's 1-120553, 5-34884 and 2-64634; an interlayer containing an electron-transfering agent as described in U.S. Pat. Nos. 5,017,454 and 5,139,919 and JP-A-2-235044; a protective layer containing a reducing agent as described in JP-A-4-249245; or a combination of these layers.

The dye which can be used in a yellow filter layer and an antihalation layer is preferably one decolorized or removed at the time of development and hence not contributing to density after processing.

The expression "dye of a yellow filter layer and an antihalation layer is decolorized or removed at the time of development" used herein means that the amount of dye remaining after processing is reduced to ⅓ or less, preferably 1/10 or less. Dye components may be transferred from the lightsensitive material to the processing material at the time of development. Alternatively, at the time of development, the dye may react so as to convert itself to a colorless compound.

Specifically, there can be mentioned dyes described in EP No. 549,489A and ExF2 to 6 dyes described in JP-A-7-152129. Also, use can be made of solid-dispersed dyes as described in JP-A-8-101487.

The dye can be mordanted in advance with the use of a mordant and a binder. As the mordant and dye, there can be employed those known in the art of photography. For example, use can be made of mordant described in U.S. Pat. No. 4,500,626 columns 58-59, JP-A-61-88256 pages 32–41, and JP-A's 62-244043 and 62-244036.

Further, use can be made of a compound capable of reacting with a reducing agent to thereby release a diffusive dye together with a reducing agent, so that a mobile dye can be released by an alkali at the time of development, transferred to the processing material and removed. Relevant descriptions are found in U.S. Pat. Nos. 4,559,290 and 4,783,396, EP No. 220,746A2, JIII Journal of Technical Disclosure No. 87-6119 and JP-A-8-101487 paragraph nos. 0080 to 0081.

A decolorizable leuco dye or the like can also be employed. For example, JP-A-1-150132 discloses a silver halide lightsensitive material containing a leuco dye which has been colored in advance by the use of a developer of a metal salt of organic acid. The complex of leuco dye and developer is decolorized by heating or reaction with an alkali agent.

Known leuco dyes can be used, which are described in, for example, Moriga and Yoshida, "Senryo to Yakuhin (Dyestuff and Chemical)" 9, page 84 (Kaseihin Kogyo Kyokai (Japan Dyestuff & Chemical Industry Association)); "Shinpan Senryo Binran (New Edition Dyestuff Manual)", page 242 (Maruzen Co., Ltd., 1970); R. Garner "Reports on the Progress of Appl. Chem." 56, page 199 (1971); "Senryo to Yakuhin (Dyestuff and Chemical)" 19, page 230 (Kaseihin Kogyo Kyokai (Japan Dyestuff & Chemical Industry Association), 1974); "Shikizai (Color Material)" 62, 288 (1989); and "Senshoku Kogyo (Dyeing Industry)" 32, 208.

As the developer, there can preferably be employed acid clay developers, phenol formaldehyde resin and metal salts of organic acid. Examples of suitable metal salts of organic acid include metal salts of salicylic acids, metal salts of phenol-salicylic acid-formaldehyde resins, and metal salts of rhodanate and xanthate. Zinc is especially preferably used as the metal. With respect to oil-soluble zinc salicylate among the above developers, use can be made of those described in, for example, U.S. Pat. Nos. 3,864,146 and 4,046,941 and JP-B-52-1327.

The coating layers of the lightsensitive material of the present invention are preferably hardened by film hardeners.

Examples of film hardeners include those described in, for example, U.S. Pat. Nos. 4,678,739 column 41 and 4,791,042, and JP-A's 59-116655, 62-245261, 61-18942 and 4-218044. More specifically, use can be made of aldehyde film hardeners (e.g., formaldehyde), aziridine film hardeners, epoxy film hardeners, vinylsulfone film hardeners (e.g., N,N'-ethylene-bis(vinylsulfonylacetamido)ethane), N-methylol film hardeners (e.g., dimethylolurea), and boric acid, metaboric acid or polymer film hardeners (compounds described in, for example, JP-A-62-234157).

These film hardeners are used in an amount of 0.001 to 1 g, preferably 0.005 to 0.5 g, per g of hydrophilic binder.

In the lightsensitive material, use can be made of various antifoggants, photographic stabilizers and precursors thereof. Examples thereof include compounds described in, for example, the aforementioned RDs, U.S. Pat. Nos. 5,089,378, 4,500,627 and 4,614,702, JP-A-64-13564 pages 7–9, 57–71 and 81–97, U.S. Pat. Nos. 4,775,610, 4,626,500 and 4,983,494, JP-A's 62-174747, 62-239148, 1-150135, 2-110557 and 2-178650, and RD No. 17643 (1978) pages 24–25.

These compounds are preferably used in an amount of $5\times10^{-6}$ to $1\times10^{-1}$ mol, more preferably $1\times10^{-5}$ to $1\times10^{-2}$ mol, per mol of silver.

In the lightsensitive material, various surfactants can be used for the purpose of coating aid, frilling amelioration, sliding improvement, static electricity prevention, development acceleration, etc. Examples of surfactants are described in, for example, Public Technology No. 5 (Mar. 22, 1991, issued by Aztek) pages 136–138 and JP-A's 62-173463 and 62-183457.

An organic fluorocompound may be incorporated in the lightsensitive material for the purpose of sliding prevention, static electricity prevention, frilling amelioration, etc. As representative examples of organic fluorocompounds, there can be mentioned fluorinated surfactants described in, for example, JP-B-57-9053 columns 8 to 17 and JP-A's 61-20944 and 62-135826, and hydrophobic fluorocompounds including an oily fluorocompound such as fluoroil and a solid fluorocompound resin such as ethylene tetrafluoride resin. Fluorinated surfactants having a hydrophilic group can also preferably be employed for the purpose of reconciling the wettability and static electricity prevention of lightsensitive material.

It is preferred that the lightsensitive material have sliding properties. A layer containing a sliding agent is preferably provided on both the lightsensitive layer side and the back side. Preferred sliding properties range from 0.25 to 0.01 in terms of kinematic friction coefficient. By the measurement, there can be obtained the value at 60 cm/min carriage on a stainless steel ball of 5 mm diameter (25° C., 60% RH). Even if the evaluation is made with the opposite material replaced by a lightsensitive layer surface, the value of substantially the same level can be obtained.

Examples of suitable sliding agents include polyorganosiloxanes, higher fatty acid amides, higher fatty acid metal salts and esters of higher fatty acids and higher alcohols. As the polyorganosiloxanes, there can be employed, for example, polydimethylsiloxane, polydiethylsiloxane, polystyrylmethylsiloxane and polymethylphenylsiloxane. The layer to be loaded with the sliding agent is preferably an outermost one of emulsion layers or a back layer. Polydimethylsiloxane and an ester having a long-chain alkyl group are especially preferred. For preventing silver halide pressure marks and desensitization, silicone oil and chlorinated paraffin are preferably used.

In the present invention, further, an antistatic agent is preferably used. As the antistatic agent, there can be mentioned a polymer containing a carboxylic acid and a carboxylic acid salt or sulfonic acid salt, a cationic polymer and an ionic surfactant compound.

Most preferable antistatic agent consists of fine particles of a crystalline metal oxide of $10^7$ Ω·cm or less, preferably $10^5$ Ω·cm or less, volume resistivity with a particle size of 0.001 to 1.0 μm, constituted of at least one member selected from among ZnO, $TiO_2$, $SnO_2$, $Al_2O_3$, $In_2O_3$, $SiO_2$, MgO, BaO, $MoO_3$ and $V_2O_5$, or a composite oxide thereof (e.g., Sb, P, B, In, S, Si or C), or fine particles of such a metal oxide or composite oxide thereof in sol form. The content of antistatic agent in the lightsensitive material is preferably in the range of 5 to 500 mg/$m^2$, more preferably 10 to 350 mg/$m^2$. The quantitative ratio of conductive crystalline oxide or composite oxide thereof to binder is preferably in the range of 1:300 to 100:1, more preferably 1:100 to 100:5. The back of the support of the lightsensitive material is preferably coated with a water resistant polymer described in JP-A-8-292514.

The lightsensitive material or later described processing material constitution (including back layer) can be loaded with various polymer latexes for the purpose of film property improvements, such as dimension stabilization, curling prevention, sticking prevention, film cracking prevention and pressure increase desensitization prevention. For example, use can be made of any of polymer latexes described in JP-A's 62-245258, 62-136648 and 62-110066. In particular, when a polymer latex of low glass transition temperature (40° C. or below) is used in a mordant layer, the cracking of the mordant layer can be prevented. Further, when a polymer latex of high glass transition temperature is used in a back layer, a curling preventive effect can be exerted.

In the present invention, as the support of the lightsensitive material, there can be employed a transparent one capable of resisting processing temperatures. Generally, use can be made of photographic supports of paper, synthetic polymers (films), etc. as described in pages 223 to 240 of "Shashinkogaku no Kiso—Gin-en Shashin Hen—(Fundamental of Photographic Technology—Silver Salt Photography—)" edited by The Society of Photographic Science and Technologh of Japan and published by CMC Co., Ltd. (1979). For example, use can be made of supports of polyethylene terephthalate, polyethylene naphthalate, polycarbonate, polyvinyl chloride, polystyrene, polypropylene, polyimide and cellulose (e.g., triacetylcellulose).

Also, use can be made of supports described in, for example, JP-A's 62-253159 pages 29 to 31, 1-161236 pages 14 to 17, 63-316848, 2-22651 and 3-56955 and U.S. Pat. No. 5,001,033. In order to improve optical properties and physical properties, these supports can be subjected to, for example, heat treatment (crystallization degree and orientation control), monoaxial or biaxial drawing (orientation control), blending of various polymers and surface treatment.

When requirements on heat resistance and curling properties are especially strict, supports described in JP-A's 6-41281, 6-43581, 6-51426, 6-51437, and 6-51442 can preferably be employed as the support of the lightsensitive material.

Moreover, a support of a styrene polymer of mainly syndiotactic structure can preferably be employed. The thickness of the supports is preferably in the range of 5 to 200 μm, more preferably 40 to 120 μm.

The polyester support preferably used in the present invention will be described below. Particulars thereof together with the below mentioned lightsensitive material, processing, cartridge and working examples are specified in JIII Journal of Technical Disclosure No. 94-6023 (issued by Japan Institute of Invention and Innovation on Mar. 15, 1994). The polyester for use in the present invention is prepared from a diol and an aromatic dicarboxylic acid as essential components. Examples of suitable aromatic dicarboxylic acids include 2,6-, 1,5-, 1,4- and 2,7-naphthalenedicarboxylic acids, terephthalic acid, isophthalic acid and phthalic acid, and examples of suitable diols include diethylene glycol, triethylene glycol, cyclohexanedimethanol, bisphenol A and other bisphenols. The resultant polymers include homopolymers such as polyethylene terephthalate, polyethylene naphthalate and polycyclohexanedimethanol terephthalate. Polyesters containing 2,6-naphthalenedicarboxylic acid in an amount of 50 to 100 mol. % are especially preferred. Polyethylene 2,6-naphthalate is most preferred. The average molecular weight thereof ranges from approximately 5,000 to 200,000. The Tg of the polyester for use in the present invention is at least 50° C., preferably at least 90° C.

The polyester support is subjected to heat treatment at a temperature of from 40° C. to less than Tg, preferably from Tg minus 20° C. to less than Tg, in order to suppress curling. This heat treatment may be conducted at a temperature held constant within the above temperature range or may be conducted while cooling. The period of heat treatment ranges from 0.1 to 1500 hr, preferably 0.5 to 200 hr. The support may be heat treated either in the form of a roll or while being carried in the form of a web. The surface form of the support may be improved by rendering the surface irregular (e.g., coating with conductive inorganic fine grains of $SnO_2$, $Sb_2O_5$, etc.). Moreover, a scheme is desired such that edges of the support are knurled so as to render only the edges slightly high, thereby preventing photographing of core sections. The above heat treatment may be carried out in any of stages after support film formation, after surface treatment, after back layer application (e.g., application of an antistatic agent or a lubricant) and after undercoating application. The heat treatment is preferably performed after antistatic agent application.

An ultraviolet absorber may be milled into the polyester. Light piping can be prevented by milling, into the polyester, dyes and pigments commercially available as polyester additives, such as Diaresin produced by Mitsubishi Chemical Industries, Ltd. and Kayaset produced by NIPPON KAYAKU CO., LTD.

Surface treatment is preferably performed for adhering the support and the lightsensitive material constituting layers to each other. Examples thereof include chemical, mechanical, corona discharge, flaming, ultraviolet irradiation, high-frequency, glow discharge, active plasma, laser, mixed acid, ozonization and other surface activating treatments. Of these surface treatments, ultraviolet irradiation, flaming, corona discharge and glow discharge treatments are preferred.

Now, the substratum will be described below: The substratum may be composed of a single layer or two or more layers. As the binder for the substratum, there can be mentioned not only copolymers prepared from monomers, as starting materials, selected from among vinyl chloride, vinylidene chloride, butadiene, methacrylic acid, acrylic acid, itaconic acid and maleic anhydride but also polyethyleneimine, an epoxy resin, a grafted gelatin, nitrocellulose, gelatin, polyvinyl alcohol and modified polymere of these polymers. Resorcin or p-chlorophenol is used as a support-swelling compound. A gelatin hardener such as a chromium salt (e.g., chrome alum), an aldehyde (e.g., formaldehyde or glutaraldehyde), an isocyanate, an active halogen compound (e.g., 2,4-dichloro-6-hydroxy-s-triazine), an epichlorohydrin resin or an active vinyl sulfone compound can be used in the substratum. Also, SiO2, $TiO_2$, inorganic fine grains or polymethyl methacrylate copolymer fine grains (0.01 to 10 μm) may be incorporated therein as a matting agent. Further, it is preferable to record photographed information and etc. using, as a support, the support having a magnetic recording layer as described in JP-A's 4-124645, 5-40321, 6-35092 and 6-317875.

The magnetic recording layer herein is the one obtained by coating a support with a water-base or organic solvent coating liquid having magnetic material grains dispersed in a binder.

The magnetic material grains for use in the present invention can be composed of any of ferromagnetic iron oxides such as $\gamma Fe_2O_3$, Co coated $\gamma$ $Fe_2O_3$, Co coated magnetite, Co containing magnetite, ferromagnetic chromium dioxide, ferromagnetic metals, ferromagnetic alloys, Ba ferrite of hexagonal system, Sr ferrite, Pb ferrite and Ca ferrite. Of these, Co coated ferromagnetic iron oxides such as Co coated $\gamma$ $Fe_2O_3$ are preferred. The configuration thereof may be any of acicular, rice grain, spherical, cubic and plate shapes. The specific surface area is preferably at least 20 $m^2/g$, more preferably at least 30 $m^2/g$ in terms of $S_{BET}$. The saturation magnetization ($\sigma s$) of the ferromagnetic material preferably ranges from $3.0\times10^4$ to $3.0\times10^5$ A/m, more preferably from $4.0\times10^4$ to $2.5\times10^5$ A/m. The ferromagnetic material grains may have their surface treated with silica and/or alumina or an organic material.

Further, the magnetic material grains may have their surface treated with a silane coupling agent or a titanium coupling agent as described in JP-A-6-161032. Still further, use can be made of magnetic material grains having their surface coated with an organic or inorganic material as described in JP-A's-4-259911 and 5-81652.

The binder for use in the magnetic material grains can be composed of any of natural polymers (e.g., cellulose derivatives and sugar derivatives), acid-, alkali- or bio-degradable polymers, reactive resins, radiation curable resins, thermosetting resins and thermoplastic resins listed in JP-A-4-219569 and mixtures thereof. The Tg of each of the above resins ranges from −40 to 300° C. and the weight average molecular weight thereof ranges from 2 thousand to 1 million.

For example, vinyl copolymers, cellulose derivatives such as cellulose diacetate, cellulose triacetate, cellulose acetate propionate, cellulose acetate butyrate and cellulose tripropionate, acrylic resins and polyvinylacetal resins can be mentioned as suitable binder resins. Gelatin is also a suitable binder resin. Of these, cellulose di(tri)acetate is especially preferred.

The binder can be cured by adding an epoxy, aziridine or isocyanate crosslinking agent. Suitable isocyanate crosslinking agents include, for example, isocyanates such as tolylene diisocyanate, 4,4'-diphenylmethane diisocyanate, hexamethylene diisocyanate and xylylene diisocyanate, reaction products of these isocyanates and polyhydric alcohols (e.g., reaction product of 3 mol of tolylene diisocyanate and 1 mol of trimethylolpropane), and polyisocyanates produced by condensation of these isocyanates, as described in, for example, JP-A-6-59357.

The method of dispersing the magnetic material in the above binder preferably comprises using a kneader, a pin type mill and an annular type mill either individually or in combination as described in JP-A-6-35092. Dispersants listed in JP-A-5-088283 and other common dispersants can be used. The thickness of the magnetic recording layer ranges from 0.1 to 10 μm, preferably 0.2 to 5 μm, and more preferably from 0.3 to 3 μm. The weight ratio of magnetic material grains to binder is preferably in the range of 0.5:100 to 60:100, more preferably 1:100 to 30:100. The coating amount of magnetic material grains ranges from 0.005 to 3 $g/m^2$, preferably from 0.01 to 2 $g/m^2$, and more preferably from 0.02 to 0.5 $g/m^2$. The transmission yellow density of the magnetic recording layer is preferably in the range of 0.01 to 0.50, more preferably 0.03 to 0.20, and most preferably 0.04 to 0.15.

The magnetic recording layer can be applied to the back of a photographic support in its entirety or in striped pattern by coating or printing. The magnetic recording layer can be applied by the use of, for example, an air doctor, a blade, an air knife, a squeeze, an immersion, reverse rolls, transfer rolls, a gravure, a kiss, a cast, a spray, a dip, a bar or an extrusion. Coating liquids set forth in JP-A-5-341436 are preferably used.

The magnetic recording layer may also be provided with, for example, lubricity enhancing, curl regulating, antistatic, sticking preventive and head polishing functions, or other functional layers may be disposed to impart these functions. An abrasive of grains whose at least one member is nonspherical inorganic grains having a Mohs hardness of at least 5 is preferred. The nonspherical inorganic grains are preferably composed of fine grains of any of oxides such as aluminum oxide, chromium oxide, silicon dioxide and titanium dioxide; carbides such as silicon carbide and titanium carbide; and diamond. These abrasives may have their surface treated with a silane coupling agent or a titanium coupling agent. The above grains may be added to the magnetic recording layer, or the magnetic recording layer may be overcoated with the grains (e.g., as a protective layer or a lubricant layer). The binder which is used in this instance can be the same as mentioned above and, preferably, the same as the that of the magnetic recording layer. The lightsensitive material having the magnetic recording layer is described in U.S. Pat. Nos. 5,336,589, 5,250,404, 5,229,259 and 5,215,874 and EP No. 466,130.

The film patrone employed in the present invention will be described below.

The main material composing the patrone for use in the present invention may be a metal or a synthetic plastic. Examples of preferable plastic materials include polystyrene, polyethylene, polypropylene and polyphenyl ether. The patrone for use in the present invention may contain various types of antistatic agents and can preferably contain, for example, carbon black, metal oxide grains, nonionic, anionic, cationic or betaine type surfactants and polymers. Such an antistatic patrone is described in JP-A's-1-312537 and 1-312538. The resistance thereof at 25° C. in 25% RH is preferably $10^{12}\Omega$ or less. The plastic patrone is generally molded from a plastic having carbon black or a pigment milled thereinto for imparting light shielding properties. The patrone size may be the same as the current size 135, or for miniaturization of cameras, it is advantageous to decrease the diameter of the 25 mm cartridge of the current size 135 to 22 mm or less. The volume of the case of the patrone is preferably 30 $cm^3$ or less, more preferably 25 $cm^3$ or less. The weight of the plastic used in each patrone or patrone case preferably ranges from 5 to 15 g.

In addition, a patrone capable of feeding a film out by rotating a spool may be used. Further, the patrone may be so structured that a film front edge is accommodated in the main frame of the patrone and that the film front edge is fed from a port part of the patrone to the outside by rotating a spool shaft in a film feeding out direction. These are disclosed in U.S. Pat. Nos. 4,834,306 and 5,226,613.

The above-described lightsensitive material of the present invention is also suitable for use in a lens-fitted film unit described in JP-B-2-32615 and Japanese Utility Model Application KOKAI Publication No. 3-39784.

The lens-fitted film unit refers to a unit made up of a package unit body provided with a photographing lens and shutter in advance and accommodates an unexposed lightsensitive material in the form of a sheet or a roll either directly or by loading it in a container, in which the unit is sealed in a light-tight manner and is further packaged in an exterior packaging material.

In addition, the package unit body may be provided with a finder and mechanisms for, e.g., forwarding frames, accommodating an exposed lightsensitive material and taking it out. Further, the finder may be provided with a parallax-correcting support, while the photographing mechanism may be provided with an auxiliary illuminating mechanism described in Japanese Utility Model Application KOKAI Publication No. 1-93723, 1-57738 and 1-57740, JP-A's-1-93723 and 1-152437.

Since the package unit body in the present invention accommodates the lightsensitive material, the humidity inside the package unit is preferably adjusted to a value of relative humidity ranging from 40 to 70%, preferably from 50 to 65%, at 25° C. As for an exterior packaging material, the use of a moisture impermeable material or a hygroscopic material is preferable, an example of which is a material whose water absorption is 0.1% or less in the test according to ASTM D-570. The use of a sheet laminated with aluminum foil or the use of aluminum foil is particularly preferred.

A container, which is provided within the package unit body and accommodates an exposed lightsensitive material, may be a container for a cartridge for an exterior package unit or a conventional cartridge. Examples of the container are described in, e.g., JP-A-'s-54-111822, 63-194255 U.S. Pat. Nos. 4,832,275 and 4,834,306.

The film sizes of the lightsensitive materials to be used include 110 size, 135 size, half size thereof and 126 size.

The plastic material for forming the package unit in the present invention can be produced by various methods such as an addition polymerization of an olefin having a carbon-carbon double bond, a ring-opening polymerization of a compound composed of a ring having a small number of constituent members, a polycondensation between two or more polyfunctional compounds, a polyaddition, and an addition-condensation between a derivative of phenol, urea or melamine and a compound having an aldehyde group.

The lightsensitive material of the present invention can be developed by conventional methods described in above-mentioned RD No. 17643, pp. 28 to 29; RD No. 18716, p. 651, left to right columns; and RD No. 307105, pp. 880 to 881. As development processing for color negative films for use in the present invention, Processing C-41 by Eastman Kodak Co. and Processing CN-16 by Fuji Photo Film Co., Ltd. can be mentioned.

With respect to the processing of color reversal films used in the present invention, detailed descriptions are made in Known Technology No. 6 (Apr. 1, 1991) issued by Aztek, page 1, line 5 to page 10, line 5 and page 15, line 8 to page 24, line 2, any of which can be preferably applied thereto. Preferable examples of a development processing containing the above-mentioned content include Processing E-6 by Eastman Kodak Co. and Processing CR-56 by Fuji Photo Film Co., Ltd.

It is also possible to form an image on the lightsensitive material of the present invention by heat development after exposure.

Heat treatment of a lightsensitive material is known in this technical field, and the heat-developable lightsensitive material and the process therefor are described, for example, in Shashin Kogaku no Kiso (Primary Study of Photographic Industry), pp. 553 to 555, Corona Sha (1970), Eizo Joho (Image Information), p. 40 (April 1978), Nabletts Handbook of Photography and Reprography, 7th ed., pp. 32 to 33, Vna Nostrand and Reinhold Company, U.S. Pat. Nos. 3,152,904, 3,301,678, 3,392,020 and 3,457,075, British Patents 1,131,108 and 1,167,777, and RD, No. 17029, pp. 9 to 15 (1978).

The heating temperature in the heat development process is from about 50 to 250° C., preferably from 60 to 180° C.

The heating method in the development process includes a method of contacting with a heated block or plate, a method of contacting with a hot plate, a hot presser, a heat roller, a heat drum, a halogen lamp heater, an infrared or far infrared lamp heater or the like, and a method of passing through a high temperature atmosphere. Although the contact heating may be conducted either from the side of the lightsensitive silver halide emulsion layer of the lightsensitive material or from the side of the back layer thereof, the contact heating from the side of the emulsion layer from the viewpoint of increase in development rate or enhancement of color forming property.

In processing of the lightsensitive material of the present invention, any types of heat development apparatus can be employed. For example, those disclosed in JP-A's-59-75247, 59-177547, 59-181353, 60-18951, Japanese Utility Model Application KOKAI Publication No. 62-25944 and the like can be preferably used.

The lightsensitive material of the present invention may also be developed by an activator processing or with a processing solution containing a developing agent and a base to form an image. The activator processing is a processing method of developing a lightsensitive material self-containing a color developing agent with a processing solution containing no color-developing agent. In this case, the processing solution is characterized by containing no color-developing agent which is contained in usual development processing solution components, and may contain other components (for example, alkali or auxiliary developing agent). Examples of the activator processing are described in known publications such as EP's 545,491A1 and 565,165A1.

The processing raw materials and the processing method for use in the present invention in the case of heat development processing are described in detail below.

In the lightsensitive material of the present invention, a base or a base precursor can be used for the purpose of accelerating silver development and dye forming reaction. Examples of the base precursor include a salt of a base with an organic acid capable of decarboxylation by heat and a compound that releases an amine by intramolecular nucleophilic substitution reaction, Rossen rearrangement or Beckmann rearrangement. Specific examples thereof are described in U.S. Pat. Nos. 4,514,493 and 4,657,848 and Known Technology No. 5, (issued on Mar. 22, 1991, by Aztek Limited), pp. 55 to 86. Also, a method of generating a base by the combination of a sparingly water-soluble basic metal compound with a compound (referred to as a complex forming compound) that is capable of complex formation reaction with the metal ion constituting the basic metal compound using water as a medium, may also be used. The amount of the base or the base precursor used is from 0.1 to 20 g/m$^2$, preferably from 1 to 10 g/m$^2$.

In order to feed the base, a processing member having a processing layer containing a base or a base precursor can be used. The processing member may have additional functions of shielding air at the heat development, preventing volatilization of raw materials from the lightsensitive material, feeding materials for the processing other than the base to the lightsensitive material, or removing materials (e.g., YF dyestuff, AH dyestuff) in the lightsensitive material which become unnecessary after the development or unnecessary components generated during the development. The support and the binder of the processing member may be the same as those used in the lightsensitive material. The processing member may contain a mordanting agent for the purpose of removing the dyestuff as described above. The mordanting agent used may be a mordanting agent known in the photographic field and examples thereof include the mordanting agents described in U.S. Pat. No. 4,500,626, columns 58 and 59, JP-A-61-88256, pp. 32 to 41, JP-A's-62-244043 and 62-244036. A dye acceptable high molecular compound described in U.S. Pat. No. 4,463,079 may also be used. Further, the processing member may contain the above-described heat solvent.

In performing heat development using a processing member, a slight amount of water is preferably used for the purpose of accelerating development, accelerating transfer of the material for processing or accelerating diffusion of unnecessary matters. This is specifically described in U.S. Pat. Nos. 4,704,245 and 4,470,445, JP-A-61-238056, and the like. The water may contain an inorganic alkali metal salt, an organic base, a low-boiling solvent, a surfactant, an antifoggant, a complex forming compound with a sparingly soluble metal salt, a fungicide or a bactericide. The water may be any water commonly used. More specifically, distilled water, tap water, well water, mineral water or the like may be used. In the heat development apparatus using the lightsensitive material and the processing member of the present invention, the water may be used up or may be circulated and repeatedly used. In the latter case, water used contains components dissolved out from the lightsensitive material. Apparatuses and water described in JP-A's-63-144354, 63-144355, 62-38460 and 3-210555 may also be used. The water may be fed to the lightsensitive material, the processing member or both of them. The water is preferably used in an amount corresponding to from 1/10 to 1 times the amount necessary for giving maximum swelling of all coating films (excluding the back layer) of the lightsensitive material and the processing member. In feeding the water, the methods described, for example, in JP-A-62-253159, p. 5, JP-A-63-85544 and the like are preferably used. Also, a solvent may be enclosed in a microcapsule or previously incorporated in the form of a hydrate into the lightsensitive material or the processing member or both of them. The temperature of water fed is preferably from 30 to 60° C., as described in JP-A-63-85544.

In performing heat development in the presence of a slight amount of water, a method of using a combination of a sparingly water-soluble basic metal compound with a compound (referred to as a complex-forming compound) capable of complex formation reaction with the metal ion constituting the basic metal compound using water as a medium, and generating a base therefrom is effective as described in European Patent No. 210660 and U.S. Pat. No. 4,740,445. In this case, in view of storage stability of lightsensitive materials, the sparingly water-soluble basic metal compound is preferably added to the lightsensitive material and the complex-forming compound is preferably added to the processing member.

For laminating the lightsensitive material and the processing member so that the lightsensitive layer and the processing layer face each other, the methods described in JP-A's-62-253159 and 61-147244, p. 27 may be used. The heating temperature is more preferably 60° C. to less than 100° C. The heating time is preferably from 5 to 60 seconds.

The lightsensitive material or the processing sheet of the present invention may be in the form having an electrically conductive heating element layer as heating means for heat development. As the heating element, those described in JP-A-61-145544 may be used.

The lightsensitive material of the present invention may contain a heat solvent for the purpose of accelerating heat development. Examples thereof include organic compounds having polarity as described in U.S. Pat. No. 3,347,675 and 3,667,959. Specific examples thereof include amide derivatives (e.g., benzamide), urea derivatives (e.g., methylurea, ethyleneurea), sulfonamide derivatives (e.g., compounds described in JP-B's-1-40974 and 4-13701), polyol compounds, sorbitols and polyethylene glycols. When the heat solvent is water insoluble, it is preferably used as a solid dispersion. The layer to which the heat solvent is added may be either a lightsensitive layer or a light-insensitive layer depending on the purpose. The addition amount of the heat solvent is from 10 to 500% by weight, preferably from 20 to 300% by weight of the binder in the layer to which the heat solvent is added.

In the present invention, image information may be taken in without removing developed silver generated by the development or undeveloped silver halide, however, an image may also be taken in after removing them. In the latter case, means for removing them simultaneously with or after the development may be applied.

In order to remove developed silver in the lightsensitive material simultaneously with development, to convert silver halide into a complex or to solubilize silver halide, the processing member may contain an oxidizing agent for silver or a rehalogenating agent, which acts as a bleaching agent, or a silver halide solvent which acts as a fixing agent, so that it scan cause reaction on heat development. Further, a second material containing an oxidizing agent for silver, a rehalogenating agent or a silver halide solvent may be laminated on the lightsensitive material after completion of development in the image formation, to remove developed silver, to convert silver halide into a complex or to solubilize silver halide. In the present invention, the above-described treatment is preferably applied to such a degree that no obstacle arises to the reading of image information after photographing and development in the subsequent image formation. In particular, undeveloped silver halide generates high haze in the gelatin film to increase the background density of an image and therefore, the above-described complex forming agent is preferably used to reduce haze or solubilize and then remove wholly or partly the undeveloped silver halide from the layer. Further, in order to reduce haze of the silver halide itself, tabular grains having a high aspect ratio or having a high silver chloride content may also be preferably used.

The bleaching agent that can be used in the processing member of the present invention may be any silver bleaching agent commonly used. Such a bleaching agent is described in U.S. Pat. Nos. 1,315,464 and 1,946,640, and Photographic Chemistry, Vol. 2, Chapter 30, Foundation Press, London, England. The bleaching agent effectively oxidizes and then solubilizes the photographic silver image. Useful examples of the silver bleaching agent include an alkali metal bichromate and an alkali metal ferricyanide. The bleaching agent is preferably soluble in water and examples thereof include ninhydrine, indanedione, hexaketocyclohexane, 2,4-dinitrobenzoic acid, benzoquinone, benzenesulfonic acid and 2,5-dinirobenzoic acid. A metal organic complex such as a ferric salt of cyclohexyldialkylaminotetraacetic acid, a ferric salt of ethylenediaminetetraacetic acid and a ferric salt of citric acid may also be used. As the fixing agent, the above-described silver halide solvent that can be incorporated into the processing member (first processing member) for developing the lightsensitive material may be used. The binder, the support and other additives that can be used in the second processing member may be the same as used in the first processing member. The amount of the bleaching agent coated should be varied depending on the amount of silver contained in the lightsensitive material to be laminated, however, it is, based on the coated silver amount per unit area of the lightsensitive material, from 0.01 to 10 mol/mol-coated silver of lightsensitive material, preferably from 0.1 to 3 mol/mol-coated silver of lightsensitive material, more preferably from 0.1 to 2 mol/mol-coated silver of lightsensitive material.

EXAMPLES

Examples of the present invention will be set forth below, however the present invention is not limited to the examples.

Example 1

(Preparation of Tabular Grains Seed Emulsion)

In a reaction vessel was placed 4220 mL of distilled water containing 3.17 g of oxidized gelatin having an average molecular weight of 15,000 and 3.17 g of KBr, and was heated to 35° C. To this solution with vigorous stirring, 158 mL of an aqueous solution containing 31.7 g of $AgNO_3$ and 158 mL of an aqueous solution containing 22.2 g of KBr and 5.27 g of gelatin having an average molecular weight of 15,000 were added over 60 seconds by the double jet method. Immediately after the completion of the addition, 5.28 g of KBr was added, and then 249 mL of an aqueous solution containing 39.8 g of $AgNO_3$ and 258 mL of an aqueous solution containing 29.1 g of KBr were added over 120 seconds by the double jet method. 4.78 g of KBr was added immediately after the completion of the addition. After the completion of the addition, the reaction solution was kept at 40° C. for one minute and then heated up to 75° C. Thereto, 7.92 g of KBr and 92.7 g of phthalated gelatin resulting from the modification of 97% of amino group with phthalic acid were added, and then 160 mL of an aqueous solution containing 51.0 g of $AgNO_3$ and an aqueous KBr solution were added over 12 minutes while the flow rate was accelerated such that the final flow rate was 1.4 times the initial flow rate. During the addition, the silver potential was held at −60 mV with respect to a saturated calomel electrode. After cooling to 40° C., desalting was performed by normal flocculation and then gelatin was added so that the pH and the pAg were adjusted to 5.7 and 8.8, respectively.

(Preparation of Emulsion 1-A)

1211 mL of an aqueous solution containing 46.0 g of phthalated gelatin and 1.7 g of KBr was vigorously stirred at 75° C. After 9.9 g of the above-described seed emulsion was added, 0.3 g of modified silicone oil (L7602 manufactured by Nippon Unicar Co. Ltd.) was added. After the adjustment of the pH to 5.5 with $H_2SO_4$, 67.6 mL of an aqueous solution containing 7.0 g of $AgNO_3$ and an aqueous KBr solution were added over 6 minutes while the flow rate was accelerated such that the final flow rate was 5.1 times the initial flow rate. During the addition, the silver potential was held at −20 mV with respect to a saturated calomel electrode. After the temperature was lowered to 40° C., 2 mg of sodium benzenethiosulfinate and 2 mg of thiourea dioxide were added. An emulsion containing AgBrI fine grains (a mean grain size: 0.015 μm) having a silver iodide content of 7 mol % was prepared through simultaneous addition of 762 mL of an aqueous solution containing 134.4 g of $AgNO_3$ and 762 mL of an aqueous solution containing 90.1 g of KBr, 9.46 g of KI and 38.1 g of gelatin having an average molecular weight of 20000 to a stirring device located outside the reaction vessel, and simultaneously the emulsion of AgBrI fine grains was added into a reaction vessel over 90 minutes. During the addition, the silver potential was held at −30 mV with respect to a saturated calomel electrode.

121 mL of an aqueous solution containing 45.6 g of $AgNO_3$ and an aqueous KBr solution were added over 22 minutes by the double jet method. During the addition, the silver potential was held at +20 mV with respect to a saturated calomel electrode. The temperature was raised to 78° C., KBr was added to adjust the silver potential to −80 mV, and an emulsion containing AgI fine grains emulsion having a grain size of 0.03 μm was added in an amount of 6.33 g in terms of a KI weight. Immediately after the completion of the addition, 206 mL of an aqueous solution containing 66.4 g of $AgNO_3$ was added over 16 minutes. For the first 5 minutes of the addition, the silver potential was held at −80 mV in the aqueous solution of KBr. After lowering the temperature, desalting was performed in a conventional manner, and then gelatin was added so that the pH and the pAg were adjusted to 5.8 and 8.7, respectively, at 40° C. The emulsion obtained was emulsion comprised hexagonal tabular grains having an average grain size of 1.70 μm, expressed in terms of sphere equivalent diameter, and an average aspect ratio of 12.0.

The emulsion obtained was subjected to spectral sensitization and chemical sensitization by the addition of $4.5\times10^{-4}$ mol/mol-Ag of a sensitizing dye D-15, potassium thiocyanate, chloroauric acid, sodium thiosulfate and mono (pentafluorophenyl)diphenylphosphine selenide. At the completion of the chemical sensitization, Compound-11 and Compound-12 shown below were added. In the chemical sensitization, the amounts of chemical sensitizers were each adjusted so that the level of the chemical sensitization of the emulsion was optimized.

(Compound-11)

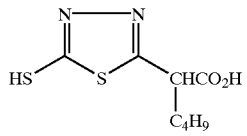

(Compound-12)

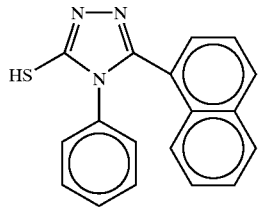

(Preparation of Emulsion 1-B)

In the preparation of Emulsion 1-A, after the spectral sensitization and chemical sensitization were performed, the sensitizing dye D-15 was further added in an amount of $0.5\times10^{-4}$ mol/mol-Ag and then the mixture was stirred for 10 minutes. Further, $1.0\times10^{-3}$ mol/mol-Ag. of a sensitizing dye D-20 was added and was stirred for 60 minutes. The chemical sensitization was thereafter finished to obtain Emulsion 1-B.

(Measurement of Light Absorption Intensity)

The measurement of the light absorption intensity per unit area was conducted as follows: that is, the obtained emulsion was coated thinly on a slide glass and transmission spectrum and reflection spectrum of each grain were measured using a microspectrophotometer MSP65 produced by Carl Zeiss Corp. according to the following method, from which absorption spectrum was searched for. A portion where grains were not present was taken as a reference of transmission spectrum, and silicon carbide the reflectance of which was known was measured and the obtained value was made a reference of reflection spectrum. The measuring part was a circular aperture of a diameter of 1 μm, and transmission spectrum and reflection spectrum were measured in the wave number region of from 14,000 $cm^{-1}$ (714 nm) to 28,000 $cm^{-1}$ (357 nm) by adjusting the position so that the aperture part was not overlapped with the contour of the grain. Absorption spectrum of the grains to which a sensitizing dye was adsorbed was found taking 1-T-R as absorption factor A, wherein T is transmittance and R is reflectance. The absorption by silver halide was deducted from A to obtain absorption A'. The value obtained by integrating −Log (1-A') to wave number ($cm^{-1}$) was divided by 2 and this value was made the light absorption intensity per unit surface area of the grain surface. The integrated region was from 14,000 $cm^{-1}$ to 28,000 $cm^{-1}$. A tungsten lamp was used as a light source and the light source voltage was 8 V. For minimizing the injury of a dye by irradiation of light, a primary monochromator was used, the distance of wavelength was 2 nm, and a slit width was 2.5 nm.

The results of the measurement revealed that the average light absorption intensity of 200 grains of Emulsion 1-A was 51 and that the average light absorption intensity of Emulsion 1-B was 121.

(Preparation of Dispersion of 5-Amino-3-Benzylthiotriazole Silver Salt (Organic Silver Salt))

11.3 g of 5-amino-3-benzylthiotriazole, 1.1 g of sodium hydroxide and 10 g of gelatin were dissolved in 1000 mL of water and were stirred while being held at 50° C. Next, a solution obtained by dissolving 8.5 g of silver nitride in 100 mL of water was added to the above-mentioned solution over 2 minutes. The emulsion was precipitated through the adjustment of the pH of the emulsion and the excessive salt was removed. Thereafter, the pH was adjusted to 6.0 to yield a dispersion of a 5-amino-3-benzylthiotriazole silver salt in a yield of 400 g.

In the subsequent preparation of a lightsensitive material, preparation of a support and coating of an undercoat layer, a first back layer (an antistatic layer), a second back layer (a magnetic recording layer) and a third back layer (a sliding layer) were conducted in the following manner.

(Preparation of Support)

The support used in this example was prepared as follows. 100 parts by weight of a polyethylene-2,6-naphthalene-dicarbonxylate (PEN) and 2 parts by weight of Tinuvin P.326 (manufactured by Ciba-Geigy Co.) as an ultraviolet absorbent were mixed uniformly, melted at 300° C., and extruded from a T-die. The resultant material was longitudinally oriented by 3.3 times at 140° C., and then laterally oriented by 4.0 times. The resultant was thermally fixed at 250° C. for 6 sec., thereby obtaining a 90-$\mu$m thick PEN film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 30 cm in diameter and given a thermal history of at 110° C. for 48 hr, yielding a support with a high resistance to curling.

(Application of Undercoat Layer)

Glow treatment was applied to both surfaces of a PEN support as follows. Four cylindrical electrodes 2 cm in diameter and 40 cm in length were fixed at 10-cm intervals on an insulating plate in a vacuum tank. At this time, the setting was made so that a film runs 15 cm away from the electrodes. Further, a heating roll 50 cm in diameter equipped with a temperature controller was positioned just before the electrodes so that the film has contact with a ¾ round of the heating roll. A biaxially stretched film 90 $\mu$m in thickness and 30 cm in width was caused to run to be heated with the heating roll so that the temperature of the surface of the film between the heating roll and the electrode zone became 115° C. Subsequently, the film was conveyed at a rate of 15 cm/sec and was subjected to glow treatment.

The treatment was conducted under the following conditions: the pressure inside the vacuum chamber: 26.5 Pa; the $H_2O$ partial pressure in the atmospheric gas: 75%; the discharge frequency: 30 KHz; the output: 2500 W; and the treatment strength: 0.5 KV·A·min/m$^2$. The vacuum glow discharge electrode was selected in accordance with the method described in JP-A-7-003056.

An undercoat layer was formed on one side (the emulsion side) of the glow-treated PEN support according to the following formulation. The dry film thickness was designed to be 0.02 $\mu$m. The drying temperature was set to 115° C. for 3 minutes.

| | |
|---|---|
| Gelatin | 83 parts by weight |
| Water | 291 parts by weight |
| Salicylic acid | 18 parts by weight |
| Aerozil R972 (manufactured by Nippon Aerozil Co., Ltd.; colloidal silica) | 1 parts by weight |
| Methanol | 6900 parts by weight |
| n-Propanol | 830 parts by weight |
| Polyamide-epichiorohydrin resin disclosed in JP-A-51-3619 | 25 parts by weight |

(Application of First Back Layer (Antistatic Layer))

While 1N aqueous sodium hydroxide solution was added to a mixed liquid comprising 40 parts by weight of SN-100 (manufactured by Ishihara Sangyo Kaisya, Ltd.; conductive fine grain) and 60 parts by weight of water, rough dispersion was conducted with an agitator. Thereafter, dispersion was conducted using a horizontal sand mill, resulting in a dispersion (pH 7.0) of conductive grains whose secondary grains had an average particle diameter of 0.06 $\mu$m.

A coating liquid having the following composition was applied on the surface-treated PEN support (the back side) such that the applied amount of conductive grains was 270 mg/m$^2$. The drying conditions were set to at 115° C. for 3 minutes.

| | |
|---|---|
| SN-100 (manufactured by Ishihara Sangyo Kaisya, Ltd.; conductive fine grain) | 270 parts by weight |
| Gelatin | 23 parts by weight |
| Rheodol TW-L120 (manufactured by Kao Corp.; Surfactant) | 6 parts by weight |
| Denacol EX-521 (manufactured by Nagase Chemicals Ltd.; a film hardener) | 9 parts by weight |
| Water | 5000 parts by weight |

(Application of Second Back Layer (Magnetic Recording Layer))

On the surface of magnetic grains CSF-4085V2 (manufactured by TODA KOGYO CORP.; $\gamma$-$Fe_2O_3$ coated with Co) was applied surface treatment with 16% by weight, base on the amount of the magnetic grains, of X-12-641 (manufactured by Shin-Etsu Chemical Co., Ltd.; silane coupling agent).

A coating liquid having the following composition was applied onto the first back layer so that the applied amount of the CSF-4085V2 treated with the silane coupling agent was 62 mg/m$^2$. Dispersion of the magnetic grains and an abrasive was conducted in accordance with the method disclosed in JP-A-6-035092. The drying conditions were set to at 115° C. for 1 minute.

| | |
|---|---|
| Diacetylcellulose (binder) | 1140 parts by weight |
| CSF-4085V2 (magnetic grains) treated with X-12-641 | 62 parts by weight |
| AKP-50 (manufactured by Sumitomo Chemical Co., Ltd.; abrasive) | 40 parts by weight |
| Milionate MR-400 (manufactured by Nippon Polyurethane Industry Co., Ltd.; film hardener) | 71 parts by weight |
| Cyclohexanone | 12000 parts by weight |
| Methyl ethyl ketone | 12000 parts by weight |

The color density increase of the magnetic recording layer measured by an X-light (blue filter) was about 0.1. The saturation magnetization moment, coercive force, and squareness ratio of the magnetic recording layer were 4.2 Am$^2$/kg, 7.3×10$^4$ A/m, and 65%, respectively.

(Application of Third Back Layer (Sliding Layer))

A wax dispersion in water having a concentration of 10% by weight and an weight average diameter of 0.25 $\mu$m was obtained by emulsifying a wax having the following structure into dispersion using a high-pressure homogenizer.

Wax: n-$C_{17}H_{35}COOC_{40}H_{81}$-n

A coating liquid having the following composition was applied onto the second back layer (magnetic recording layer) so that the applied amount of the wax was 27 mg/m$^2$. The drying conditions were set to at 115° C. for 1 minute.

| | |
|---|---|
| The above-described wax dispersion in water (10% by weight) | 270 parts by weight |
| Water | 176 parts by weight |
| Ethanol | 8000 parts by weight |
| Cyclohexanone | 200 parts by weight |

(Preparation of Dispersion Containing Coupler and Incorporated Developing Agent))

A yellow coupler (a), a developing agent (DEVP-26), antifoggants (b) and (c), high-boiling organic solvents (d) and (e) and ethyl acetate were dissolved at 60° C. The above solution was mixed with an aqueous solution obtained by dissolving lime-processed gelatin and sodium dodecylbenzenesulfonate, and emulsified into dispersion over 20 minutes using a dissolver at 10,000 r.p.m., resulting in a dispersion of yellow coupler/developing agent.

Yellow coupler (a)

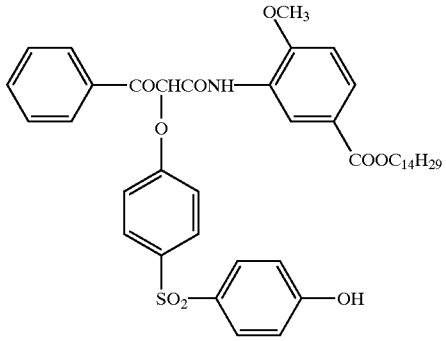

Antifoggant (b)

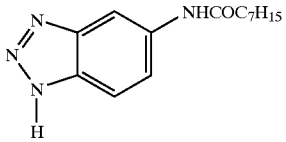

Antifoggant (c)

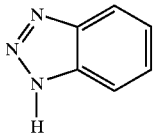

High-boiling organic solvent (d)

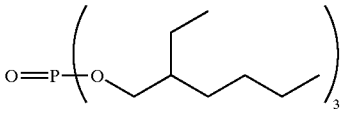

High-boiling organic solvent (e)

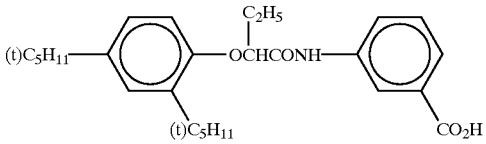

A magenta coupler (f), a magenta coupler (g), a developing agent (DEVP-26), an antifoggant (b), a high-boiling organic solvent (h) and ethyl acetate were dissolved at 60° C. The above solution was mixed with an aqueous solution obtained by dissolving lime-processed gelatin and sodium dodecylbenzenesulfonate, and emulsified into dispersion over 20 minutes using a dissolver at 10,000 r.p.m., resulting in a dispersion of magenta coupler/developing agent.

Magenta coupler (f)

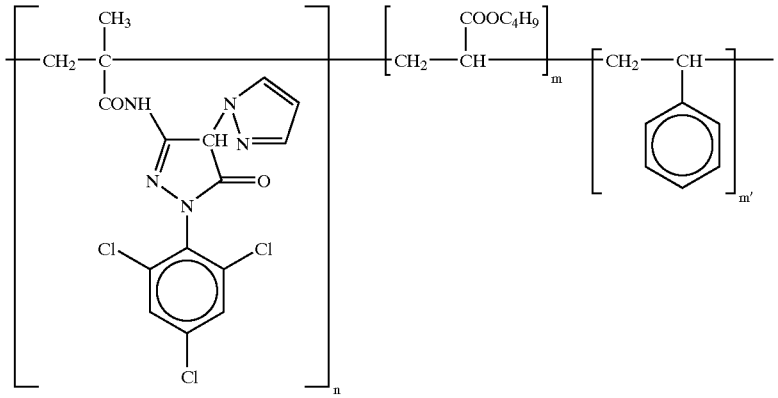

n = 50
m = 25
m′ = 25
mol. wt. about 20,000

Magenta coupler (g)

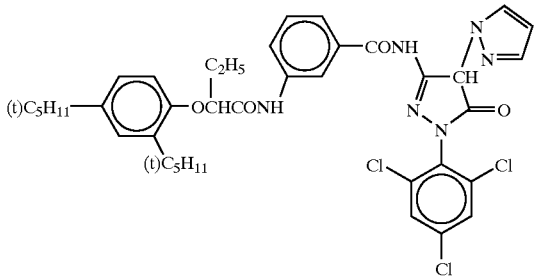

High-boiling organic solvent (h)

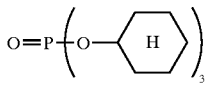

A cyan coupler (i), a cyan coupler (j), a developing agent (DEVP-26), an antifoggant (b), high-boiling organic solvents (h), (k) and ethyl acetate were dissolved at 60° C. The above solution was mixed with an aqueous solution obtained by dissolving lime-processed gelatin and sodium dodecylbenzenesulfonate, and emulsified into dispersion over 20 minutes using a dissolver at 10,000 r.p.m., resulting in a dispersion of cyan coupler/developing agent.

Cyan coupler (i)

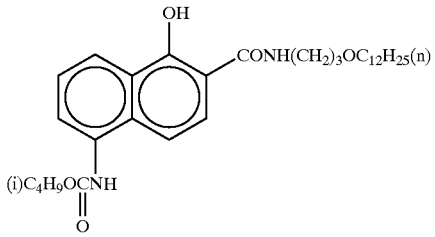

-continued

Cyan coupler (j)

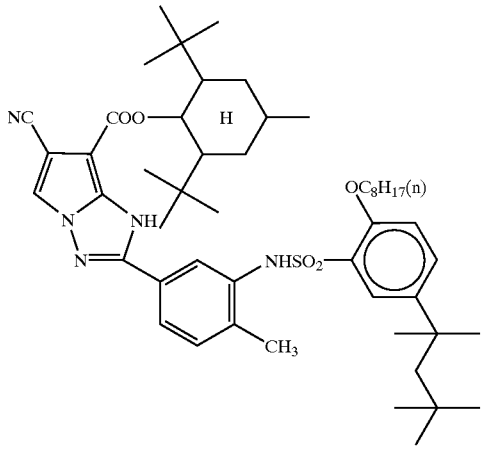

-continued

High-boiling organic solvent (k)

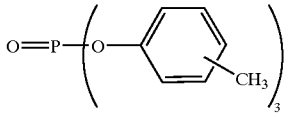

Further, dye dispersions for coloring intermediate layers as filter layers and an antihalation layer were similarly prepared. Respective dyes and high-boiling organic solvents used for dispersing them are shown below.

Yellow dye (l)

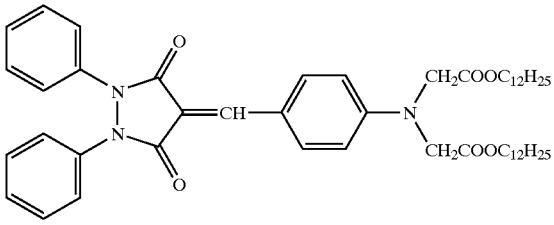

High-boling organic solvent (m)

A1:1 mixture of

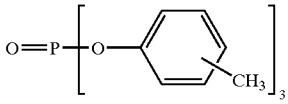

and Ajinomoto Empara K5 manufactured by AJINOMOTO K.K.

Magenta dye (n)

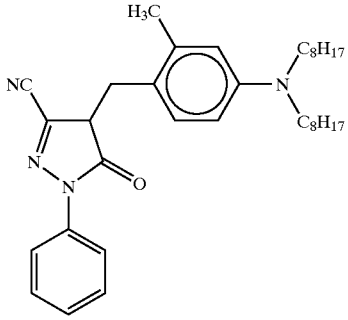

High-boiling organic solvent (o)

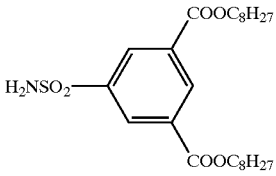

Cyan dye (p)

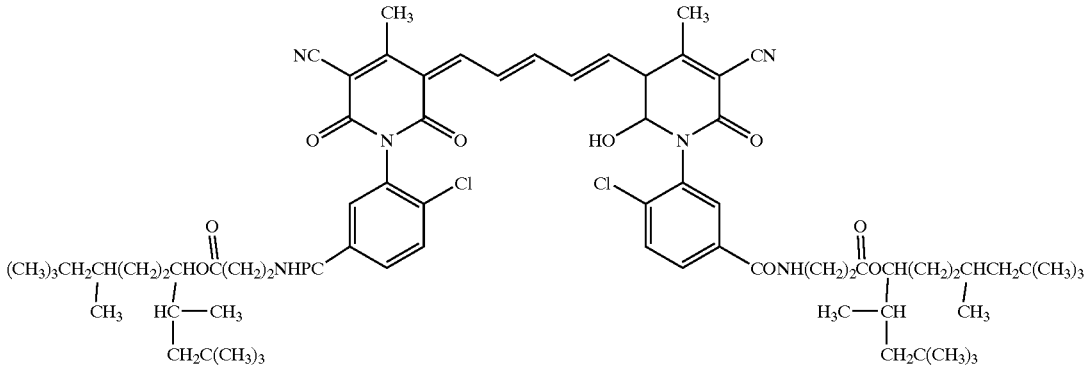

(Preparation of Dispersion of Solid Fine Grains of Base Precursor)

64 g of a base precursor compound (w), 28 g of diphenylsulfone and 10 g of a surfactant DEMOL N manufactured by Kao Corp. were mixed with 220 mL of distilled water. The mixed liquid was subjected to beads dispersion using a sand mill (¼ Gallon sand grinder mill, manufactured by Aimex Co., Ltd.), yielding a dispersion of solid fine grains of the base precursor compound having an average diameter of 0.2 $\mu$m.

(Preparation of Multi-Layer-Coated Sample)

Subsequently, sample T-01, which is a multi-layer color lightsensitive material shown in Table 1, was prepared on the side opposite to the above-described back layers.

TABLE 1

| | Sample T-01 | Addition amount (mg/m$^2$) |
|---|---|---|
| 14th layer | Alkali-processed delimed gelatin | 880 |
| Protective layer | Surfactant (q) | 35 |
| | Surfactant (r) | 40 |
| | Water-soluble polymer (s) | 17 |
| | Film-hardening agent (t) | 105 |
| 13th layer | Alkali-processed delimed gelatin | 455 |
| Intermediate layer | Surfactant (r) | 8 |
| | Base precursor compound (w) | 425 |
| | Formalin scavenger (u) | 312 |
| | D-sorbitol | 60 |
| | Water-soluble polymer (s) | 20 |
| | Film pAg-adjusting agent | |
| 12th layer | Alkali-processed delimed gelatin | 1790 |
| Yellow-coloring layer | Emulsion 1-A or Emulsion 1-B | 550 |
| (High-speed layer) | (in terms of coated silver amount) | |
| | 5-Butylbenzotriazole silver | 183 |
| | Yellow coupler (a) | 170 |
| | Developing agent (DEVP-26) | 225 |
| | Antifoggant (b) | 3.8 |
| | Antifoggant (c) | 5.0 |
| | High-boiling organic solvent (d) | 90 |
| | High-boiling organic solvent (e) | 90 |
| | Surfactant (v) | 30 |
| | D-sorbitol | 210 |
| | Water-soluble polymer (s) | 1 |
| 11th layer | Alkali-processed delimed gelatin | 1350 |
| Yellow-coloring | Emulsion 1-C (in terms of coated silver amount) | 275 |
| layer | 5-Butylbenzotriazole silver | 91 |
| (Medium-speed | Yellow coupler (a) | 180 |
| layer) | Developing agent (DEVP-26) | 310 |
| | Antifoggant (b) | 5.0 |
| | Antifoggant (c) | 10.0 |
| | High-boiling organic solvent (d) | 135 |
| | High-boiling organic solvent (e) | 135 |
| | Surfactant (v) | 30 |
| | D-sorbitol | 140 |
| | Water-soluble polymer (s) | 2 |
| 10th layer | Alkali-processed delimed gelatin | 1670 |
| Yellow-coloring | Emulsion 1-D (in terms of coated silver amount) | 250 |
| layer | 5-Butylbenzotriazole silver | 83 |
| (Low-speed | Yellow coupler (a) | 465 |
| layer) | Developing agent (DEVP-26) | 540 |
| | Antifoggant (b) | 9.0 |
| | Antifoggant (c) | 16.0 |
| | High-boiling organic solvent (d) | 220 |
| | High-boiling organic solvent (e) | 220 |
| | Surfactant (v) | 25 |
| | D-sorbitol | 140 |
| | Water-soluble polymer (s) | 2 |
| 9th layer | Alkali-processed delimed gelatin | 580 |
| Intermediate | Surfactant (v) | 20 |
| layer | Surfactant (r) | 20 |
| (Yellow filter | Base precursor compound (w) | 510 |
| layer) | Yellow dye (1) | 80 |
| | High-boiling organic solvent (m) | 80 |
| | Water-soluble polymer (s) | 20 |
| 8th layer | Alkali-processed delimed gelatin | 780 |
| Magenta-coloring | Emulsion 1-E (in terms of coated silver amount) | 475 |
| layer | 5-Butylbenzotriazole silver | 158 |
| (High-speed | Magenta coupler (f) | 60 |
| layer) | Magenta coupler (g) | 23 |
| | Developing agent (DEVP-26) | 90 |
| | Antifoggant (b) | 1.3 |
| | High-boiling organic solvent (h) | 78 |
| | Surfactant (v) | 10 |
| | D-sorbitol | 105 |
| | Water-soluble polymer (s) | 9 |
| 7th layer | Alkali-processed delimed gelatin | 676 |
| Magenta-coloring | Emulsion 1-F (in terms of coated silver amount) | 388 |
| layer | 5-Butylbenzotriazole silver | 129 |
| (Medium-speed | Magenta coupler (f) | 95 |
| layer) | Magenta coupler (g) | 57 |
| | Developing agent (DEVP-26) | 165 |
| | Antifoggant (b) | 2.4 |
| | High-boiling organic solvent (h) | 155 |
| | Surfactant (v) | 13 |
| | D-sorbitol | 86 |

TABLE 1-continued

| | Sample T-01 | Addition amount (mg/m$^2$) |
|---|---|---|
| | Water-soluble polymer (s) | 16 |
| 6th layer | Alkali-processed delimed gelatin | 720 |
| Magenta-coloring | Emulsion 1-G (in terms of coated silver amount) | 235 |
| layer | 5-Butylbenzotriazole silver | 78 |
| (Low-speed | Magenta coupler (f) | 250 |
| layer) | Magenta coupler (g) | 120 |
| | Developing agent (DEVP-26) | 420 |
| | Antifoggant (b) | 5.7 |
| | High-boiling organic solvent (h) | 386 |
| | Surfactant (v) | 34 |
| | D-sorbitol | 84 |
| | Water-soluble polymer (s) | 18 |
| 5th layer | Alkali-processed delimed gelatin | 855 |
| Intermediate | Surfactant (v) | 14 |
| layer | Surfactant (r) | 25 |
| (Magenta filter | Base precursor compound (w) | 476 |
| layer) | Magenta dye (n) | 52 |
| | High-boiling organic solvent (o) | 50 |
| | Formalin scavenger (u) | 300 |
| | D-sorbitol | 80 |
| | Water-soluble polymer (s) | 14 |
| 4th layer | Alkali-processed delimed gelatin | 800 |
| Cyan-coloring | Emulsion 1-H (in terms of coated silver amount) | 425 |
| layer | 5-Butylbenzotriazole silver | 142 |
| (High-speed | Cyan coupler (i) | 20 |
| layer) | Cyan coupler (j) | 39 |
| | Developing agent (DEVP-26) | 70 |
| | Antifoggant (b) | 1.0 |
| | High-boiling organic solvent (h) | 76 |
| | Surfactant (v) | 6 |
| | D-sorbitol | 88 |
| | Water-soluble polymer (s) | 20 |
| 3rd layer | Alkali-processed delimed gelatin | 480 |
| Cyan-coloring | Emulsion 1-I (in terms of coated silver amount) | 400 |
| layer | 5-Butylbenzotriazole silver | 133 |
| (Medium-speed | Cyan coupler (i) | 40 |
| layer) | Cyan coupler (j) | 140 |
| | Developing agent (DEVP-26) | 229 |
| | Antifoggant (b) | 2.5 |
| | High-boiling organic solvent (h) | 200 |
| | Surfactant (v) | 10 |
| | D-sorbitol | 45 |
| | Water-soluble polymer (s) | 10 |
| 2nd layer | Alkali-processed delimed gelatin | 810 |
| Cyan-colored | Emulsion 1-J (in terms of coated silver amount) | 305 |
| layer | 5-Butylbenzotriazole silver | 102 |
| (Low-speed | Cyan coupler (i) | 90 |
| layer) | Cyan coupler (j) | 210 |
| | Developing agent (DEVP-26) | 410 |
| | Antifoggant (b) | 3.8 |
| | High-boiling organic solvent (h) | 370 |
| | Surfactant (v) | 17 |
| | D-sorbitol | 95 |
| | Water-soluble polymer (s) | 7 |
| 1st layer | Alkali-processed delimed gelatin | 420 |
| Halation-prevent- | Surfactant (v) | 12 |
| ing layer | Base precursor compound (w) | 620 |
| | Cyan dye (p) | 260 |
| | High-boiling organic solvent (o) | 245 |
| | Water-soluble polymer (s) | 15 |
| | Transparent PEN base (96 $\mu$m) | |

Surfactant (q)

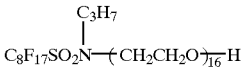

Surfactant (r)

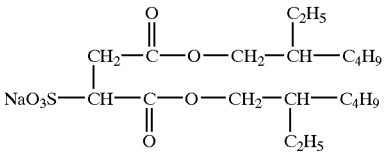

Water-soluble polymer (s)

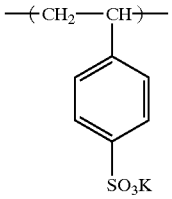

Film-hardeniing agent (t)

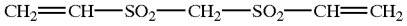

-continued

Base precursor compound (w)

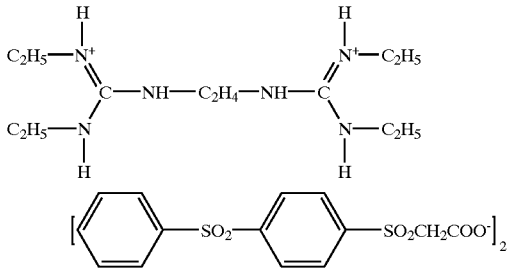

Emulsion 1-A or Emulsion 1-B was used for a 12th layer (a high-speed yellow-coloring layer), and Emulsions 1-C through 1-J, which were prepared by a method that is the same as a tabular emulsion preparation method disclosed in JP-A-1-329231, were used for the other emulsion layers. The compositions of the emulsions and the sensitizing dyes used for the preparation of sample T-01 are shown in Table 2.

TABLE 2

| Emulsion | Average grain size (μm) | Coefficient of variation or the grain size (%) | Average aspect ratio | Thickness | Spectral sensitizer | Remarks |
|---|---|---|---|---|---|---|
| 1-A (Blue sensitive) | 1.70 | 15 | 12.0 | 0.28 | D-15 | Hexagonal tabular grains |
| 1-B (Blue-sensitive) | 1.70 | 15 | 12.0 | 0.28 | D-15/D-20 | Hexagonal tabular grains to which dyes were adsorbed in multi-layered form |
| 1-C (Blue-sensitive) | 0.86 | 20 | 8.0 | 0.19 | IV | Triple structure tabular grains |
| 1-D (Blue-sensitive) | 0.49 | 17 | 5.2 | 0.14 | IV | Triple structure tabular grains |
| 1-E (Green-sensitive) | 1.07 | 22 | 7.0 | 0.26 | I/II/III | Triple structure tabular grains |
| 1-F (Green-sensitive) | 0.86 | 20 | 8.0 | 0.19 | I/II/III | Triple structure tabular grains |
| 1-G (Green-sensitive) | 0.49 | 17 | 5.2 | 0.14 | I/II/III | Triple structure tabular grains |
| 1-H (Red-sensitive) | 1.07 | 22 | 7.0 | 0.26 | V/VI/VII | Triple structure tabular grains |
| 1-I (Red-sensitive) | 0.86 | 20 | 8.0 | 0.19 | V/VI/VII | Triple structure tabular grains |
| 1-J (Red-sensitive) | 0.49 | 17 | 5.2 | 0.14 | V/VI/VII | Triple structure tabular grains |

-continued

Formalin scavenger (u)

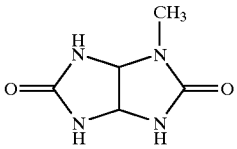

Surfactant (v)

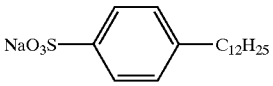

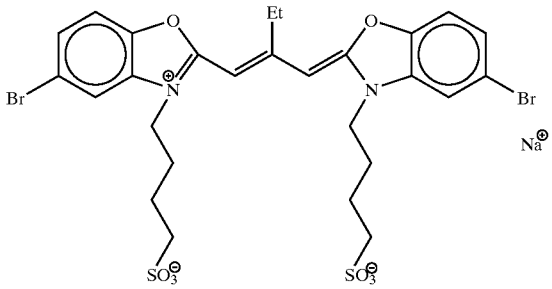

A mixtur of the following spectral sensitizers I: II: III in a molar ratio of 77: 20: 3
Spectral sensitizer I for green-sensitive emulsion -continued

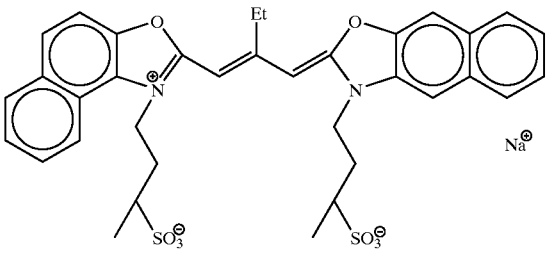

Spectral sensitizer II for green-sensitive emulsion

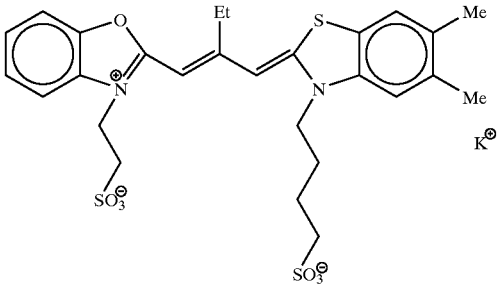

Spectral sensitizer III for green-sensitive emulsion

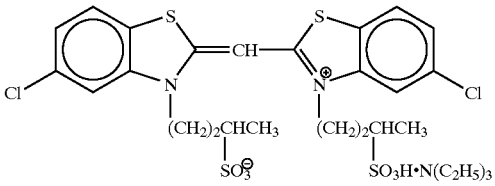

Spectral sensitizer IV for blue-sensitive emulsion

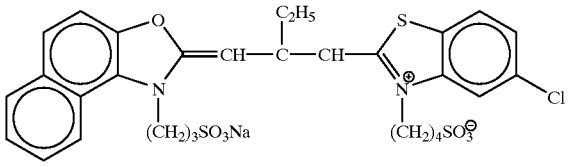

A mixture of the following spectral sensitizers V: VI: VII in a molar ratio of 40: 2: 58

Spectral sensitizer V for red-sensitive emulsion

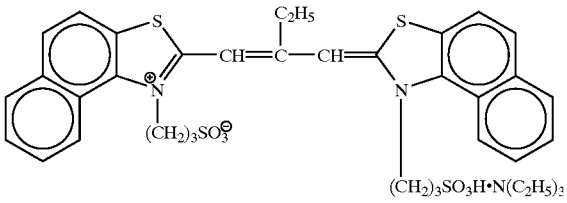

Spectral sensitizer VI for red-sensitive emulsion

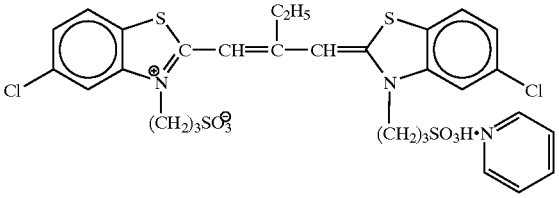

Spectral sensitizer VII for red-sensitive emulsion

Image forming methods 101 to 108 shown in Table 3 were tested by varying the amounts of the matting agent for the 14th layer and the third back layer and the kind of the emulsion for the 12th layer in sample T-01, and the side of the sample with which a heat source is brought into contact during development.

Fine-powdery spherical silica (SP-series, average grain diameter 2 $\mu$m) manufactured by FUSO CHEMICAL Co., Ltd. was used as the matting agent, and it was added to the 14th layer and/or the third back layer in the amounts shown in Table 3.

Sample pieces were cut out from these lightsensitive materials, and were exposed to white light through an optical wedge for 1/100 second. After the exposure, heat development processing was conducted for 10 seconds in a manner that the 14th layer side or the third back layer side came into contact with a heat drum heated to 150° C. The transmission densities of the colored samples obtained after the heat development, were measured. A reciprocal number of the exposure amount corresponding to a density of yellow fog density +0.2 was used for a relative sensitivity and the sensitivity was expressed by a value relative to the image-forming method 101.

The surface roughness of each raw lightsensitive material was measured using NanoScope III Contact AFM manufactured by Digital Instruments, U.S.A.

Evaluation of adhesiveness was conducted as follows. A lightsensitive material was humidity conditioned for one day at 25° C. under a relative humidity of 90%. Thereafter, it was cut into squares with each side 3.5 cm long and the resulting nine pieces were piled. The resultant was applied with a load of 40 g/cm$^2$ and was left stand for 3 days at 40° C. under a relative humidity of 90%. The three pieces near the center of the nine pieces piled were evaluated. The area of the part adhered was measured and the adhesiveness was expressed by a relative value. The smaller the value, adhesion more hardly occurs. Thus, a smaller value is preferable.

In evaluation of development-induced unevenness, a sample was cut into a square with each side 5 cm long. The above-described heat development at 150° C. for 10 seconds was conducted by exposing the entire surface of the sample to white light in the same exposure amount. In this processing, all samples were exposed in an exposure amount such that the magenta density of sample T-01 became 1.0.

The development-induced unevenness of each sample after development was visually observed. Twenty observers rated the development-induced unevenness on a 1-to-5 scale and the average of the rates was obtained.

| | |
|---|---|
| Rate 1 | Very much development-induced unevenness was observed. |
| Rate 2 | Much development-induced unevenness was observed. |
| Rate 3 | Slight development-induced unevenness was observed. |
| Rate 4 | Little development-induced unevenness was observed. |
| Rate 5 | No development-induced unevenness was observed. |

TABLE 3

| Image-forming method No. | Sensitive material No. | Surface roughness of raw sensitive material (nm) 14th layer | 3rd back layer | $R_{q1}/R_{q2}$ | Matting agent coating amount ($mg/m^2$) 14th layer | 3rd back layer | Layer with which a heat source is brought into contact | Emulsion in 12th layer | Development-induced unevenness | Sensitivity | Adhesion |
|---|---|---|---|---|---|---|---|---|---|---|---|
| 101 (Comp.) | T-01 | 31 | 32 | 1.03 | — | — | 3rd back layer | 1-A | 4.1 | 100 | 200 |
| 102 (Comp.) | T-02 | 30 | 119 | 3.97 | — | 125 | 3rd back layer | 1-A | 1.1 | 102 | 100 |
| 103 (Comp.) | T-03 | 110 | 82 | 0.75 | 100 | 70 | 3rd back layer | 1-A | 1.7 | 101 | 83 |
| 104 (Inv.) | T-04 | 118 | 55 | 0.47 | 110 | 35 | 3rd back layer | 1-A | 3.1 | 103 | 82 |
| 105 (Inv.) | T-05 | 120 | 43 | 0.36 | 110 | 20 | 3rd back layer | 1-A | 3.6 | 103 | 80 |
| 106 (Inv.) | T-06 | 45 | 121 | 0.37 | 20 | 110 | 14th layer | 1-A | 3.8 | 125 | 79 |
| 107 (Inv.) | T-07 | 32 | 130 | 0.25 | — | 130 | 14th layer | 1-A | 4.2 | 127 | 80 |
| 108 (Inv.) | T-08 | 31 | 131 | 0.24 | — | 130 | 14th layer | 1-B | 4.3 | 155 | 80 |

It is apparent from Table 3 that the image-forming method of the present invention exhibits high sensitivity and generates less development-induced unevenness, and also is excellent in adhesion resistance.

Example 2

The multi-layer coated samples T-01 through T-08 each was cut into a size of 24 mm (width)×160 cm, and two perforations each in a size of 2 mm×2 mm were provided on the portion of 0.7 mm inside from one vertical side in the longitudinal direction of the sample at an interval of 5.8 mm. Samples each having this pair of perforations at an interval of 32 mm were prepared and housed in a film cartridge shown in FIGS. 1 to 7 of U.S. Pat. No. 5,296,887. The resulting cartridge was installed in a camera and various scenes were photographed at ISO 200. At this time, a gray plate having neutral color with a reflectance of 18% was photographed in each object. After heat development the same as Example 1, image information was read with a film scanner. Based on the image information obtained, image processing was conducted so that the RGB values of neutral gray of all the images agreed with each other and further correction of gradation was conducted. The image information was output to a PICTOROGRAPHY 3000 manufactured by Fuji Photo Film Co., Ltd. to produce a hard copy of an image. The output image obtained was fully satisfactory in image quality and color reproducibility.

According to the present invention, a high speed silver halide photographic lightsensitive material excellent in adhesion resistance during the storage of the lightsensitive material can be obtained. Further, an image-forming method that can reduce development-induced unevenness and that can realize a preferable image quality can also be provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A heat-developable silver halide photographic light sensitive material comprising, on a support, at least one light sensitive silver halide emulsion layer and at least one non-light sensitive layer, wherein the roughness of the surfaces of the light sensitive material satisfies the relationship of formula (1):

$$Rq1/Rq2 \leqq 0.5 \quad (1)$$

wherein Rq1 is the roughness of one of the surfaces of the light sensitive material with which a heat source to heat develop the light sensitive material is to be brought into contact, and Rq2 is the roughness of the other opposing surface of the light sensitive material.

2. The heat-developable silver halide photographic light sensitive material according to claim 1, wherein Rq1 is 50 or less and Rq2 is 100 or more.

3. The heat-developable silver halide photographic light sensitive material according to claim 1, wherein the outermost layer of one of the sides of the light sensitive material with which a heat source is to be brought into contact comprises no matting agent grain, and the outermost layer of the other opposing side of the light sensitive material comprises a matting agent grain.

4. The heat-developable silver halide photographic light sensitive material according to claim 1, wherein the light sensitive silver halide emulsion layer comprises a light sensitive silver halide emulsion containing tabular silver halide grains having an average thickness of in the range of 0.01 $\mu$m to 0.12 $\mu$m.

5. The heat-developable silver halide photographic light sensitive material according to claim 1, wherein the light sensitive silver halide emulsion layer comprises a light sensitive silver halide emulsion containing tabular silver halide grains having adsorbed a sensitizing dye or sensitizing dyes so that the grains have a maximum spectral absorption wavelength of less than 500 nm and a light absorption intensity of 60 or more or have a maximum spectral absorption wavelength of 500 nm or more and a light absorption intensity of 100 or more.

6. The heat-developable silver halide photographic light sensitive material according to claim 1, wherein the light sensitive silver halide emulsion layer and/or the non-light sensitive layer contain a developing agent and/or a precursor thereof.

7. The heat-developable silver halide photographic light sensitive material according to claim 6, wherein the developing agent is at least one compound selected from the group consisting of compounds represented by the following general formulas (1) to (5):

(1)

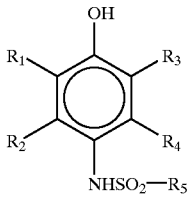

(2)

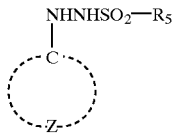

(3)

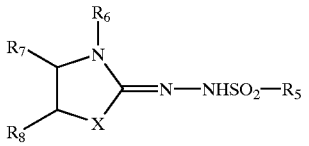

(4)

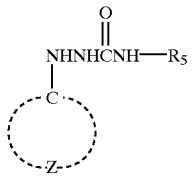

(5)

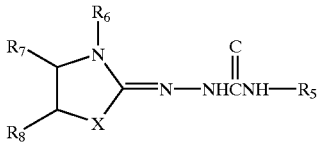

wherein each of $R_1$ to $R_4$ independently represents a hydrogen atom, halogen atom, alkyl group, aryl group, alkylcarbonamido group, arylcarbonamido group, alkylsulfonamido group, arylsulfonamido group, alkoxy group, aryloxy group, alkylthio group, arylthio group, alkylcarbarnoyl group, arylcarbamoyl group, carbamoyl group, alkylsulfamoyl group, arylsulfamoyl group, sulfamoyl group, cyano group, alkylsulfonyl group, arylsulfonyl group, alkoxycarbonyl group, aryloxycarbonyl group, alkylcarbonyl group, arylcarbonyl group or acyloxy group; $R_5$ represents a substituted or unsubstituted alkyl group, aryl group or heterocyclic group; Z represents an atom group capable of forming an aromatic ring (including a heteroaromatic ring) together with the carbon atom, and the aromatic ring may have a substituent, provided that when Z forms a benzene ring, the total of Haimnett's constants (σ) of the substituents is 1 or more; $R_6$ represents a substituted or unsubstituted alkyl group; X represents an oxygen atom, sulfur atom, selenium atom or tertiary nitrogen atom substituted with at least one of alkyl and aryl groups; and $R_7$ and $R_8$ each represent a hydrogen atom or substituent, provided that $R_7$ and $R_8$ may be bonded to each other to thereby form a double bond or a ring.

8. The heat-developable silver halide photographic light sensitive material according to claim 6, wherein the developing agent is a p-phenylenediamine derivative and/or p-aminophenol derivative.

9. The heat-developable silver halide photographic light sensitive material according to claim 6, wherein the precursor of a developing agent is a compound represented by the following general formula (6):

(6)

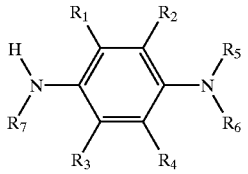

wherein each of $R_1$, $R_2$, $R_3$ and $R_4$ independently represents a hydrogen atom or a substituent; each of $R_5$ and $R_6$ independently represents an alkyl group, aryl group, heterocyclic group, acyl group or sulfonyl group; $R_1$ and $R_2$, $R_3$ and $R_4$, $R_5$ and $R_6$, $R_2$ and $R_5$ and/or $R_4$ and $R_6$ may be bonded to each other to thereby form a 5-membered, 6-membered or 7-membered ring; and $R_7$ represents $R_{11}$—C—CO—, $R_{12}$—CO—CO—, $R_{13}$—NH—CO—, $R_{14}$—$SO_2$—, $R_{15}$—W—C($R_{16}$)($R_{17}$)— or $(M)_{1/n}OSO_2$—, wherein each of $R_{11}$, $R_{12}$, $R_{13}$ and $R_{14}$ independently represents an alkyl group, aryl group or heterocyclic group, $R_{15}$ represents a hydrogen atom or blocking group, W represents an oxygen atom, sulfur atom or >N—$R_{18}$, each of $R_{16}$, $R_{17}$, and $R_{18}$ independently represents a hydrogen atom or alkyl group, M represents a n-valence cation, and n is an integer of 1 to 5.

10. The heat-developable silver halide photographic light sensitive material according to claim 1, wherein the light sensitive silver halide emulsion layer and/or the non-light sensitive layer contain an organometallic salt.

11. The heat-developable silver halide photographic light sensitive material according to claim 1, wherein the light sensitive material is a color silver halide photographic light sensitive material.

12. A heat-developable silver halide photographic light sensitive material comprising, on a support, at least one light sensitive silver halide emulsion layer and at least one non-light sensitive layer, wherein the roughness of the surfaces of the light sensitive material satisfies the relationship of formula (1)

$$Rq1/Rq2 \leqq 0.5 \quad (1)$$

wherein Rq1 is the roughness of one of the surfaces of the light sensitive material with which a heat source to heat develop the light sensitive material is to be brought into contact, and Rq2 is the roughness of the other opposing surface of the light sensitive material;

the outermost layer of one of the sides of the light sensitive material with which the heat source is to be brought into contact comprises no matting agent grain, and the outermost layer of the other opposing side of the light sensitive material comprises a matting agent grain; and the light sensitive silver halide emulsion layer and/or the non-light sensitive layer contain an organometallic salt.

13. The heat-developable silver halide photographic light sensitive material according to claim 12, wherein the light sensitive silver halide emulsion layer comprises a light sensitive silver halide emulsion containing tabular silver halide grains having an average thickness of 0.01 μm or more and 0.12 μm or less.

14. An image-forming method comprising image-wise exposing a silver halide photographic light sensitive material according to claim 1, and then heat-developing a said image-wise exposed silver halide photographic light sensitive material by bringing said light sensitive material into contact with a heat source.

15. The image-forming method according to claim 14, wherein the development temperature is 60° C. or more and 180° C. or less.

16. The image-forming method according to claim 14, wherein the developing time is 5 seconds or more and 60 seconds or less.

17. The image-forming method according to claim 14, wherein a light sensitive silver halide emulsion layer of the light sensitive material is brought into contact with the heat source to heat-develop the light sensitive material.

18. The image-forming method according to claim 14, wherein the light sensitive material is a color silver halide photographic light sensitive material.

19. A heat-developable silver halide photographic light sensitive material having a front and a back surface comprising, on a support having a front surf ace and a back surface, at least one light sensitive silver halide emulsion layer on the front surface and at least one non-light sensitive layer on either the front or back surface, wherein the roughness of the surfaces of the light sensitive material satisfies the relationship of formula (1):

$$Rq1/Rq2 \leqq 0.5 \quad (1)$$

wherein Rq1 is the roughness of one of the surfaces of the light sensitive material with which a heat source to heat develop the light sensitive material is to be brought into contact, and Rg2 is the roughness of the other opposing surface of the light sensitive material.

20. The heat-developable silver halide photographic light sensitive material of claim 19, wherein Rq1 is the roughness of the front surface of the light sensitive material with which the heat source to heat develop the light sensitive material is to be brought into contact, and Rq2 is the roughness of the back surface of the light sensitive material.

21. The heat-developable silver halide photographic light sensitive material of claim 19, wherein Rq1 is the roughness of the back surface of the light sensitive material with which the heat source to heat develop the light sensitive material is to be brought into contact, and Rq2 is the roughness of the front surface of the light sensitive material.

* * * * *